US011307510B2

(12) United States Patent
Wada et al.

(10) Patent No.: US 11,307,510 B2
(45) Date of Patent: Apr. 19, 2022

(54) ELECTROPHOTOGRAPHIC PHOTORECEPTOR, ELECTROPHOTOGRAPHIC PHOTORECEPTOR CARTRIDGE AND IMAGE FORMING APPARATUS

(71) Applicant: Mitsubishi Chemical Corporation, Chiyoda-ku (JP)

(72) Inventors: Mitsuo Wada, Tokyo (JP); Wataru Miyashita, Tokyo (JP); Takahiro Choda, Tokyo (JP); Akira Ando, Tokyo (JP); Hiroe Fuchigami, Tokyo (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/522,198

(22) Filed: Jul. 25, 2019

(65) Prior Publication Data

US 2019/0346779 A1 Nov. 14, 2019

Related U.S. Application Data

(63) Continuation of application No. PCT/JP2018/002355, filed on Jan. 25, 2018.

(30) Foreign Application Priority Data

Jan. 27, 2017 (JP) ..... JP2017-012881
Mar. 22, 2017 (JP) ..... JP2017-056370

(51) Int. Cl.
*G03G 5/00* (2006.01)
*G03G 5/06* (2006.01)
(Continued)

(52) U.S. Cl.
CPC ..... *G03G 5/061473* (2020.05); *G03G 5/047* (2013.01); *G03G 5/0539* (2013.01);
(Continued)

(58) Field of Classification Search
CPC ... G03G 5/0614; G03G 5/0618; G03G 5/0539
See application file for complete search history.

(56) References Cited

U.S. PATENT DOCUMENTS 5,250,377 A * 10/1993 Shimada ..... C07C 255/00 430/58.75
7,381,511 B2 * 6/2008 Ikegami ..... G03G 5/051 399/159

(Continued)

FOREIGN PATENT DOCUMENTS

JP 6-230590 A 8/1994
JP 2004-117849 A 4/2004

(Continued)

OTHER PUBLICATIONS

English language machine translation of JP 2005-037524 (Year: 2005).*

(Continued)

*Primary Examiner* — Mark A Chapman
(74) *Attorney, Agent, or Firm* — Oblon, McClelland, Maier & Neustadt, L.L.P.

(57) ABSTRACT

An object of the present invention is to provide an electrophotographic photoreceptor which can prevent an increase in potential even using a fluorine resin in a charge transport layer, and can achieve both electrical properties and abrasion resistance, and present invention relates to a lamination type electrophotographic photoreceptor, in which a charge transport layer of the lamination type electrophotographic photoreceptor contains a compound having an E_homo of −4.550 eV or more based on structure optimization calcu-
(Continued)

lation by density functional calculation B3LYP/6-31G (d, p) and fluorine resin particles, and a content of the fluorine resin particles is 3% by weight to 20% by weight based on a total mass of the charge transport layer.

12 Claims, 3 Drawing Sheets

(51) Int. Cl.
*G03G 5/047* (2006.01)
*G03G 5/05* (2006.01)

(52) U.S. Cl.
CPC ..... *G03G 5/0614* (2013.01); *G03G 5/0618* (2013.01); *G03G 5/06147* (2020.05)

(56) References Cited

U.S. PATENT DOCUMENTS

2004/0151999 A1 8/2004 Mishra et al.
2004/0234294 A1* 11/2004 Nagame ..... G03G 21/0017 399/159
2006/0013615 A1* 1/2006 Nukada ..... G03G 15/5008 399/159
2009/0180788 A1 7/2009 Tamoto et al.
2013/0260295 A1 10/2013 Iwadate et al.
2015/0017580 A1* 1/2015 Fukushima ..... G03G 5/0503 430/56
2016/0018746 A1* 1/2016 Nagao ..... G03G 5/0614 399/159
2019/0025719 A1* 1/2019 Yamazaki ..... G03G 5/06

FOREIGN PATENT DOCUMENTS

JP 2005037524 A * 2/2005
JP 2005-308925 A 11/2005
JP 2005-345686 A 12/2005
JP 2009-186969 A 8/2009
JP 2013-205540 A 10/2013
JP 2013-246364 A 12/2013
JP 2014-209224 A 11/2014
JP 2015-18036 A 1/2015
JP 2015-52734 A 3/2015
JP 2015-176139 A 10/2015

OTHER PUBLICATIONS

International Search Report dated Apr. 24, 2018 in PCT/JP2018/002355 filed Jan. 25, 2018 (with English Translation).
Written Opinion dated Apr. 24, 2018 in PCT/JP2018/002355 filed Jan. 25, 2018.
Office Action dated Dec. 7, 2021 in the corresponding JP patent application No. 2018-564635 and its English machine translation.

* cited by examiner

ELECTROPHOTOGRAPHIC PHOTORECEPTOR, ELECTROPHOTOGRAPHIC PHOTORECEPTOR CARTRIDGE AND IMAGE FORMING APPARATUS

TECHNICAL FIELD

The present invention relates to an electrophotographic photoreceptor, an electrophotographic photoreceptor cartridge and an image forming apparatus which are used in copiers, printers or the like, and relates to an electrophotographic photoreceptor which has high durability and little deterioration such as an increase in residual potential even in repeated use in an image forming apparatus under a high temperature and high humidity environment.

BACKGROUND ART

In the related art, organic photoreceptors (hereinafter, also simply referred to as photoreceptors) have been widely used as electrophotographic photoreceptors. The organic photoreceptors have advantages over other photoreceptors in that: it is easy to develop materials corresponding to various exposure light sources from visible light to infrared light; materials free from environmental pollution can be selected; the manufacturing cost is low; or the like.

On the other hand, the organic photoreceptors have disadvantages in that: the mechanical strength is weak and easy to abrade; the electrostatic properties of the photoreceptors are easy to deteriorate when printing a large number of sheets; or the like. Particularly in recent years, with the progress of high speed and high image quality of image forming apparatuses, the photoreceptors are required to have, in addition to sensitivity, durability such as stability of the potential against filming and repeated use. Further, the photoreceptor itself is regarded as a portion of parts of the image forming apparatus, and durability (abrasion resistance) is required more than ever. Furthermore, reducing the cost of members used in a process cartridge (electrophotographic photoreceptor cartridge) also progresses, and the use of a charging roll having a low volume resistivity causes a problem of leakage.

Filming is caused by toner-derived wax and an external additive adhered to a photosensitive layer of the photoreceptor. Thus, in order to prevent the wax and external additive from adhering to the photoreceptor, studies are being conducted to disperse materials such as polytetrafluoroethylene resin particles in the photosensitive layer to lower the surface free energy of the photosensitive layer and to reduce the adhesion force between the photosensitive layer and the wax/external additive.

Therefore, in order to improve the abrasion resistance of the photoreceptor, there is known a technique for containing fluorine-containing resin fine particles such as polytetrafluoroethylene resin (PTFE) in an outermost surface layer of a photoreceptor (Patent Literature 1). In addition, there is known a technique for improving the leak property by containing a specific amount of fluorine resin particles (Patent Literature 2).

Further, there is known a technique for improving the electrical properties of a photoreceptor by using a specific charge transport substance having excellent electrical properties (Patent Literature 3).

CITATION LIST

Patent Literature

Patent Literature 1: JP-A-2005-345686
Patent Literature 2: JP-A-H06-230590
Patent Literature 3: JP-A-2009-186969

SUMMARY OF INVENTION

Technical Problem

However, when the fluorine resin particles are dispersed in the photosensitive layer, an increase in potential after exposure when the photoreceptor is repeatedly used becomes remarkable, and a great problem occurs in the durability of the photoreceptor. In addition, depending on the charge transport substance used, it is difficult to achieve both abrasion resistance and electrical properties.

Further, when a specific charge transport substance having excellent electrical properties is used, there are problems that the abrasion resistance of the photoreceptor is insufficient and the leak resistance deteriorates.

As described above, when the fluorine resin particles are used in the charge transport layer, the increase in potential becomes remarkable. An object of the present invention is to provide an electrophotographic photoreceptor, an electrophotographic photoreceptor cartridge and an image forming apparatus which can prevent an increase in potential even when using a fluorine resin in a charge transport layer, and can achieve abrasion resistance and leak property which are in a trade-off relationship with electrical properties.

Solution to Problem

The inventors have conducted intensive studies and as a result, it is found that both the electrical properties and the abrasion resistance of the photoreceptor can be achieved by using a combination of a compound serving as a specific charge transport material and fluorine resin particles. Further, it is found that an electrophotographic photoreceptor can be provided, which has high durability and little deterioration such as an increase in residual potential even in repeated use under high temperature and high humidity. The present invention as follows has been completed.

That is, the present invention provides specific aspects or the like shown in the following [1] to [10].

[1] A lamination type electrophotographic photoreceptor comprising:

a conductive support; and a charge generation layer and a charge transport layer on the conductive support, wherein the charge transport layer contains a compound having a HOMO energy level (E_homo) of −4.550 eV or more based on structure optimization calculation by density functional calculation B3LYP/6-31G (d, p) and fluorine resin particles, and a content of the fluorine resin particles is 3% by weight to 20% by weight based on a total mass of the charge transport layer.

[2] The electrophotographic photoreceptor according to item [1], wherein a surface roughness (Rz) of the electrophotographic photoreceptor is 0.1 μm to 0.4 μm.

[3] The electrophotographic photoreceptor according to item [1] or [2], wherein in a stable structure of the compound having an E_homo of −4.550 eV or more, a calculated value αcal of a polarizability is 70 $Å^3$ or more based on the density functional calculation B3LYP/6-31G (d, p) and HF/6-31G (d, p) calculation.

[4] The electrophotographic photoreceptor according to any one of items [1] to [3], wherein an average primary particle diameter of the fluorine resin particles is 0.05 μm to 1 μm.

[5] The electrophotographic photoreceptor according to any one of items [1] to [4], wherein the compound having an E_homo of −4.550 eV or more includes a compound represented by the following Formula (1):

(1)

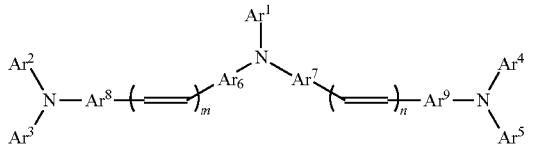

(in the Formula (1), $Ar^1$ to $Ar^5$ each independently represent an aryl group which may have a substituent; $Ar^6$ to $Ar^9$ each independently represent a 1,4-phenylene group which may have a substituent; and m and n each independently represent an integer of 1 to 3).

[6] The electrophotographic photoreceptor according to any one of items [1] to [4], wherein the compound having an E_homo of −4.550 eV or more includes a compound represented by the following Formula (2):

(in the Formula (2), $R^1$, $R^2$, $R^5$ and $R^6$ each independently represent an alkyl group, an alkoxy group, an aryl group or an aralkyl group; m, n, p and q each independently represent an integer of 0 to 3; when $R^1$ and $R^2$ are the same group, m and n represent different integers; when $R^5$ and $R^6$ are the same group, p and q represent different integers; $R^3$ and $R^4$ each independently represent a hydrogen atom or an alkyl group; and when there are a plurality of $R^1$, $R^2$, $R^5$ and $R^6$ respectively, the plurality of groups may be the same or different, and the plurality of groups may be bonded to form a ring).

[7] A lamination type electrophotographic photoreceptor comprising:

a conductive support; and a charge generation layer and a charge transport layer on the conductive support, wherein the charge transport layer contains a compound represented by the following Formula (1) and fluorine resin particles, and a content of the fluorine resin particles is 3% by weight to 20% by weight based on a total mass of the charge transport layer, (1)

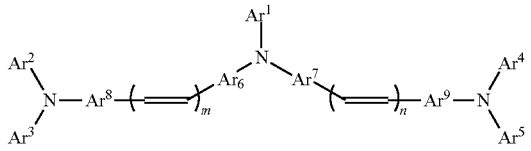

(in the Formula (1), $Ar^1$ to $Ar^5$ each independently represent an aryl group which may have a substituent; $Ar^6$ to $Ar^9$ each independently represent a 1,4-phenylene group which may have a substituent; and m and n each independently represent an integer of 1 to 3).

[8] A lamination type electrophotographic photoreceptor comprising:

a conductive support; and a charge generation layer and a charge transport layer on the conductive support, wherein the charge transport layer contains a compound represented by the following Formula (2) and fluorine resin (2)

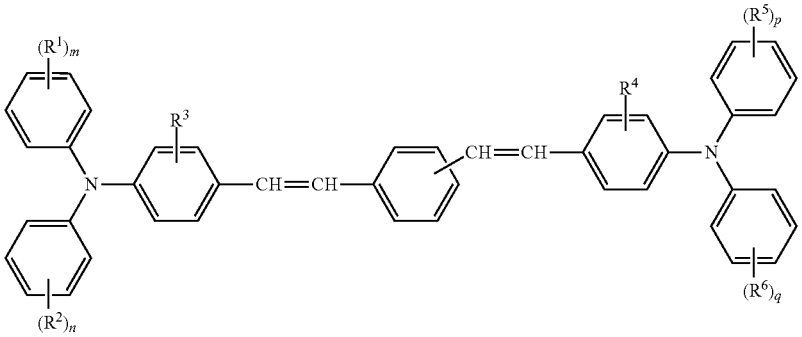

particles, and a content of the fluorine resin particles is 3% by weight to 20% by weight based on a total mass of the charge transport layer, Although the reason why the effects of the present invention are achieved has not been completely elucidated, it is presumed that it is because in the charge transport layer, (2)

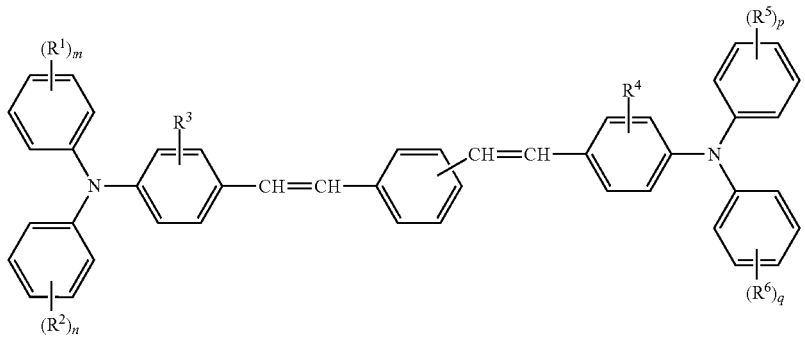

(in the Formula (2), $R^1$, $R^2$, $R^5$ and $R^6$ each independently represent an alkyl group, an alkoxy group, an aryl group or an aralkyl group; m, n, p and q each independently represent an integer of 0 to 3; when $R^1$ and $R^2$ are the same group, m and n represent different integers; when $R^5$ and $R^6$ are the same group, p and q represent different integers; $R^3$ and $R^4$ each independently represent a hydrogen atom or an alkyl group; and when there are a plurality of $R^1$, $R^2$, $R^5$ and $R^6$ respectively, the plurality of groups may be the same or different, and the plurality of groups may be bonded to form a ring).

[9] An electrophotographic photoreceptor cartridge comprising: the electrophotographic photoreceptor according to any one of items [1] to [8]; and at least one device selected from the group consisting of: a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

[10] An image forming apparatus comprising: the electrophotographic photoreceptor according to any one of items [1] to [8]; a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

Advantageous Effects of Invention

The present invention can provide an electrophotographic photoreceptor which has high durability and little deterioration such as an increase in residual potential even in repeated use under high temperature and high humidity, by using a combination of a compound serving as a specific charge transport material and fluorine resin particles in the charge transport layer.

In addition, the present invention can achieve both the electrical properties and the abrasion resistance of the photoreceptor which are contradictory, further preferably can achieve both the electrical properties and the leak property which are contradictory, and can provide an electrophotographic photoreceptor and an electrophotographic cartridge (process cartridge) which are excellent in electrical properties, the abrasion resistance, and preferably leak property.

pores formed by a compound having a specific HOMO energy level or a specific structure, which is a relatively large molecule, are filled with a specific amount of fluorine resin particles appropriately. When the compound is present in a dielectric, pores are generated, and the electric field applied to the pore portion is larger than that of the portion other than the pores. As a result, destruction progresses and leaks easily occur even in the photosensitive layer. If the pores caused by the compound are filled with the fluorine resin particles, it is considered that a photoreceptor excellent in overall property balance can be obtained, which can prevent an increase in electric field, improve the leak property, and contribute to the electrical properties and the abrasion resistance.

DESCRIPTION OF EMBODIMENTS

Figure 1:
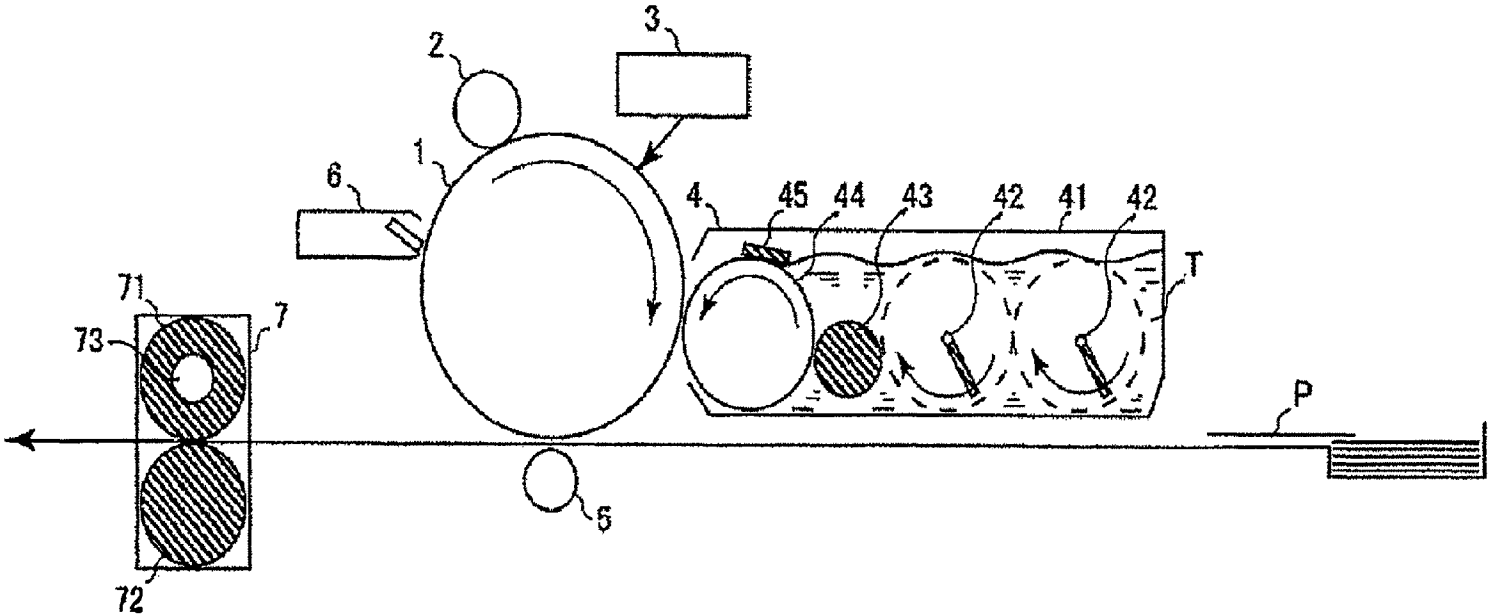
FIG. 1 is a schematic diagram showing a configuration of a main part of one embodiment of an image forming apparatus of the present invention.

Hereinafter, embodiments of the present invention will be described in detail, but the description of the constituent features described below are representative examples of the embodiments of the present invention, and can be appropriately modified and implemented without departing from the spirit of the present invention. In the description, "part by mass" and "part by weight", and "% by mass" and "% by weight" are synonymous with each other, and in the case of "ppm", it means "weight ppm".

<<Charge Transport Substance Used for Photoreceptor of the Present Invention>>

Generally, in the case of a negatively charged lamination type photoreceptor, the surface of the photoreceptor is negatively charged, and after exposure, holes generated in a charge generation layer are injected into a charge transport layer. The injected holes reach the photosensitive layer surface while hopping and conducting an HOMO trajectory of the charge transport substance, cancel the negative charges on the photoreceptor surface, and attenuate to the desired surface potential.

Generally, in a case where fluorine resin particles are contained in the charge transport layer, it is necessary to disperse the fluorine resin particles in a charge transport layer forming coating liquid; the fluorine resin particles are dispersed in the coating liquid using a dispersant, and the coating liquid is coated so as to form a charge transport layer containing the fluorine resin particles. However, impurities, which adversely affect the hopping conduction of the holes in the charge transport layer, such as catalysts and raw material residues during production, remain in the fluorine resin particles and the dispersant in many cases, and when the photoreceptor is used repeatedly, there is an adverse effect that the surface potential increases after exposure.

In order to overcome the above problems, as a result of intensive studies, a conclusion has been obtained that an impurity compound having an HOMO energy level higher than that of an HOMO energy level of the charge transport substance generally used is present in the fluorine resin particles and the dispersant, and this impurity compound traps the holes injected into the charge transport layer, increasing the surface potential after exposure due to repeated use of the photoreceptor.

Therefore, in the present invention, when a charge transport substance having an HOMO energy level higher than the HOMO energy level of the impurity compound derived from the fluorine resin particles and the dispersant is used, the holes injected into the charge transport layer are not trapped by the impurities derived from the fluorine resin particles and reach the surface of the photoreceptor, so that the charges are not accumulated on the charge transport layer. Therefore, even when the photoreceptor is used repeatedly, it is possible to prevent an increase in the surface potential after exposure.

Based on the above reasons, a charge transport substance contained in the charge transport layer which can be used in the present invention preferably has an HOMO energy level (E_homo) of −4.550 eV or more, more preferably −4.500 eV or more, and still more preferably −4.450 eV or more, which is obtained based on structure optimization calculation using B3LYP/6-31G (d, p). When the HOMO energy level is within the above range, the holes injected into the charge transport layer are not trapped by the impurities derived the fluorine resin particles and reach the surface of the photoreceptor, so that the charges are not accumulated on the charge transport layer. Therefore, even when the photoreceptor is used repeatedly, it is possible to prevent an increase in the surface potential after exposure. On the other hand, the upper limit of the HOMO energy level is not particularly limited, and is preferably −4.150 eV or less, more preferably −4.200 eV or less, and still preferably −4.250 eV or less, from the viewpoint of improving gas resistance and preventing ghost.

Further, when HF/6-31G (d, p) calculation is performed with respect to a stable structure based on the structure optimization calculation using B3LYP/6-31G (d, p), a calculated value αcal of a polarizability of the stable structure can be calculated. Based on the density functional calculation B3LYP/6-31G (d, p) and HF/6-31G (d, p) calculation of the compound having an E_homo of −4.550 eV or more, the calculated value αcal of the polarizability in the stable structure of the hole transport material is not particularly limited, and generally the calculated value αcal is preferably 70 $Å^3$ or more, more preferably 80 $Å^3$ or more, and still more preferably 90 $Å^3$ or more.

This is because, a charge transport layer containing a charge transport substance having a large αcal exhibits high charge mobility, and when the charge transport layer is used, an electrophotographic photoreceptor excellent in chargeability, sensitivity and the like can be obtained. On the other hand, from the viewpoint of solubility, the αcal is generally 200 $Å^3$ or less, preferably 170 $Å^3$ or less, more preferably 150 $Å^3$ or less, and still more preferably 130 $Å^3$ or less.

In the present invention, the HOMO energy level E_homo is obtained by calculating a stable structure by structure optimization calculation using B3LYP (see A. D. Becke, J. Chem. Phys. 98, 5648 (1993), C. Lee, W. Yang, and R. G. Parr, Phys. Rev. B37, 785 (1988) and B. Miehlich, A. Savin, H. Stoll, and H. Preuss, Chem. Phys. Lett. 157, 200 (1989)) which is a type of density functional theory. Then, 6-31G (d, p) which is obtained by adding a polarization function to 6-31G is used as the basis function system (see, R. Ditchfield, W. J. Hehre, and J. A. Pople, J. Chem. Phys. 54, 724(1971), W. J. Hehre, R. Ditchfield, and J. A. Pople, J. Chem. Phys. 56, 2257(1972), P. C. Hariharan and J. A. Pople, Mol. Phys. 27, 209(1974), M. S. Gordon, Chem. Phys. Lett. 76, 163(1980), P. C. Hariharan and J. A. Pople, Theo. Chim. Acta 28, 213(1973), J.-P. Blaudeau, M. P. McGrath, L. A. Curtiss, and L. Radom, J. Chem. Phys. 107, 5016(1997), M. M. Francl, W. J. Pietro, W. J. Hehre, J. S. Binkley, D. J. DeFrees, J. A. Pople, and M. S. Gordon, J. Chem. Phys. 77, 3654(1982), R. C. Binning Jr. and L. A. Curtiss, J. Comp. Chem. 11, 1206(1990), V. A. Rassolov, J. A. Pople, M. A. Ratner, and T. L. Windus, J. Chem. Phys. 109, 1223(1998), and V. A. Rassolov, M. A. Ratner, J. A. Pople, P. C. Redfern, and L. A. Curtiss, J. Comp. Chem. 22, 976(2001)). In the present invention, the B3LYP calculation using 6-31G (d, p) is described as B3LYP/6-31G (d, p).

Further, the polarizability αcal is determined by the restricted Hartree-Fock method calculation (see "Modern Quantum Chemistry", A. Szabo and N. S. Ostlund, McGraw-Hill publishing company, New York, 1989) in the stable structure obtained by the structure optimization calculation using the above B3LYP/6-31G (d, p). At this time, 6-31G (d, p) is used as a basis function. In the present invention, the Hartree-Fock calculation using 6-31 G (d, p) is described as HF/6-31G (d, p).

In the present invention, a program used for both the B3LYP/6-31G (d, p) calculation and HF/6-31G (d, p) calculation is Gaussian 03, Revision D. 01 (see, M. J. Frisch, G. W. Trucks, H. B. Schlegel, G. E. Scuseria, M. A. Robb, J. R. Cheeseman, J. A. Montgomery, Jr., T. Vreven, K. N. Kudin, J. C. Burant, J. M. Millam, S. S. lyengar, J. Tomasi, V. Barone, B. Mennucci, M. Cossi, G. Scalmani, N. Rega, G. A. Petersson, H. Nakatsuji, M. Hada, M. Ehara, K. Toyota, R. Fukuda, J. Hasegawa, M. Ishida, T. Nakajima, Y. Honda, O. Kitao, H. Nakai, M. Klene, X. Li, J. E. Knox, H. P. Ilratchian, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, P. Y. Ayala, K. Morokuma, G. A. Voth, P. Salvador, J. J. Dannenberg, V. G. Zakrzewski, S. Dapprich, A. D. Daniels, M. C. Strain, O. Farkas, D. K. Malick, A. D. Rabuck, K. Raghavachari, J. B. Foresman, J. V. Ortiz, Q. Cui, A. G. Baboul, S. Clifford, J. Cioslowski, B. B. Stefanov, G. Liu, A. Liashenko, P. Piskorz, I. Komaromi, R. L. Martin, D. J. Fox, T. Keith, M. A. Al-Laham, C. Y. Peng, A. Nanayakkara, M. Challacombe, P. M. W. Gill, B. Johnson, W. Chen, M. W. Wong, C. Gonzalez, and J. A. Pople, Gaussian, Inc., Wallingford Conn., 2004.).

The structure of the charge transport substance satisfying the parameters of the present invention is not limited, and examples thereof include electron-donating materials such as aromatic amine derivatives, stilbene derivatives, butadiene derivatives, hydrazone derivatives, carbazole derivatives, aniline derivatives, enamine derivatives, and compounds where two or more of these compounds bond together, or polymers each including, in the main chain or a side chain thereof, a group constituted of any of these compounds. Preferred among these are aromatic amine derivatives, stilbene derivatives, hydrazone derivatives, enamine derivatives, and compounds where two or more of these compounds bond together; more preferred among these are enamine derivatives, and those in which aromatic amines bond together; and it is more preferable to contain at least one of compounds represented by the following formulas (1) and (2).

(1)

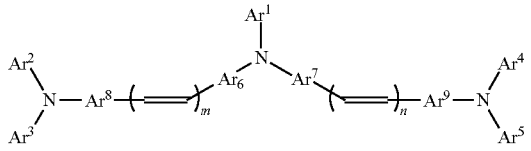

(In the Formula (1), $Ar^1$ to $Ar^5$ each independently represent an aryl group which may have a substituent, and $Ar^6$ to $Ar^9$ each independently represent a 1,4-phenylene group which may have a substituent. m and n each independently represent an integer of 1 to 3.)

In the Formula (1), $Ar^1$ to $Ar^5$ each independently represent an aryl group which may have a substituent. The number of carbon atoms of the aryl group is preferably 30 or less, more preferably 20 or less, and still more preferably 15 or less. Specific examples of the aryl group include a phenyl group, a naphthyl group, a biphenyl group, an anthryl group, a phenanthryl group, or the like. Among these, a phenyl group, a naphthyl group and an anthryl group are preferred in consideration of the properties of the electrophotographic photoreceptor, and from the viewpoint of charge transport ability, a phenyl group and a naphthyl group are more preferred, and a phenyl group is still more preferred.

Examples of the substituent which $Ar^1$ to $Ar^5$ may have include an alkyl group, an aryl group, an alkoxy group, a halogen atom, or the like. Specific examples of the alkyl group include linear alkyl groups such as a methyl group, an ethyl group, an n-propyl group and an n-butyl group, branched alkyl groups such as an isopropyl group and an ethylhexyl group, and cycloalkyl groups such as a cyclohexyl group. Examples of the aryl group include a phenyl group and a naphthyl group which may have a substituent. Examples of the alkoxy group include linear alkoxy groups such as a methoxy group, an ethoxy group, an n-propoxy group and n-butoxy group, branched alkoxy groups such as an isopropoxy group and an ethylhexyloxy group, cycloalkoxy groups such as a cyclohexyloxy group, alkoxy groups having a fluorine atom such as a trifluoromethoxy group, a pentafluoroethoxy group and a 1,1,1-trifluoroethoxy group. Examples of the halogen atom include a fluorine atom, a chlorine atom, a bromine atom, or the like.

Among these, an alkyl group having 1 to 20 carbon atoms and an alkoxy group having 1 to 20 carbon atoms are preferred from the versatility of producing raw materials, an alkyl group having 1 to 12 carbon atoms and an alkoxy group having 1 to 12 carbon atoms are more preferred from the viewpoint of handleability during production, and an alkyl group having 1 to 6 carbon atoms and an alkoxy group having 1 to 6 carbon atoms are still more preferred from the viewpoint of light attenuation properties as the electrophotographic photoreceptor.

In a case where $Ar^1$ to $Ar^5$ are phenyl groups, it is preferable to have a substituent from the viewpoint of charge transport ability, and the number of the substituent can be 1 to 5, but is preferably 1 to 3 from the versatility of the producing raw materials, and is more preferably 1 to 2 from the viewpoint of the properties of the electrophotographic photoreceptor. In addition, in a case where $Ar^1$ to $Ar^5$ are naphthyl groups, it is preferable that the number of the substituent is 2 or less, or there is no substituent, and it is more preferably that the number of the substituent is 1, or there is no substituent, from the versatility of the producing raw materials.

$Ar^1$ to $Ar^5$ preferably have at least one substituent at an ortho or para position with respect to a nitrogen atom, and the substituent is preferably an alkoxy group having 1 to 6 carbon atoms or an alkyl group having 1 to 6 carbon atoms from the viewpoint of solubility.

In the Formula (1), $Ar^6$ to $Ar^9$ each independently represent a 1,4-phenylene group which may have a substituent, that is, an arylene group. The number of carbon atoms of the arylene group is preferably 30 or less, more preferably 20 or less, and still more preferably 15 or less. Specific examples thereof include a phenylene group, a biphenylene group, a naphthylene group, an anthrylene group and a phenanthrylene group. Among these, a phenylene group and a naphthylene group are preferred, and a phenylene group is more preferred in consideration of the properties of the electrophotographic photoreceptor. As the substituent which $Ar^6$ to $Ar^9$ may have, those mentioned as the substituent which $Ar^1$ to $Ar^5$ may have can be applied. Among these, an alkyl group having 1 to 6 carbon atoms and an alkoxy group having 1 to 6 carbon atoms are preferred from the versatility of producing raw materials, an alkyl group having 1 to 4 carbon atoms and an alkoxy group having 1 to 4 carbon atoms are more preferred from the viewpoint of handleability during production, and a methyl group, an ethyl group, a methoxy group, and an ethoxy group are still more preferred from the viewpoint of light attenuation properties as the electrophotographic photoreceptor. When $Ar^6$ to $Ar^9$ have a substituent, the molecular structure may be distorted, which may prevent the expansion of n conjugation in the molecule and reduce the electron transport ability, so that $Ar^6$ to $Ar^9$ preferably have no substituent.

m and n each independently represent an integer of 1 to 3. When m and n are large, the solubility in a coating solvent tends to decrease, so that m and n each is preferably 2 or less and, from the viewpoint of charge transport ability as the charge transport substance, is more preferably 1. In a case where m and n each represent 1, it represents an ethenyl group and has a geometric isomer, but from the viewpoint of the properties of the electrophotographic photoreceptor, a transformer structure is preferred. In a case where m and n each represent 2, it represents a butadienyl group, and also has a geometric isomer, but from the viewpoint of coating liquid storage stability, a mixture of two or more geometric isomers is preferred.

(2)

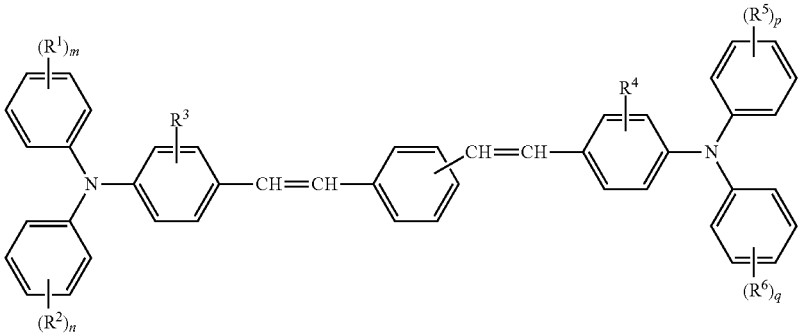

(In the Formula (2), $R^1$, $R^2$, $R^5$ and $R^6$ each independently represent an alkyl group, an alkoxy group, an aryl group or an aralkyl group. m, n, p and q each independently represent an integer of 0 to 3. When $R^1$ and $R^2$ are the same group, m and n represent different integers. When $R^5$ and $R^6$ are the same group, p and q represent different integers. $R^3$ and $R^4$ each independently represent a hydrogen atom or an alkyl group. When there are a plurality of $R^1$, $R^2$, $R^5$ and $R^6$ respectively, the plurality of groups may be the same or different, and the plurality of groups may be bonded to form a ring.)

The electrophotographic photoreceptor of the present invention may contain the compound represented by the Formula (1) or the Formula (2) as a single component in the charge transport layer, or can contain a mixture of at least one of the compound represented by the Formula (1) and the compound represented by the Formula (2) in the charge transport layer, and can also contain a mixture of the compound represented by the Formula (1) and the compound represented by the Formula (2) in the charge transport layer.

In addition, among the compounds represented by the Formula (1), a compound represented by the following Formula (3) is particularly preferred. In the Formula (3), $Ar^1$ in the Formula (1) is a phenyl group having an alkyl group, an alkoxy group, an aryloxy group or an aralkyloxy group, $Ar^2$ to $Ar^5$ are each independently a phenyl group which may have an alkyl group having 1 to 6 carbon atoms as a substituent, $Ar^6$ to $Ar^9$ are each an unsubstituted 1,4-phenylene group, and both m and n are 1.

(3)

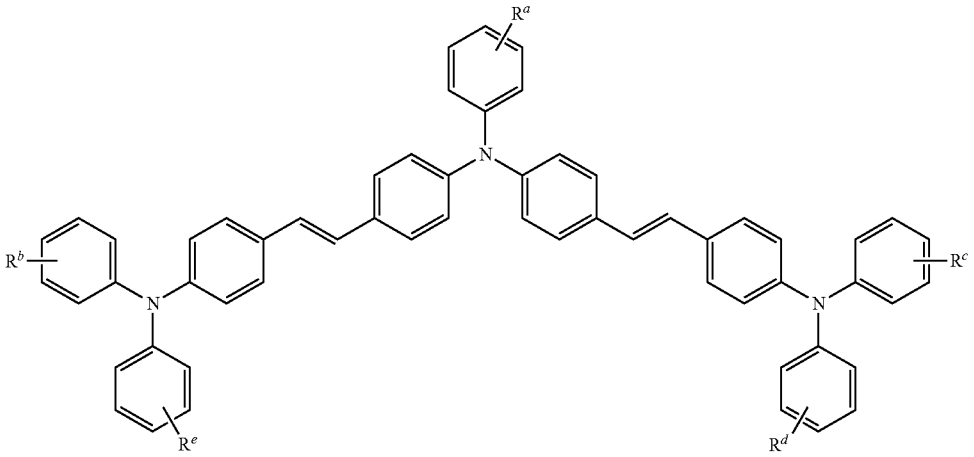

(In the above Formula (3), $R^a$ to $R^e$ each independently represent an alkyl group, an alkoxy group, an aryloxy group, an aralkyloxy group or a hydrogen atom.)

In the photosensitive layer, as a proportion of a binder resin to at least one compound of the compounds represented by the Formula (1) and the Formula (2) or the total amount of these compounds (charge transport substance), the charge transport substance is generally used in an amount of 10 parts by mass or more, and preferably 20 parts by mass or more, based on 100 parts by mass of the binder resin in the same layer. 25 parts by mass or more is more preferred from the viewpoint of reducing residual potential, and 30 parts by mass or more is still more preferred and 40 parts by mass or more is particularly preferred from the viewpoint of stability and charge mobility when repeatedly used. On the other hand, the charge transport substance is generally used in an amount of 150 parts by mass or less, and preferably 80 parts by mass or less from the viewpoint of thermal stability of the photosensitive layer. 75 parts by mass or less is preferred from the viewpoint of the compatibility between the charge transport substance and the binder resin, 70 parts by mass or less is more preferred from the viewpoint of heat resistance, 65 parts by mass or less is still more preferred from the viewpoint of scratch resistance, and 60 parts by mass or less is particularly preferred from the viewpoint of abrasion resistance. The above range is preferred from the viewpoint of charge mobility, stability, and abrasion resistance of the photosensitive layer.

The structure of the charge transport substance represented by the Formula (1), which is suitable for the present invention, will be exemplified below. The following structures are exemplified to make the present invention more specific, and the present invention is not limited to the following structures without departing from the concept of the present invention.

In the structural formulas in this description, Et represents an ethyl group, Me represents a methyl group, Bu represents a butyl group, n represents normal (linear without branching), and t—represents tertiary (branched with branching).

CT1

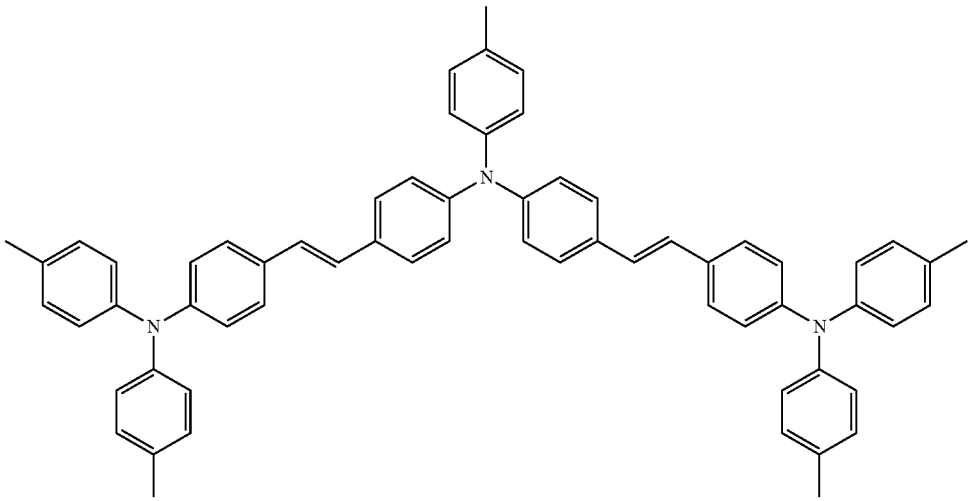

CT2

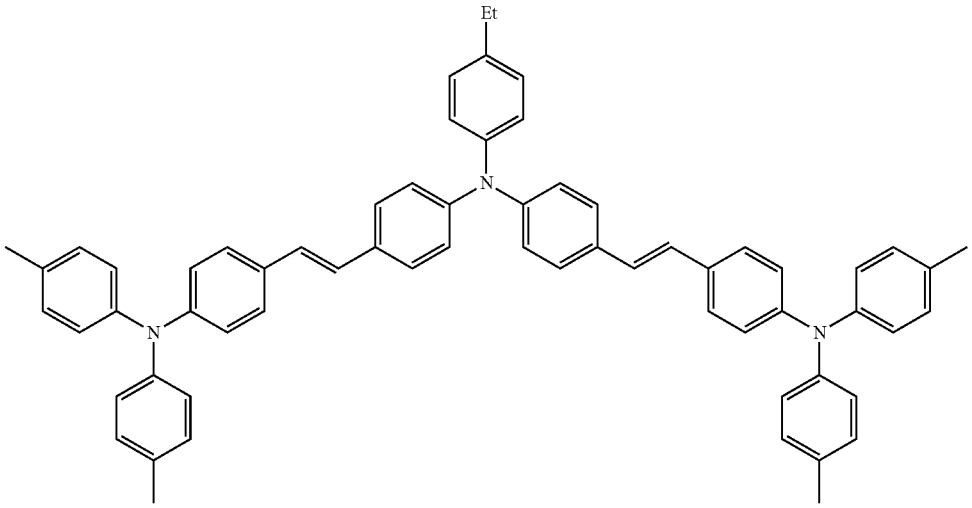

-continued
CT3
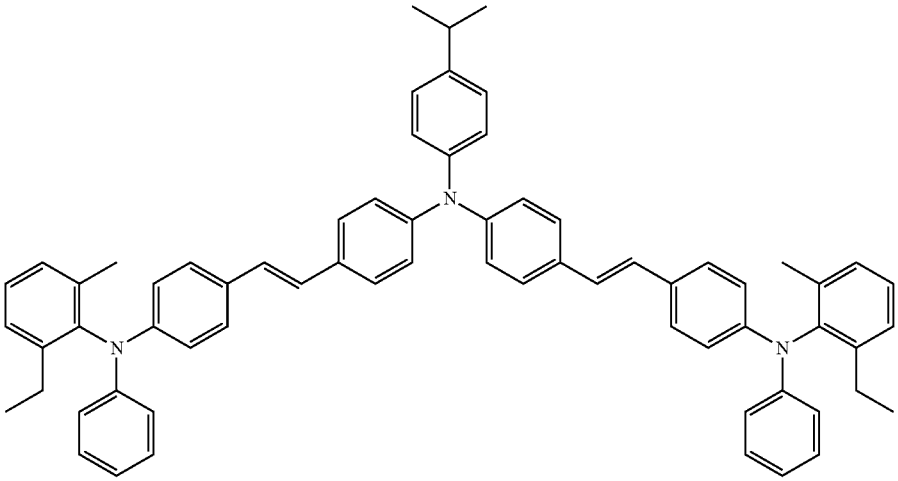
CT4
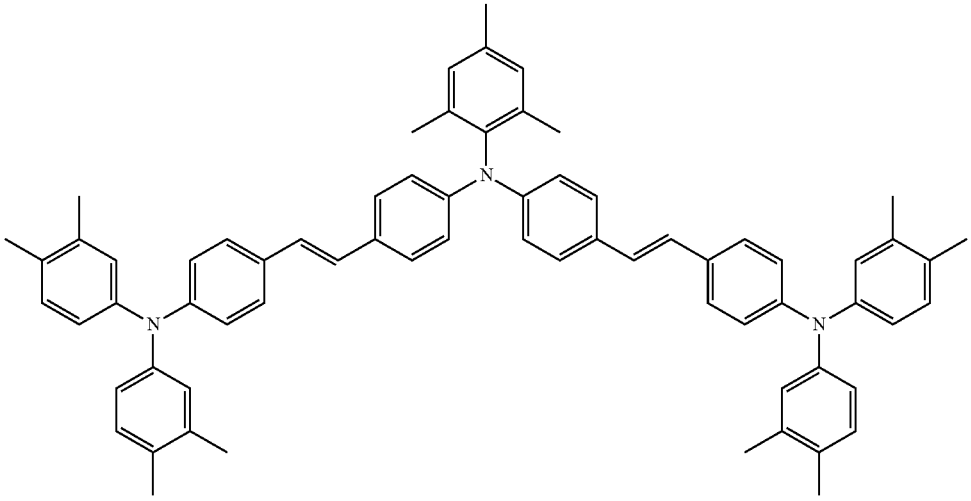
CT5
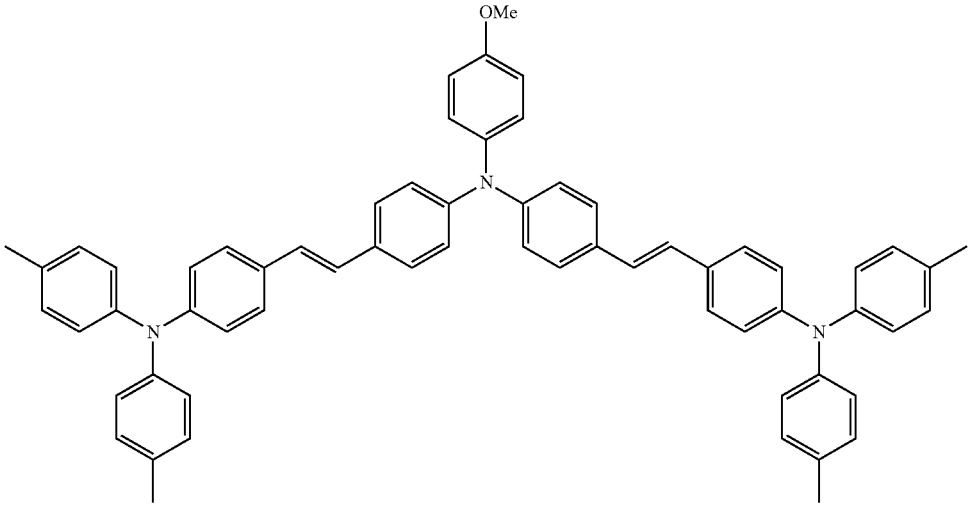

-continued
CT6
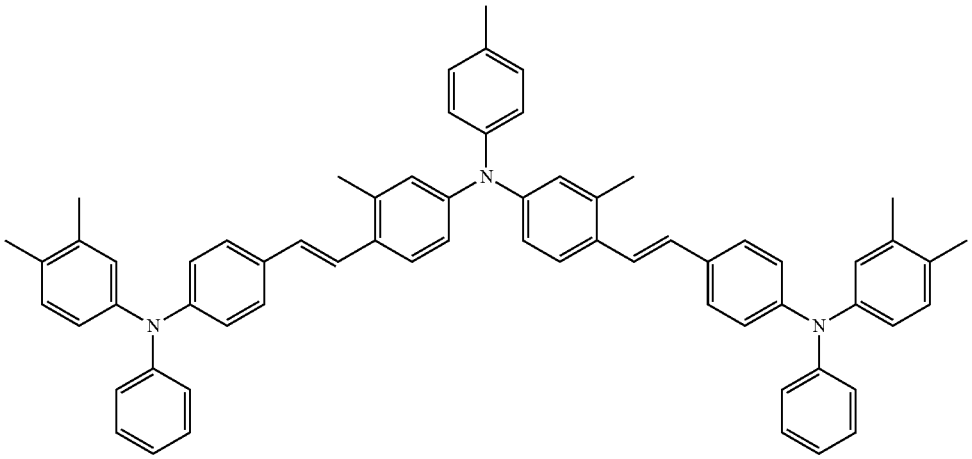
CT7
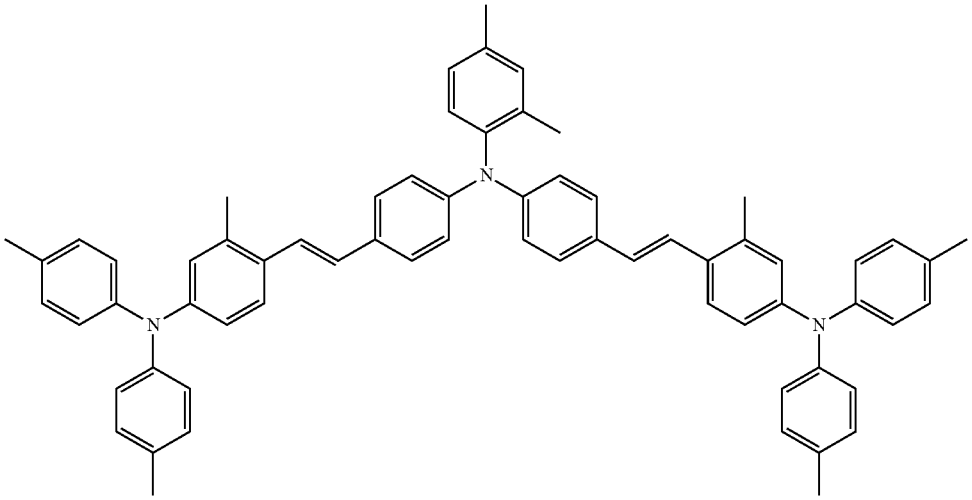
CT8
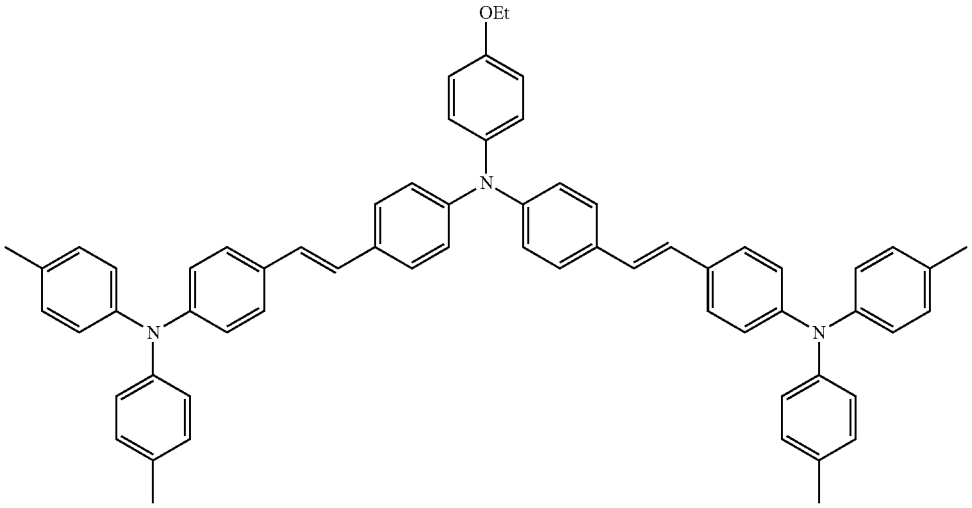

-continued
CT9
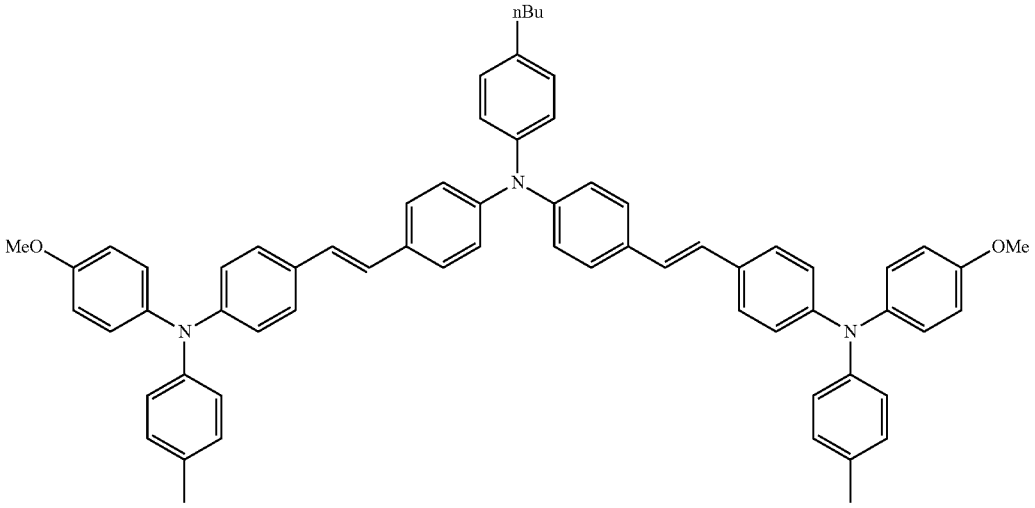
CT10
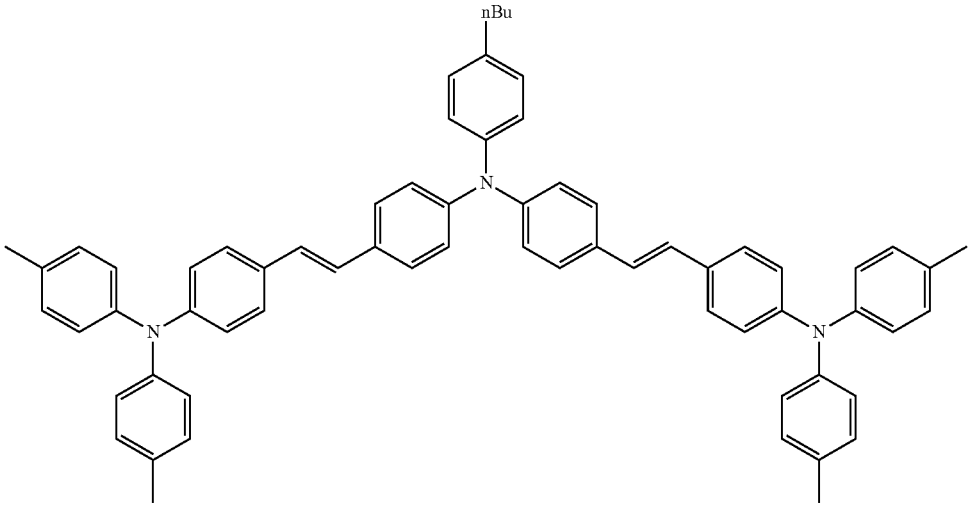
CT11
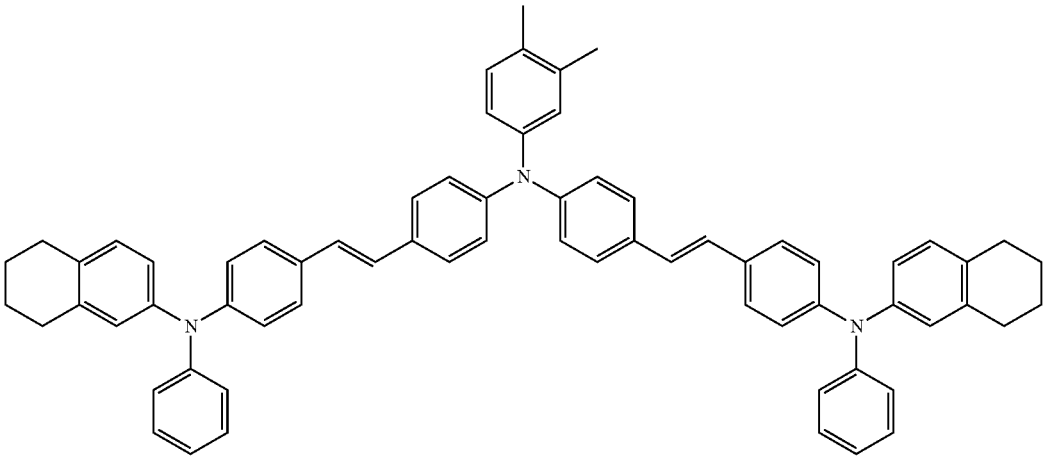

-continued
CT12
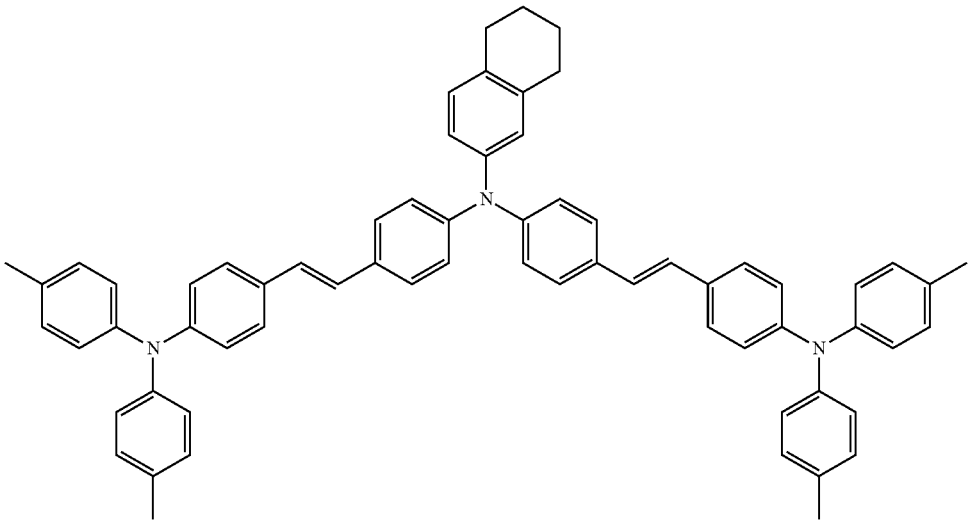
CT13
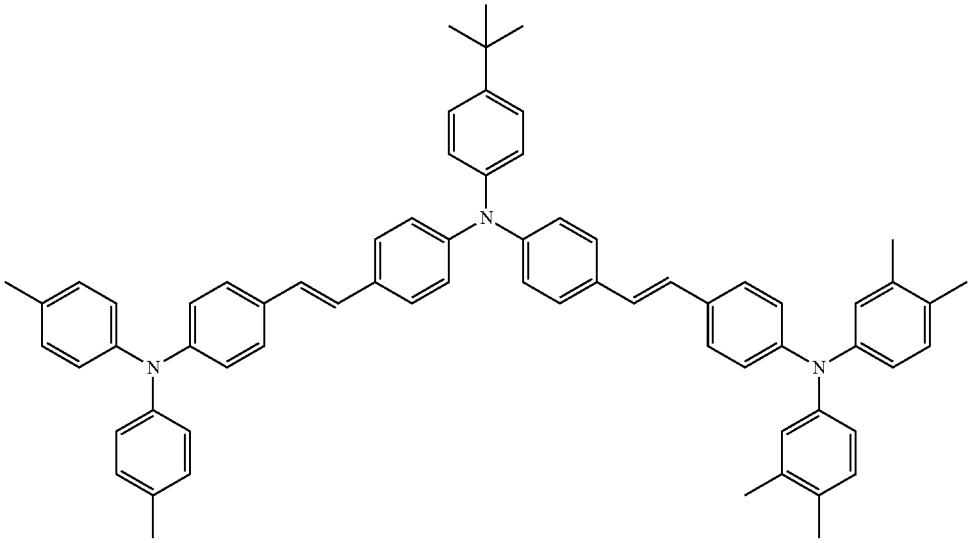
CT14
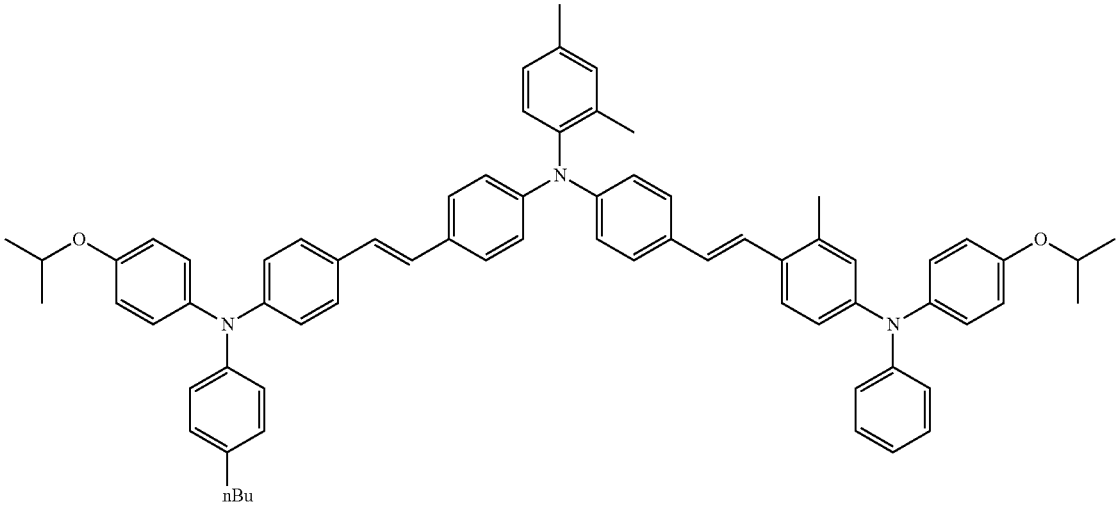

-continued
CT15
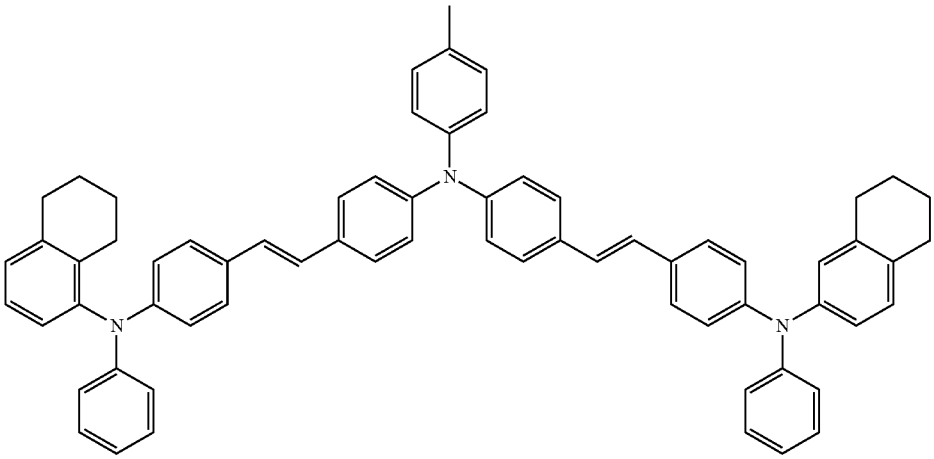
CT16
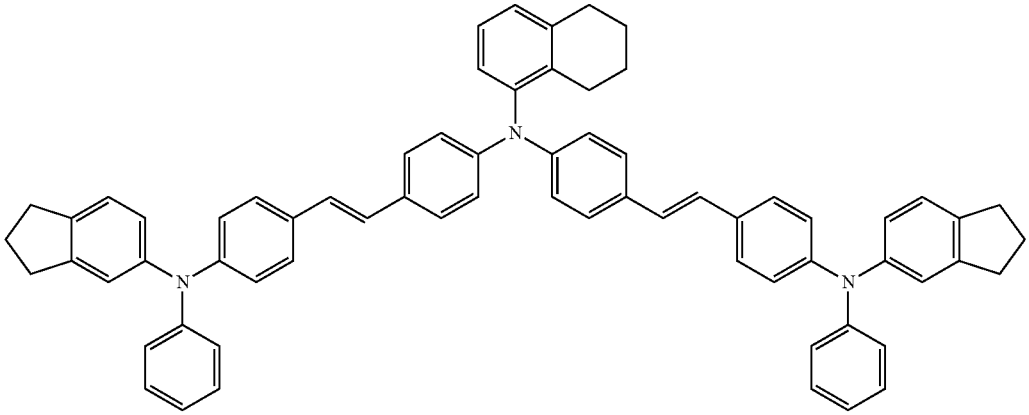
CT17
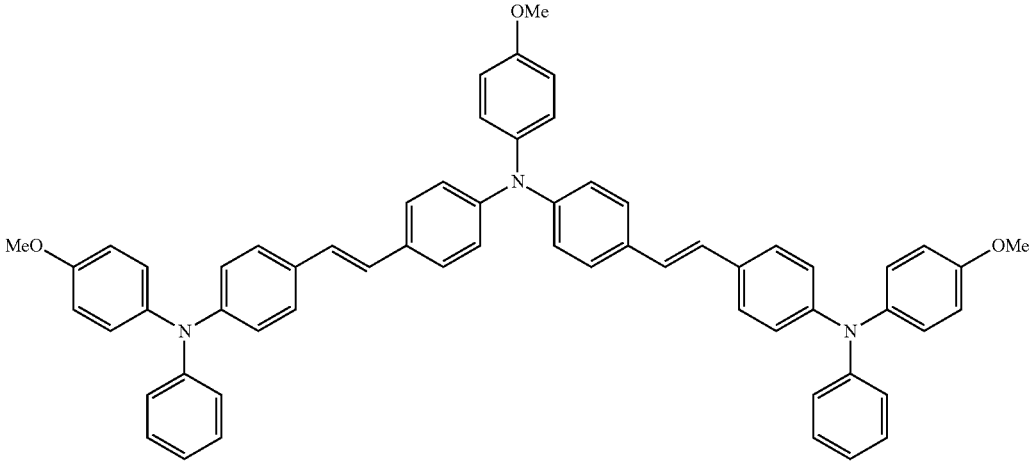

-continued
CT18
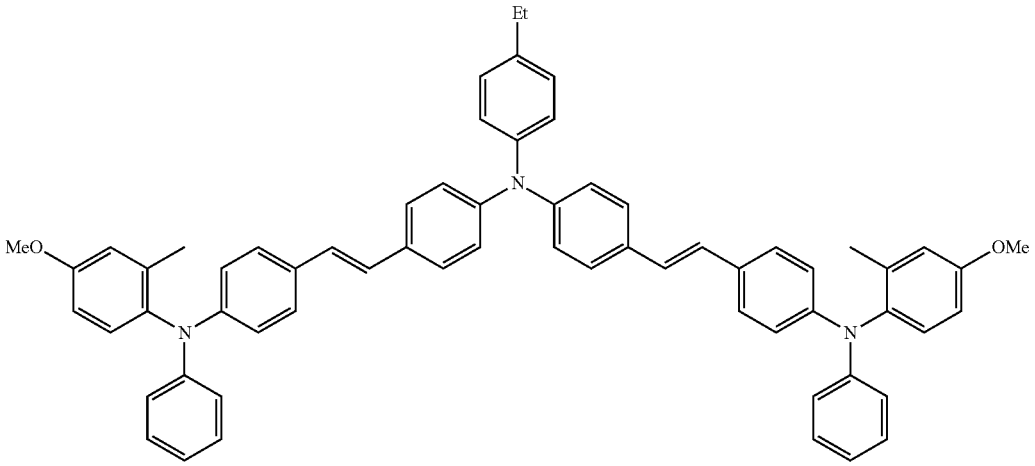
CT19
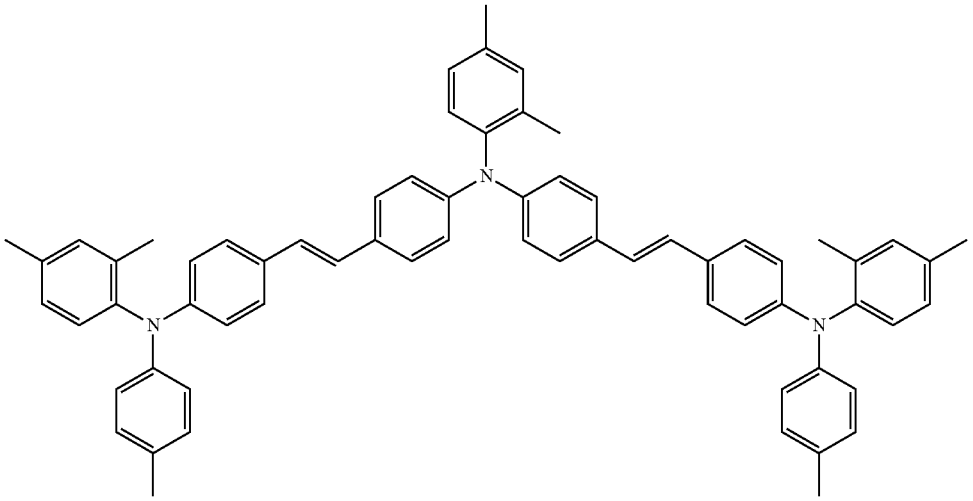
CT20
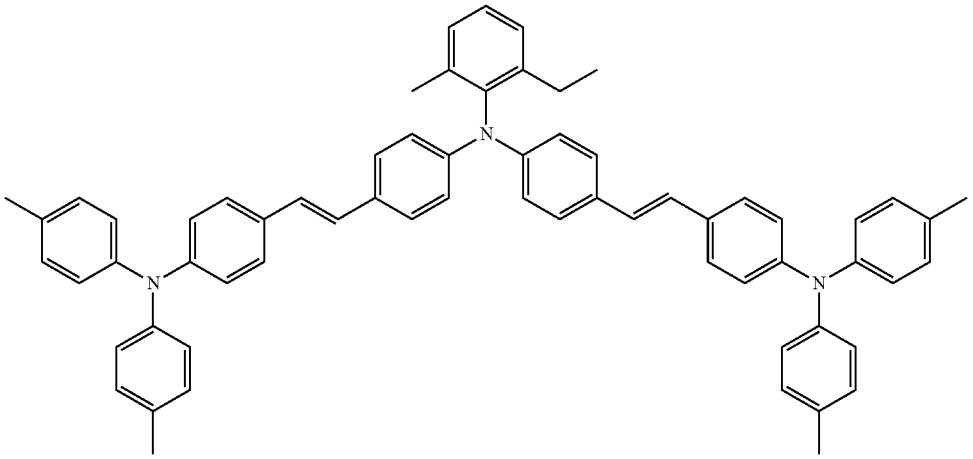

-continued
CT21
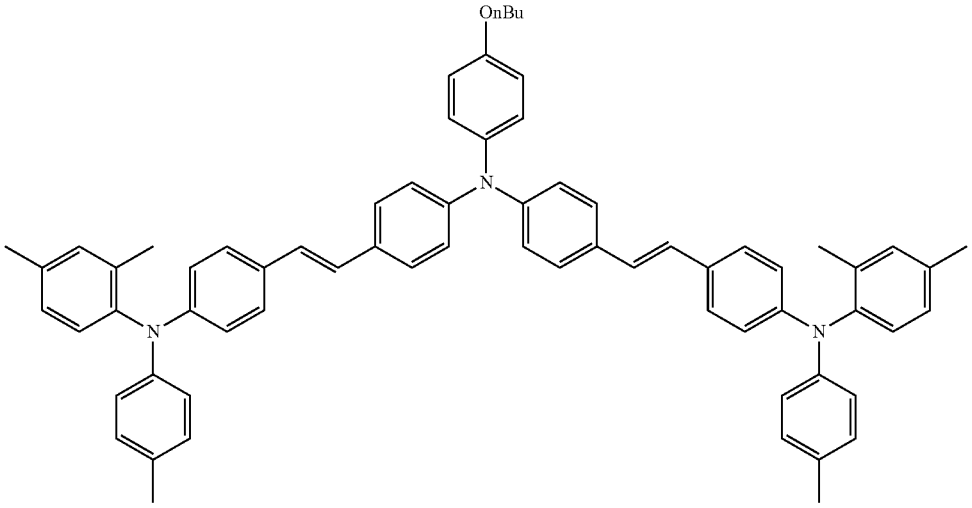
CT22
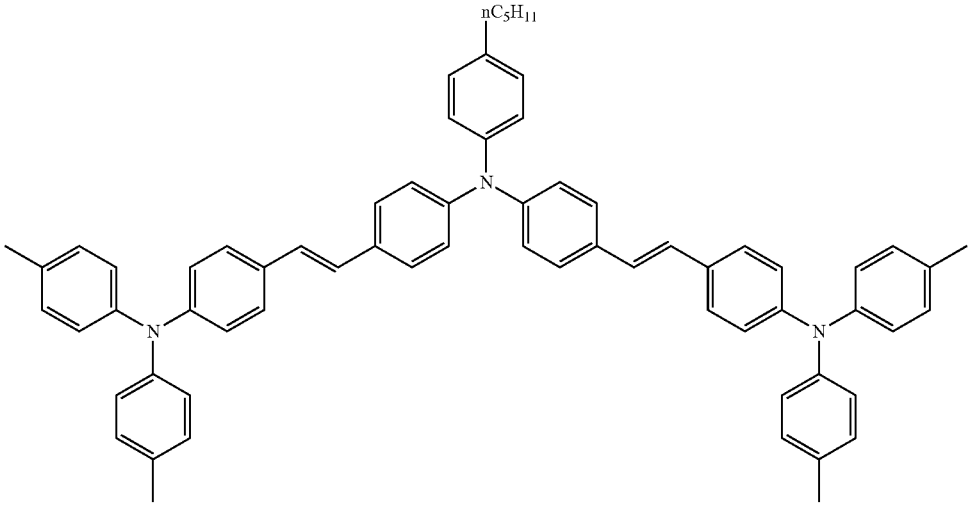
CT23
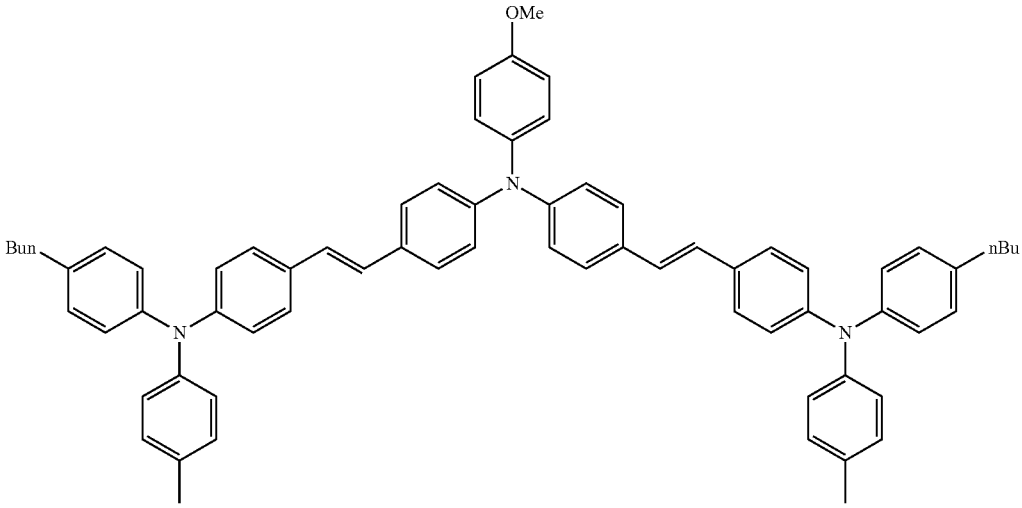

-continued
CT24
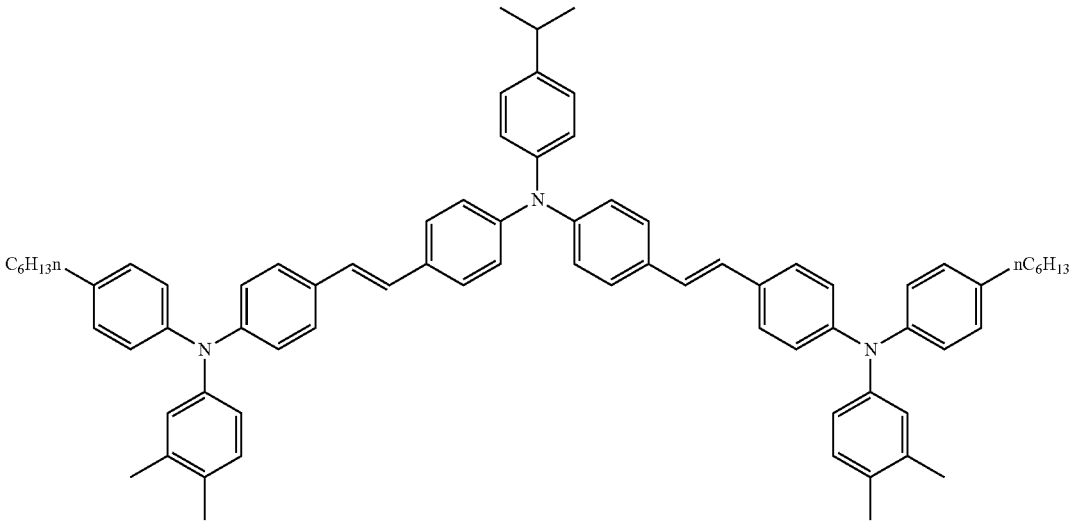
CT25
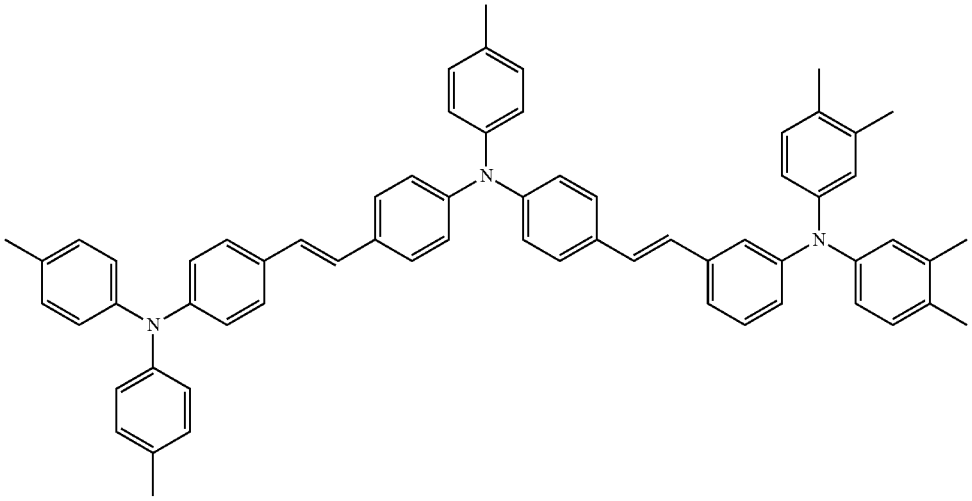
CT26
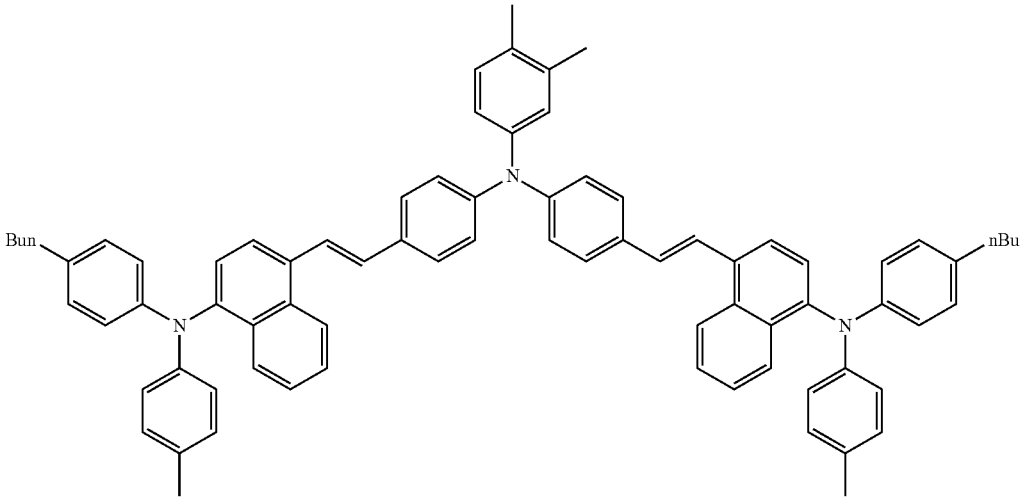

-continued
CT27
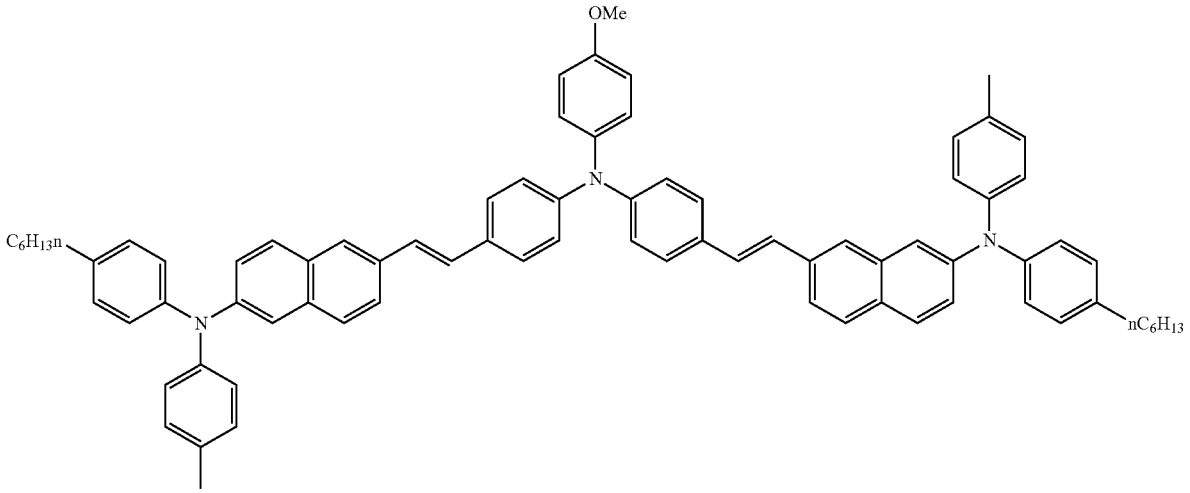
CT28
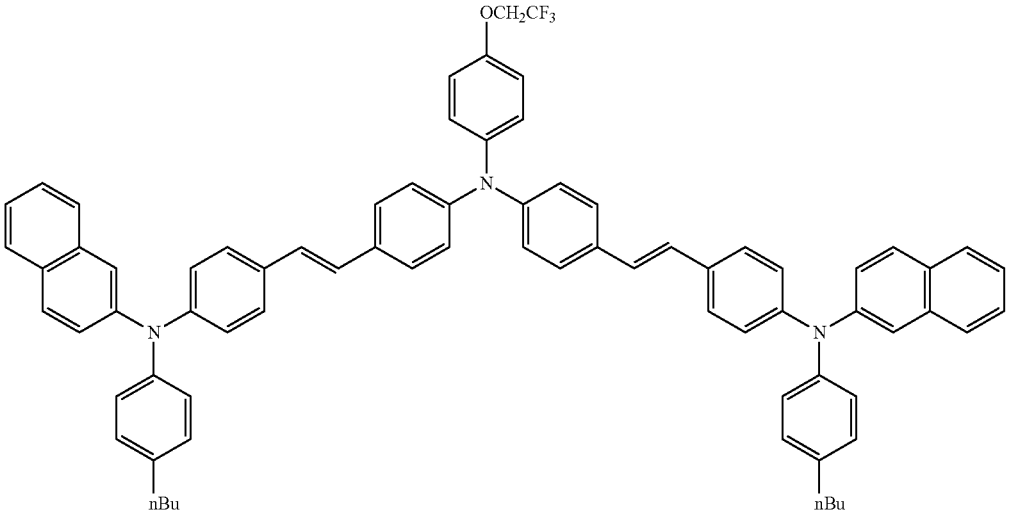
CT29
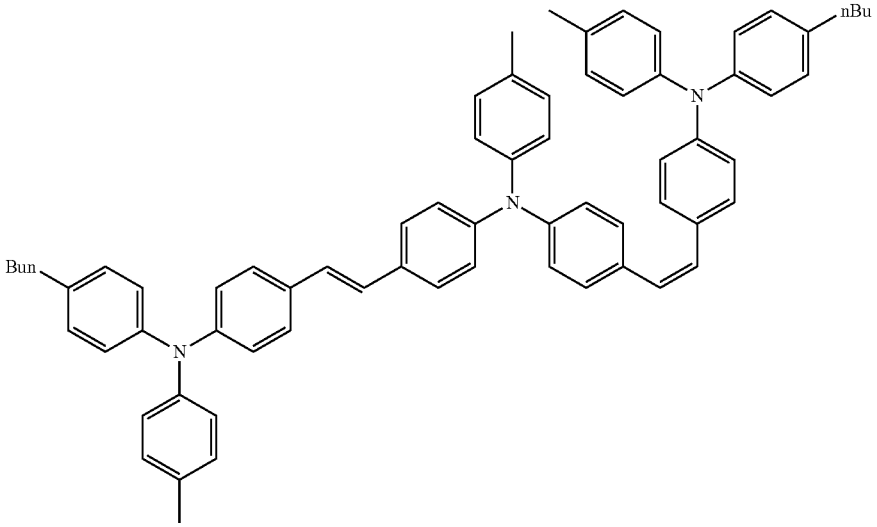

-continued

CT30

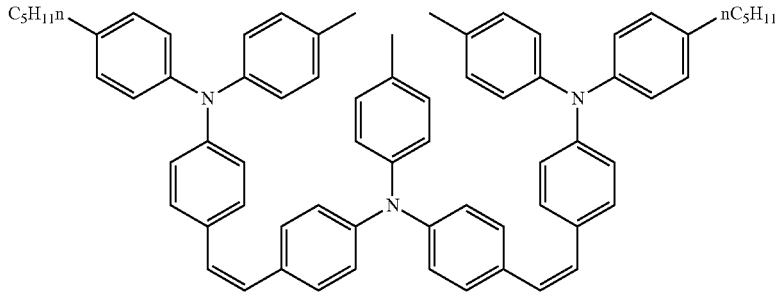

CT31

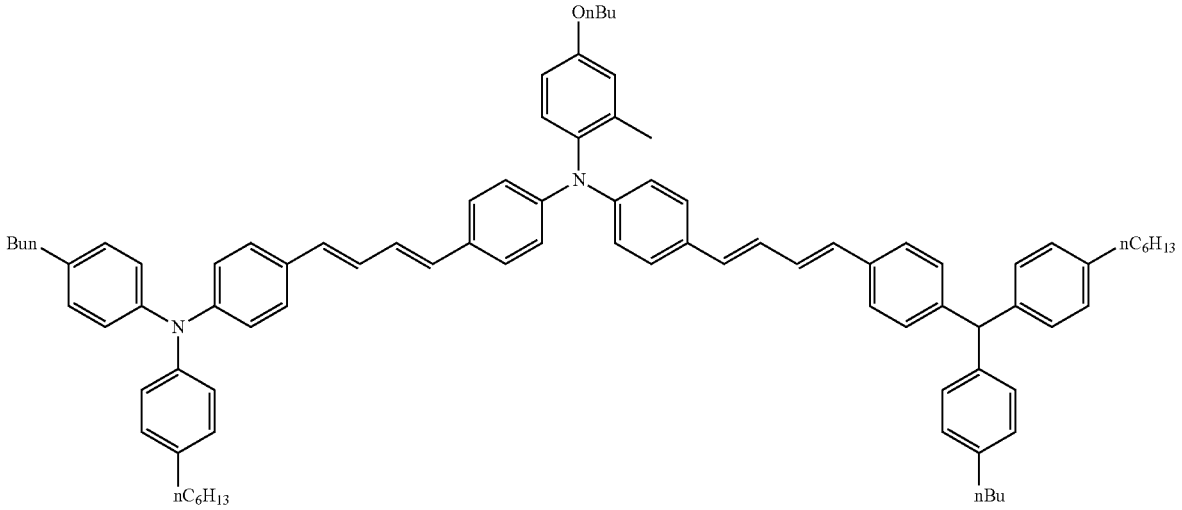

CT32

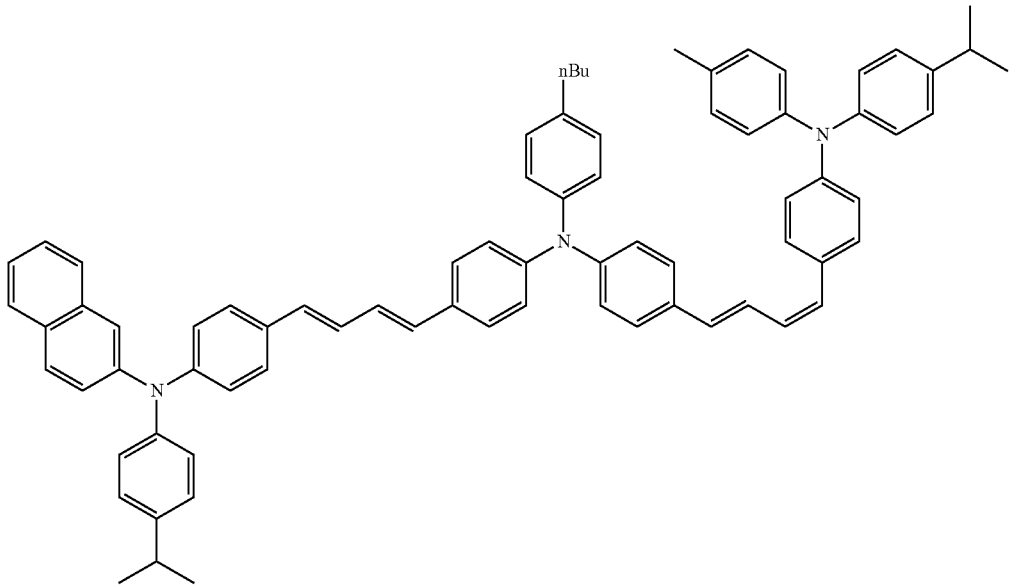

Among the compounds represented by the above Formula (1), compounds represented by CT1, CT2, CT3, CT5, CT8, CT9, CT10, CT18, CT20 and CT22 are preferred from the viewpoint of residual potential after exposure, and compounds represented by CT1, CT2, CT5, CT8, CT10, CT20 and CT22 are more preferred from the viewpoint of mobility and responsiveness of hole transport.

In addition, the structure of the charge transport substance represented by the Formula (2) will be exemplified. The following structures are exemplified to make the present invention more specific, and the present invention is not limited to the following structures without departing from the concept of the present invention.

(HT-1)
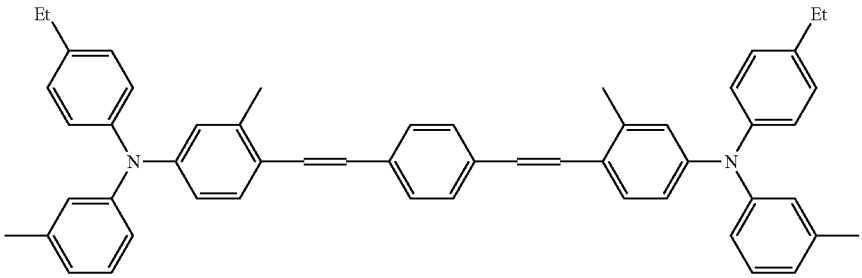
(HT-2)
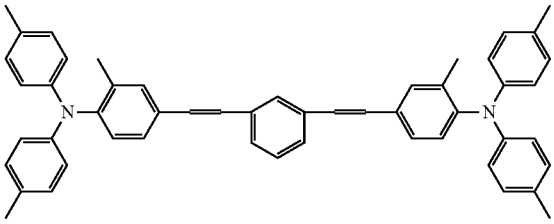
(HT-3)
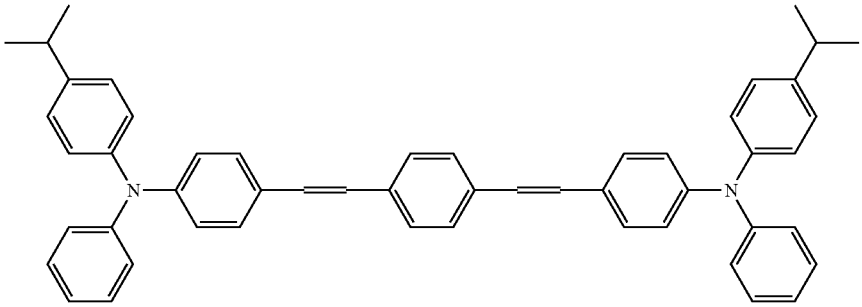
(HT-4)
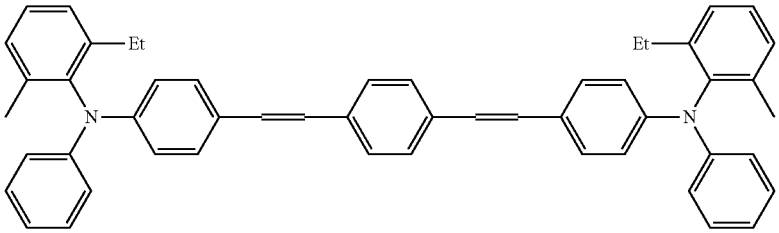
(HT-5)
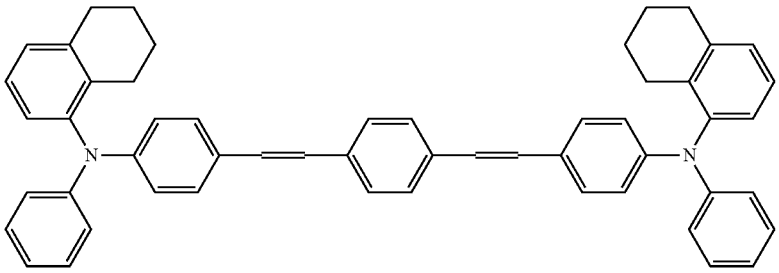
(HT-6)
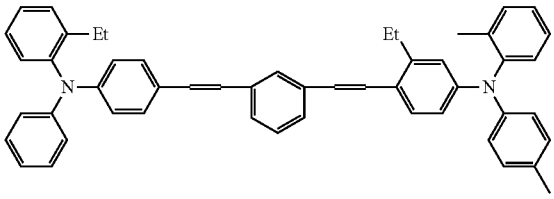
(HT-7)
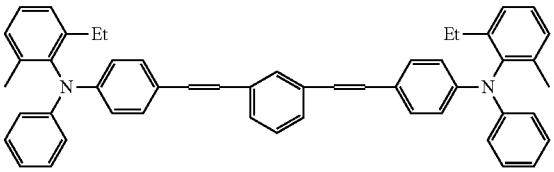

-continued
(HT-8)
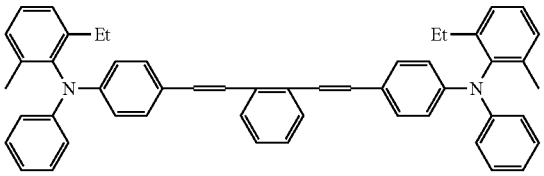
(HT-9)
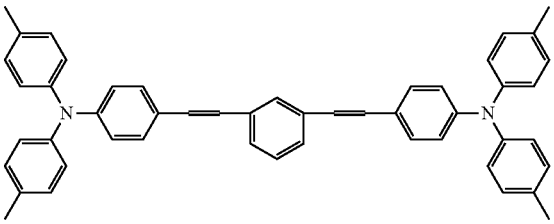
(HT-10)
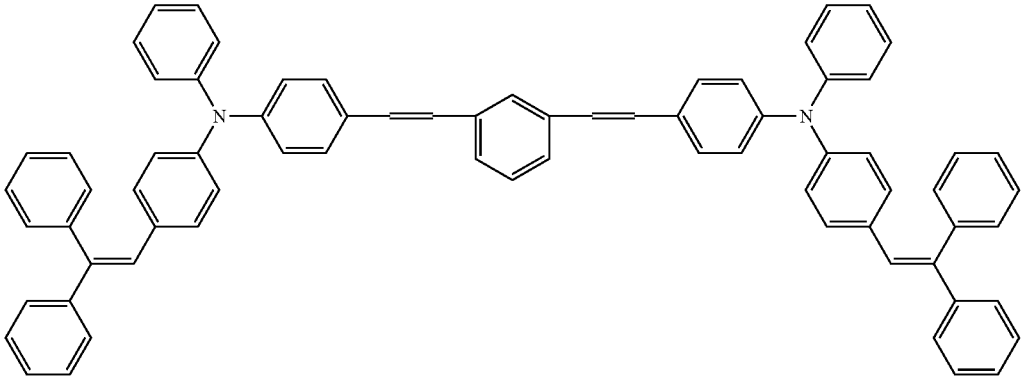
(HT-11)
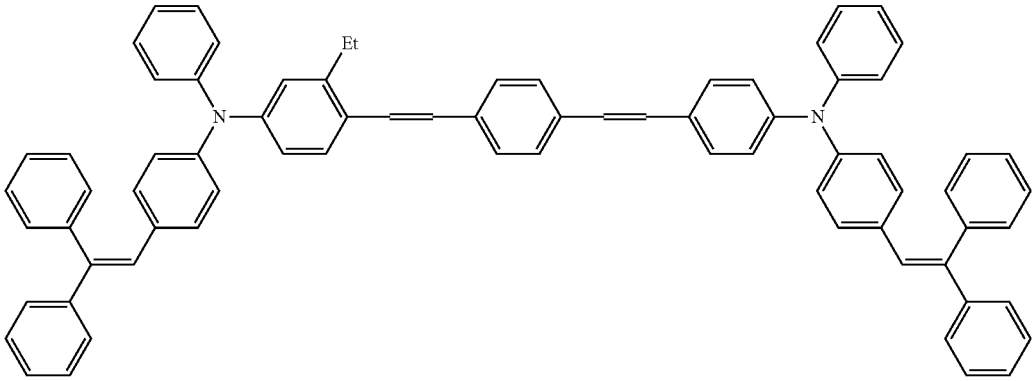
(HT-12)
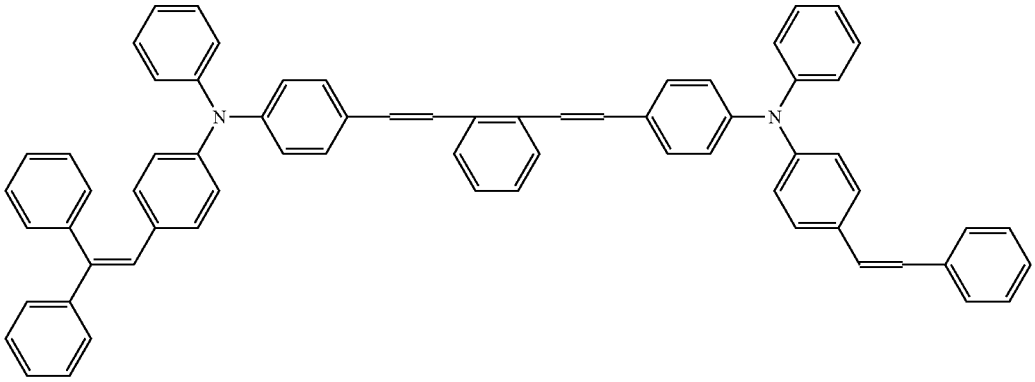
(HT-13)
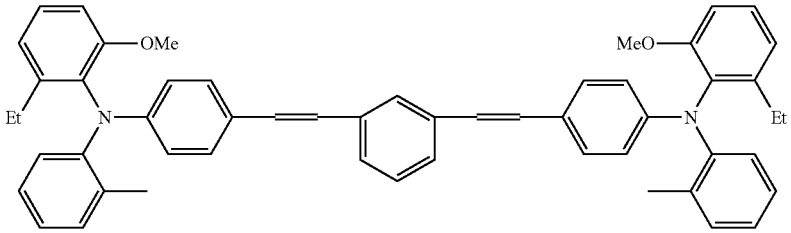

-continued (HT-14)

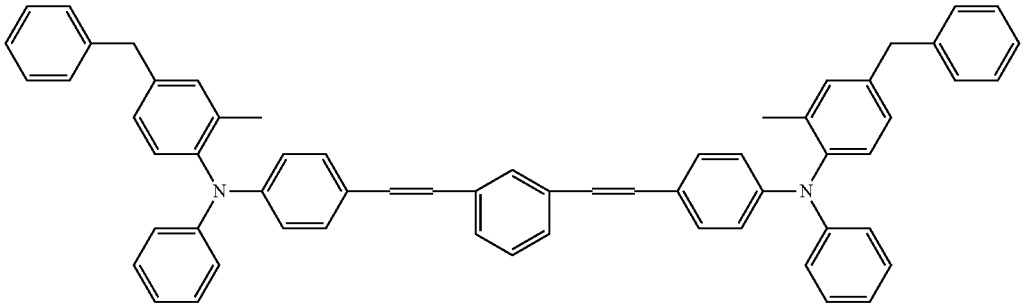

(HT-15)

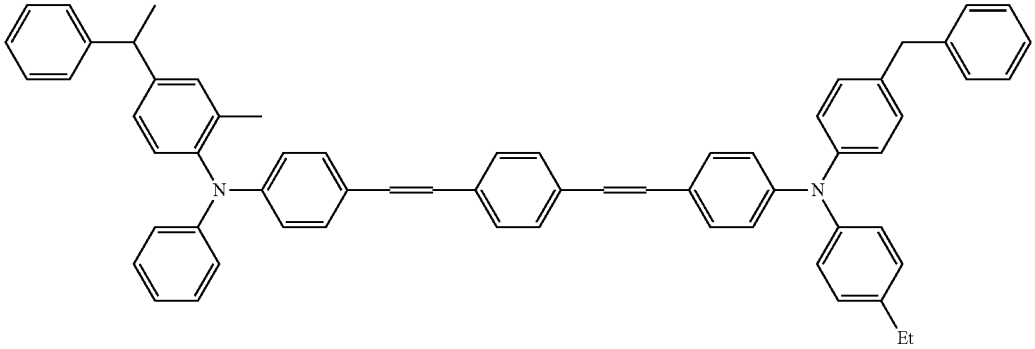

(HT-16)

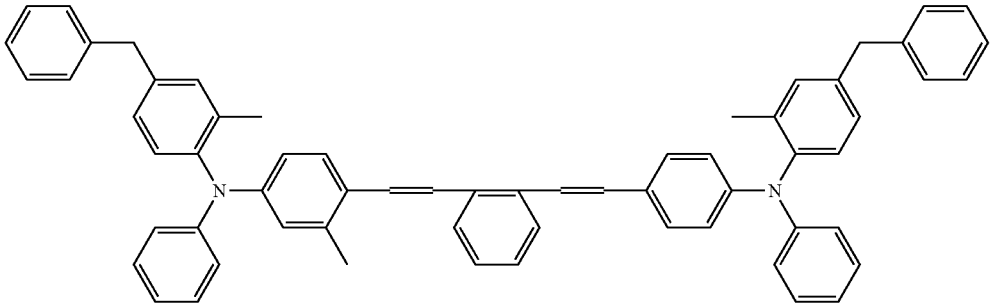

(HT-17)

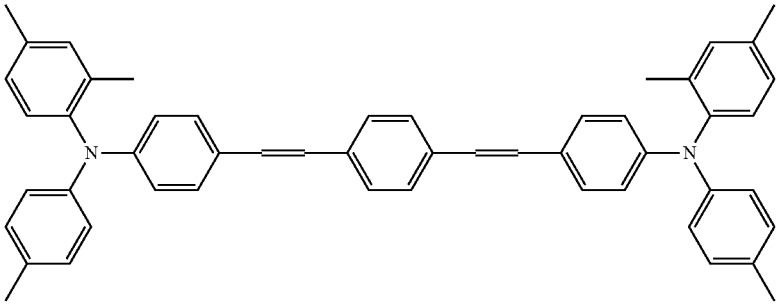

Among the compounds represented by the Formula (2), (HT-17) is preferred from the viewpoint of electrical properties, abrasion resistance and leak property.

Among the compounds represented by the Formula (1) or the Formula (2), CT1, CT2, CT3, CT5, CT8, CT9, CT10, CT18, CT20, CT22 and (HT-17) are preferred, and CT1, CT2, CT5, CT8, CT10, CT20, CT22 and (HT-17) are more preferred.

<<Fluorine Resin Particle>>

The charge transport layer of the present invention contains fluorine resin particles, and the content of the fluorine resin particles is generally 3% by mass or more, preferably 4.5% by mass or more, more preferably 5% by mass or more, particularly preferably 6% by mass or more, and on the other hand, is generally 20% by mass or less, preferably 17.5% by mass or less, more preferably 15% by mass or less, still more preferably 12% by mass or less, particularly preferably 10% by mass or less, based on the total mass of the charge transport layer. The above range is preferred from the viewpoint of the stability of the light attenuation behavior when the photoreceptor is repeatedly used and of the balance between the development and the cleaning process after exposure. In addition, the above range is preferred from the viewpoint of abrasion property and dispersibility.

As the fluorine resin particles, it is desirable to select one or two or more kinds from, for example, particles of polytetrafluoroethylene, polychlorotrifluoroethylene, polyhexafluoropropylene, polyvinyl fluoride, polyvinylidene fluoride, polydichlorodifluoroethylene and a copolymer thereof. Among these, particularly preferred is polytetrafluoroethylene, preferred is polyvinylidene fluoride, and most preferred is polytetrafluoroethylene. The above fluorine resin particles are preferred from the viewpoint of abrasion property.

The average primary particle diameter of the fluorine resin particles is not particularly limited, and is generally preferably 0.05 μm or more, and more preferably 0.1 μm or more from the viewpoint of both dispersibility and abrasion property. On the other hand, the average primary particle diameter of the fluorine resin particles is generally preferably 1 μm or less and more preferably 0.5 μm or less.

The average primary particle diameter is obtained by obtaining a sample piece from the outermost surface layer (charge transport layer) of the electrophotographic photoreceptor, observing the sample piece with a scanning electron microscope (SEM) at a magnification of 5000 times, measuring maximum diameters of the fluorine resin particles in a primary particle state, and obtaining the average value.

The fluorine resin particles are preferably used in combination with a fluorinated graft polymer as a dispersant. The amount of the dispersant is not particularly specified, and is preferably 0.1% by mass to 10% by mass based on the fluorine resin particles. As the dispersant, for example, a fluorinated comb-type graft polymer (GF400, manufactured by TOAGOSEI CO., LTD.) can be used.

In addition, the charge transport layer may further contain a fluorine-modified silicone oil, if necessary. Examples of the fluorine-modified silicone oil include a fluorine-modified silicone oil in which some or all of substituents of organopolysiloxane are substituted with a fluoroalkyl group (for example, a fluoroalkyl group having 1 to 10 carbon atoms).

The content of the fluorine-modified silicone oil is not particularly limited, and is generally in a range of 0.1 ppm or more, preferably 0.5 ppm by mass or more, and on the other hand, is generally in a range of 1000 ppm or less, preferably 500 ppm or less.

In order to disperse the fluorine resin particles in an outermost coating liquid, it is possible to use a disperser using media such as a paint shaker, a ball mill or a sand mill, or a disperser not using media such as a high pressure collision type disperser. The high pressure is generally determined by the discharge amount of the high pressure pump, the discharge pressure, the orifice diameter and length, and the viscosity of the solvent and the material to be dispersed.

Among these, the disperser not using media is preferred from the viewpoint of not damaging the fluorine resin particles during dispersion, and a high pressure collision type disperser is particularly preferred in the sense of preventing aggregation. In the present invention, a method of increasing the pressure to a high pressure state, and performing crushing and/or dispersion by collision of high pressure liquids (high pressure liquid collision dispersion method) means that, for example, a fluid is pumped to a fine flow path, and a substance to be dispersed is crushed and/or dispersed by the collision of high pressure liquids and the collision of the high pressure liquid with the wall of the device immediately after the fluid leaves the discharge port of the fine flow path. As means for this, a device including a high-pressure pump, a jig having a plurality of small-diameter orifices connected to the high-pressure pump by piping, and a jig processed to make liquids collide with each other when the liquids are discharged from the orifices can be used.

Examples of such a device include Starburst manufactured by Sugino Machine Limited, Nanoveita manufactured by Yoshida kikai Co., Ltd., and Microfluidizer manufactured by Microfluidics. It is desirable to attach a cooling device to the dispersion circuit, since the heat of liquid collision tends to accumulate when the number of collision passes increases.

The pressure of the liquid collision is not particularly limited, and is generally 10 MPa or more, more preferably 50 MPa or more, and on the other hand, is generally 300 MPa or less, preferably 50 MPa or less. The pressure within the above range is preferred since the collision energy between the liquids is suitable, and it is easy to disperse to the desired particle diameter. In addition, the pressure within the above range is preferred from the viewpoint of stability of the dispersed substance.

Particles other than the resin particles include inorganic particles. Examples of the inorganic particles include: powder of metal such as copper, tin, aluminum, and indium; metal oxides such as silica, tin oxide, zinc oxide, titanium oxide, alumina, indium oxide, antimony oxide, bismuth oxide, calcium oxide, antimony-doped tin oxide, and tin-doped indium oxide; metal fluorides such as tin fluoride, calcium fluoride, and aluminum fluoride; potassium titanate; boron nitride; or the like.

<<Electrophotographic Photoreceptor>>

Hereinafter, the electrophotographic photoreceptor of the present invention is described.

The electrophotographic photoreceptor of the present invention includes: a conductive support; and a charge generation layer and a charge transport layer on the conductive support. That is, a photosensitive layer of the electrophotographic photoreceptor is provided on the conductive support and, in a case of including an undercoat layer, is provided on the undercoat layer.

Types of the photosensitive layer include: a so-called single-layer type photoreceptor in which a charge generation substance and a charge transport substance are present on the same layer and are dispersed in a binder resin; and a multi-layer structure with separated functions, a so-called lamination type photoreceptor which is formed of two layers of a charge generation layer in which the charge generation substance is dispersed in the binder resin and a charge transport layer in which the charge transport substance is dispersed in the binder resin, and any configuration may be used. In addition, an overcoat layer may be provided on the photosensitive layer for the purpose of improving the chargeability and the abrasion resistance.

Examples of the lamination type photosensitive layer include a normal lamination type photosensitive layer in which the charge generation layer and the charge transport layer are laminated and disposed in this order from the conductive support side, and a reverse lamination type photosensitive layer in which the charge transport layer and the charge generation layer are laminated and disposed in this order from the conductive support side. Although either type can be employed, the normal lamination type photosensitive layer is preferred because this type can exhibit an especially well balanced photoconductivity.

<Conductive Support>

Mainly used as the conductive support (hereinafter, simply referred to as support) used in the photoreceptor is, for example, a metallic material such as aluminum, an aluminum alloy, stainless steel, copper, or nickel, a resin material to which conductivity is imparted by adding a conductive powder, such as a metal, carbon, or tin oxide powder, or a resin, glass, paper, or the like, having a surface on which a conductive material, such as aluminum, nickel, or ITO (indium oxide/tin oxide) is vapor deposited or coated.

As a form of the conductive support, a drum-like conductive support, a sheet-like conductive support, a belt-like conductive support, or the like can be used. A conductive support made of a metallic material may be coated with a conductive material having a suitable resistance value in order to control the conductivity, surface properties, or the like or to cover defects.

In a case where a metallic material such as an aluminum alloy is used as the conductive support, this material may be used after an anodized coating film is formed thereon. In the case where an anodized coating film is formed, the material is preferably subjected to a pore-sealing treatment by a known method.

For example, in an acid bath of chromic acid, sulfuric acid, oxalic acid, boric acid, sulfamic acid, or the like, an anodized coating film is formed by anodic oxidation treatment, but the anodic oxidation treatment in sulfuric acid gives better results. In the case of the anodic oxidation treatment in sulfuric acid, it is preferable to set the concentration of the sulfuric acid in a range of 100 g/l to 300 g/l, the concentration of dissolved aluminum in a range of 2 g/l to 15 g/l, the solution temperature in a range of 15° C. to 30° C., the electrolysis voltage in a range of 10 V to 20 V, and the current density in a range of 0.5 $A/dm^2$ to 2 $A/dm^2$, and the present invention is not limited to the above conditions.

It is preferable to perform a pore-sealing treatment on the anodized coating film thus formed. The pore-sealing treatment may be performed by a known method, and for example, it is preferable to perform a low-temperature pore-sealing treatment for immersing the anodized coating film in an aqueous solution containing nickel fluoride as a main component, or a high-temperature pore-sealing treatment for immersing the anodized coating film in an aqueous solution containing nickel acetate as a main component.

The concentration of the aqueous solution containing nickel fluoride in the case of the low-temperature pore-sealing treatment can be appropriately selected, and when the aqueous solution containing nickel fluoride is used in a range of 3 g/l to 6 g/l, more preferred results are obtained. In addition, in order to proceed the pore-sealing treatment smoothly, the treatment temperature is 25° C. to 40° C., preferably 30° C. to 35° C., and the pH of the aqueous solution containing nickel fluoride is 4.5 to 6.5, preferably 5.5 to 6.0.

As a pH regulator, oxalic acid, boric acid, formic acid, acetic acid, sodium hydroxide, sodium acetate, aqueous ammonia or the like can be used. The treatment time is preferably in a range of 1 minute to 3 minutes per 1 μm of the thickness of the coating film. In order to further improve the properties of the coating film, cobalt fluoride, cobalt acetate, nickel sulfate, a surfactant or the like may be added to the aqueous solution containing nickel fluoride.

Then, the anodized coating film is rinsed and dried to complete the low-temperature pore-sealing treatment.

As a sealant in the case of the high-temperature pore-sealing treatment, those using aqueous solutions of metal salts such as nickel acetate, cobalt acetate, lead acetate, nickel-cobalt acetate, and barium nitrate can be used, and those using nickel acetate is particularly preferred. The concentration of the aqueous solution of nickel acetate is preferably in the range of 5 g/l to 20 g/l. It is preferable to perform the treatment at a treatment temperature of preferably 80° C. to 100° C., more preferably 90° C. to 98° C., and at a pH of the aqueous solution of nickel acetate preferably in a range of 5.0 to 6.0.

Here, aqueous ammonia, sodium acetate, or the like can be used as a pH regulator. The treatment time is preferably 10 minutes or more, and more preferably 20 minutes or more. In this case, in order to improve the properties of the coating film, sodium acetate, an organic carboxylic acid, an anionic surfactant, a nonionic surfactant or the like may be added to the aqueous solution of nickel acetate.

Then, the anodized coating film is rinsed and dried to complete the high-temperature pore-sealing treatment.

In a case where the average film thickness is thick, strong pore-sealing conditions are required due to the high concentration of the pore-sealing solution, high temperature and longtime treatment. Therefore, as the productivity deteriorates, surface defects such as stains, dirt and dusting tend to occur on the surface of the coating film. From this point, the average film thickness of the anodized coating film is generally 20 μm or less, and particularly preferably 7 μm or less.

The surface of the support may be smooth, or may be roughened by applying a special cutting method or a polishing treatment. It may also be roughened by mixing particles having an appropriate particle diameter with a material constituting the support. In addition, in order to reduce the cost, it is also possible to use a drawn pipe as it is without performing the cutting treatment. Particularly, a case of using an aluminum support without subjecting to machining such as drawing processing, impact processing and ironing processing is preferred because the treatment eliminates deposits such as dirt and foreign matters, small scratches or the like present on the surface, and a uniform and clean support can be obtained.

<Undercoat Layer>

An undercoat layer may be provided between the conductive support and the photosensitive layer, in order to improve adhesion and blocking properties. As the undercoat layer, a resin, or those in which particles of metal oxide or the like are dispersed in a resin is used, and it is preferable to contain an inorganic filler such as particles of metal oxide from the viewpoint of electrical properties or the like.

Examples of the particles of metal oxide used for the undercoat layer include particles of metal oxide containing one metallic element, such as silica, alumina, titanium oxide, aluminum oxide, silicon oxide, zirconium oxide, zinc oxide, iron oxide, lead oxide, and indium oxide, and particles of metal oxide containing a plurality of metallic elements, such as calcium titanate, strontium titanate, and barium titanate. One kind of these particles may be used alone, or two or more kinds of those particles may be mixed and used. Among these particles of metal oxide, particles of metal oxide exhibiting n-type semiconductor properties are preferred, titanium oxide, zinc oxide, tin oxide and aluminum oxide are more preferred, and titanium oxide is particularly preferred. The particles of metal oxide described above are preferred because they have high dispersion stability in an undercoat layer coating liquid.

The surface of the titanium oxide particle may be treated with inorganic materials such as tin oxide, aluminum oxide, antimony oxide, zirconium oxide, silicon oxide, or organic materials such as stearic acid, polyol, and silicon. Crystalline or amorphous titanium oxide can be used, and crystalline titanium oxide is preferred. As the crystal form of the titanium oxide particles, any of rutile, anatase, brookite, and amorphous can be used. Further, a plurality of crystalline states may be included. Preferred is an anatase type or rutile type, and more preferred is a rutile type. These titanium oxides are preferred from the viewpoint of water absorbency, efficiency of surface treatment, or the like.

Various particle diameters of the particles of metal oxide can be used, and among these, it is desirable that the average primary particle diameter is generally 1 nm or more and preferably 10 nm or more, and is generally 100 nm or less and preferably 50 nm or less, from the viewpoint of electrical properties and stability of an undercoat layer forming coating liquid. The particle diameter of the particles used in the coating liquid may be uniform or may be a composite system of different particle diameters.

In the case of the composite system of different particle diameters, it is preferable that the maximum particle diameter peak is around 150 nm and the minimum particle diameter has a particle diameter distribution of about 30 nm to about 500 nm. For example, those having an average particle diameter of 0.1 μm and those having an average particle diameter of 0.03 μm may be mixed and used.

The particles of metal oxide are preferably surface-treated with an organometallic compound or the like. The surface treatment can be produced by a production method such as a dry method and a wet method. That is, in the dry method, the particles of metal oxide can be treated by a method of coating a surface treatment agent on the particles of metal oxide by mixing the same with the particles of metal oxide, and performing a heat treatment, if necessary. In the wet method, the particles of metal oxide can be treated by a method of mixing the particles of metal oxide and a mixture of a surface treatment agent in a suitable solvent, stirring the obtain mixture well until uniformly deposited, or mixing the mixture of the surface treatment agent in the suitable solvent with a medium, then performing drying, and performing a heat treatment, if necessary.

The surface treatment agent is preferably a reactive organometallic compound. For example, methyl hydrogen polysiloxane and a silane treatment agent having a structure represented by the following formula are preferred, and methyl dimethoxysilane is particularly preferred. In addition, a silane coupling agent having an acrylic group is also preferred, and 3-acryloxypropyl methoxysilane is particularly preferred.

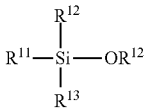

($R^{11}$ represents a hydrogen atom or an alkyl group, $R^{12}$ each independently represent an alkyl group, and $R^{13}$ represents an alkyl group or an alkoxy group.)

The amount of the surface treatment agent is not particularly limited and is generally 0.3 part by mass or more, preferably 1 part by mass or more, and on the other hand, is generally 20 parts by mass or less, preferably 10 parts by mass or less. The above range is preferred from the viewpoint of suitably obtaining the effect of the surface treatment, and preventing the repellence of the coating film during the coating step or the like.

The undercoat layer is preferably formed in a state that the particles of metal oxide are dispersed in a binder resin. Examples of the binder resin to be used in the undercoat layer include known binder resins such as: an epoxy resin, a polyethylene resin, a polypropylene resin, an acrylic resin, a methacrylic resin, a polyamide resin, a vinyl chloride resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic resin, a polyacrylamide resin, a polyvinylpyrrolidone resin, a polyvinylpyridine resin, a water-soluble polyester resin, a cellulose ester resin such as nitrocellulose, a cellulose ether resin, a casein, a gelatin, a polyglutamic acid, starch, starch acetate, amino starch, organic zirconium compounds such as zirconium chelate compounds and zirconium alkoxide compounds, organic titanyl compounds such as titanyl chelate compounds and titanyl alkoxide compounds, a silane coupling agent or the like. One selected from these may be used alone, or two or more selected from these may be used in any combination and in any proportion. In addition, these resins may be used together with a hardener to come into a hardened state. Among these, a polyamide resin is preferred since it is excellent in the adhesion of the support.

An alcohol-soluble copolymerized polyamide, a modified polyamide, and the like are preferred because of the excellent dispersibility and coating properties they exhibit. Further, preferred is a copolymerized polyamide having a ring structure as a component, more preferred is a ring structure containing at least one of a carbon atom and a hydrogen atom, and still more preferred is a ring structure containing a hydrogen atom and a hydrogen atom.

The ring structure is generally 4-membered or more, preferably 5-membered or more, and on the other hand, is generally 8-membered or less, preferably 7-membered or less, most preferably 6-membered or less.

The use ratio of the inorganic particles to the binder resin used in the undercoat layer can be arbitrarily selected. The use ratio is generally 10% by mass or more, preferably 50% by mass or more, more preferably 200% by mass or more, and on the other hand, is generally 800% by mass or less, preferably 500% by mass or less, from the viewpoint of the stability and coating properties of the dispersion liquid.

The film thickness of the undercoat layer is not particularly limited, and is generally 0.1 μm or more, preferably 2 μm or more, more preferably 3 μm or more, and on the other hand, is generally 20 μm or less, preferably 10 μm or less, more preferably 6 μm or less. The above range is preferred from the viewpoint of chargeability, prevention of increase in residual potential, and adhesion strength between the conductive substrate and the photosensitive layer. In addition, the above range is preferred from the viewpoint of improving the properties of the photoreceptor and the coating properties.

A known antioxidant and the like may be incorporated into the undercoat layer. In order to prevent image defects or the like, pigment particles, resin particles or the like may be contained and used.

The volume resistance value of the undercoat layer is not particularly limited and is generally $1\times10^{11}$ Ω·cm or more, preferably $1\times10^{12}$ Ω·cm or more, and on the other hand, is generally $1\times10^{14}$ Ω·cm or less, preferably $1\times10^{13}$ Ω·cm or less.

In order to obtain an undercoat coating liquid containing particles of metal oxide and a binder resin, it is sufficient that a binder resin or a solution in which a binder resin is dissolved in an appropriate solvent is mixed with a slurry of particles of metal oxide treated by a crushing or dispersion treatment device such as a planetary mill, a ball mill, a sand mill, a bead mill, a paint shaker, an attritor and an ultrasonic mill, and dissolution and stirring is performed. Conversely, the particles of metal oxide may be added to the binder resin solution, and the crushing or dispersion treatment may be performed by the dispersion device as described above.

<Charge Generation Layer>

The charge generation layer is formed by binding a charge generation substance with a binder resin.

Examples of the charge generation substance include inorganic photoconductive materials, such as selenium, and alloys thereof, and cadmium sulfide, and organic photoconductive materials such as organic pigments. Preferred of these are organic photoconductive materials, and particularly preferred are organic pigments.

Examples of the organic pigments include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Particularly preferred of these organic pigments are phthalocyanine pigments and azo pigments. In the case of using any of these organic pigments as the charge generation substance, the organic pigment is used generally in the form of a dispersion layer in which particles thereof have been bound with any of various binder resins.

In a case where a metal-free phthalocyanine compound and a metal-containing phthalocyanine compound are used as the charge generation substance, a photoreceptor having high sensitivity to a relatively long wavelength laser beam, for example, a laser beam having a wavelength around 780 nm can be obtained. In addition, in a case where an azo pigment such as monoazo, diazo and trisazo is used, a photoreceptor having sufficient sensitivity to white light or a laser beam having a wavelength of about 660 nm or a laser beam having a relatively short wavelength, for example, a laser having a wavelength of about 450 nm or 400 nm can be obtained.

In a case of using an organic pigment as the charge generation substance, a phthalocyanine pigment or an azo pigment is particularly preferred. The phthalocyanine pigment is excellent from the viewpoint of obtaining a photoreceptor having high sensitivity to a laser beam having a relatively long wavelength, and the azo pigment is excellent from the viewpoint of having sufficient sensitivity to white light and a laser beam having a relatively short wavelength.

In a case where a phthalocyanine pigment is used as the charge generation substance, specific examples thereof include metal-free phthalocyanine, metals such as copper, indium, gallium, tin, titanium, zinc, vanadium, silicon, germanium, and aluminum or oxides thereof, those having crystal forms of coordinated phthalocyanines such as halides, hydroxides, and alkoxides, and phthalocyanine dimers using an oxygen atom or the like as a crosslinking atom. Particularly, an X form which is a high sensitivity crystal form, a τ-form metal-free phthalocyanine, titanyl phthalocyanines (alternative name: oxytitanium phthalocyanine) such as A form (also known as β form), a B form (also known as α form), or a D form (also known as a Y form), vanadyl phthalocyanine, chloroindium phthalocyanine, hydroxy indium phthalocyanine, II-form chlorogallium phthalocyanine, V-form hydroxygallium phthalocyanine, G-form or I-form μ-oxo-gallium phthalocyanine dimer, or II-form μ-oxo-aluminum phthalocyanine dimer is suitable.

Particularly preferred of these phthalocyanines are A-form (also called β-form) and B-form (also called α-form) titanyl phthalocyanines, D-form (Y-form) titanyl phthalocyanine characterized by showing a distinct peak at a diffraction angle 2θ(±0.2°) of 27.1° or 27.3° in X-ray powder diffractometry, II-form chlorogallium phthalocyanine, V-form, hydroxygallium phthalocyanine characterized by having a most intense peak at 28.1° and characterized by having no peak at 26.2°, having a distinct peak at 28.1°, and having a half-value width W at 25.9° of 0.1°≤W≤0.4°, and a G-form μ-oxo-gallium phthalocyanine dimer.

A single phthalocyanine compound may be used alone, or a mixture of some phthalocyanine compounds or a mixture of some crystal states may be used. This mixed state of phthalocyanine compounds or of crystal states to be used here may be a mixture obtained by mixing the components prepared beforehand, or may be a mixture which comes into the mixed state during phthalocyanine compound production/treatment steps such as synthesis, pigment formation, and crystallization.

Known as such treatment steps include an acid paste treatment, grinding, solvent treatment, or the like. Examples of methods for producing a mixed-crystal state include a method in which two kinds of crystals are mixed together and the resultant mixture is mechanically ground and made amorphous and is then subjected to a solvent treatment to thereby be converted into a specific crystalline state, as described in JP-A-H10-48859.

In a case where an azo pigment is used as the charge generation substance, various bisazo pigments and trisazo pigments are suitably used. In the case where the organic pigment is used as the charge generation substance, one of the pigments may be used alone, or two or more of the pigments may be mixed and used. In this case, it is preferable to use two or more of charge generation substances having spectral sensitivity characteristics in different spectral regions of the visible region and the near infrared region in combination, and among them, it is more preferable to use a disazo pigment, a trisazo pigment and a phthalocyanine pigment in combination.

The binder resin used for the charge generation layer is not particularly limited. Examples thereof include insulating resins such as a polyvinyl acetal resin, for example, a polyvinyl butyral resin, a polyvinyl formal resin, and a partly acetalized polyvinyl butyral resin in which the butyral moieties have been partly modified with formal, acetal, or the like, a polyarylate resin, a polycarbonate resin, a polyester resin, a modified ether-type polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulosic resin, a polyurethane resin, an epoxy resin, a silicon resin, a polyvinyl alcohol resin, a polyvinylpyrrolidone resin, casein, copolymers based on vinyl chloride and vinyl acetate, for example, vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicon-alkyd resins, and phenol-formaldehyde resins; and organic photoconductive polymers such as poly-N-vinylcarbazole, polyvinylanthracene, and polyvinylperylene. Any one of these binder resins may be used alone, or any desired combination of two or more thereof may be mixed and used.

Specifically, the charge generation layer is formed by, for example, dispersing a charge generation substance in a solution of the above binder resin being dissolved in an organic solvent to prepare a coating liquid, and coating the coating liquid onto a conductive support (on an undercoat layer in the case of providing the undercoat layer).

The solvent used to prepare the coating liquid is not particularly limited as long as it dissolves the binder resin.

Examples thereof include: aromatic solvents such as toluene, xylene and anisole; halogenated aromatic solvents such as chlorobenzene, dichlorobenzene and chloronaphthalene; amide solvents such as N,N-dimethylformamide and N-methyl-2-pyrrolidone; alcohol solvents such as methanol, ethanol, isopropanol, n-butanol and benzyl alcohol; aliphatic polyhydric alcohol solvents such as glycerin and polyethylene glycol; linear or cyclic ketone solvents such as acetone, cyclohexanone and methyl ethyl ketone; ester solvents such as methyl formate, ethyl acetate and n-butyl acetate; halogenated hydrocarbon solvents such as methylene chloride, chloroform and 1,2-dichloroethane; linear or cyclic ether solvents such as diethyl ether, dimethoxyethane, tetrahydrofuran, 1,4-dioxane, methyl cellosolve and ethyl cellosolve; aprotic polar solvents such as acetonitrile, dimethyl sulfoxide, sulfolane and hexamethyl phosphate triamide; nitrogen-containing compounds such as n-butylamine, isopropanolamine, diethylamine, triethanolamine, ethylenediamine, triethylenediamine and triethylamine; mineral oils such as ligroin; water; or the like. One selected from these may be used alone, or two or more selected from these may be used. In the case of providing the above undercoat layer, those not dissolving the undercoat layer are preferred.

In the charge generation layer, regarding the mixing ratio (mass) of the charge generation substance to the binder resin, the charge generation substance is in a range of generally 10 parts by mass or more, preferably 30 parts by mass or more, and is generally in a range of 1,000 parts by mass or less, preferably 500 parts by mass or less, based on 100 parts by mass of the binder resin. The film thickness of the charge generation layer is in a range of generally 0.1 μm or more, preferably 0.15 μm or more, and of generally 10 μm or less, preferably 0.6 μm or less. When the ratio of the charge generation substance is excessively high, the stability of the coating liquid may be deteriorated due to aggregation of the charge generation substance or the like; on the other hand, when the ratio of the charge generation substance is excessively low, the sensitivity of the photoreceptor may be lowered.

Known dispersion methods such as a ball mill dispersion method, an attritor dispersion method, a sand mill dispersion method and a bead mill dispersion method can be used as a method of dispersing the charge generation substance. At this time, it is effective to pulverize the particles to a particle size in a range of 0.5 μm or less, preferably 0.3 μm or less, and more preferably 0.15 μm or less.

<Charge Transport Layer>

The charge transport layer of the lamination type photoreceptor contains a charge transport substance and fluorine resin particles and generally contains a binder resin and other components which are used, if necessary. Specifically, such a charge transport layer can be obtained by, for example, dissolving or dispersing a charge transport substance or the like and a binder resin in a solvent to prepare a coating liquid, coating the coating liquid onto a charge generation layer in the case of a normal lamination type photosensitive layer or coating the coating liquid onto a conductive support (onto an undercoat layer in the case of providing the undercoat layer) in the case of a reverse lamination type photosensitive layer, and drying the layers.

In the present invention, a compound having an HOMO energy level (E_homo) of −4.550 eV or more based on the structure optimization calculation by the density functional calculation B3LYP/6-31G (d, p) including a compound represented by Formula (1) and/or a compound represented by Formula (2) is used as the charge transport substance, and other charge transport substances may be used in mixing with this charge transport substance.

The other charge transport substances which may be used in mixing with the charge transport substance are not particularly limited, and any substances can be used. Examples of the known charge transport substance include: an electron withdrawing substance such as an aromatic nitro compound such as 2,4,7-trinitrofluorenone, a cyano compound such as tetracyanoquinodimethane, and a quinone compound such as diphenoquinone; and an electron-donating substance such as a heterocyclic compound such as a carbazole derivative, an indole derivative, an imidazole derivative, an oxazole derivative, a pyrazole derivative, a thiadiazole derivative, and a benzofuran derivative, an aniline derivative, a hydrazone derivative, an aromatic amine derivative, a stilbene derivative, a butadiene derivative, an enamine derivative, a substance where plural types of these compounds bond, or a polymer having a group composed of these compounds in a main chain or a side chain. Among these, preferred are a carbazole derivative, an aromatic amine derivative, a stilbene derivative, a butadiene derivative, an enamine derivative, and a substance where plural kinds of these compounds bond.

Specific examples of the preferred structure of the other charge transport substances are as follows. These specific examples are shown for the sake of illustration, and the known charge transport substance may be used as long as it does not contradict the gist of the present invention. Any one of these charge transport substances may be used alone, or any desired combination of two or more of these charge transport substances may be used.

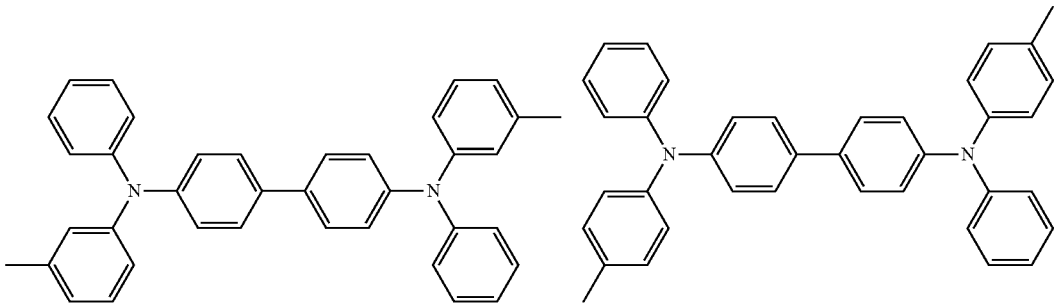

-continued
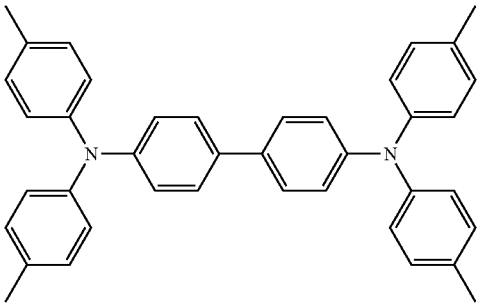
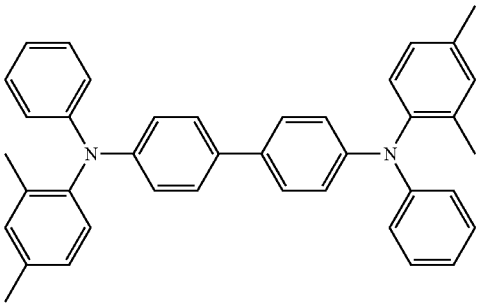
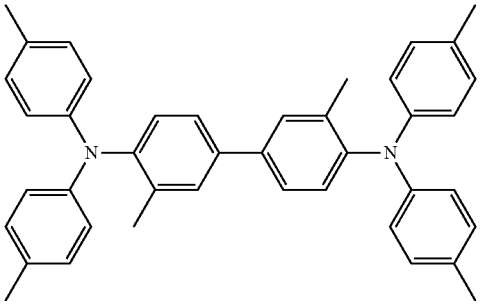
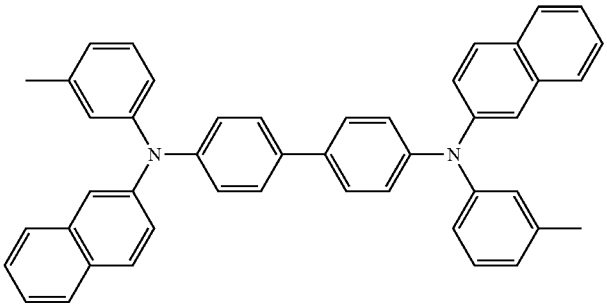
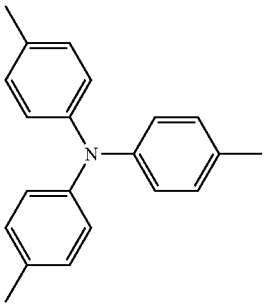
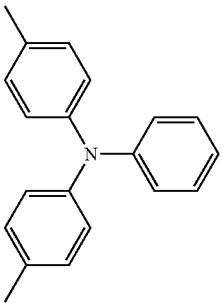
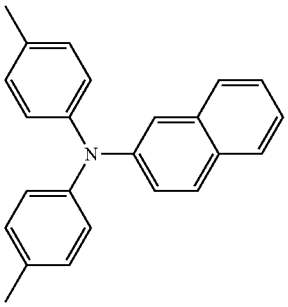
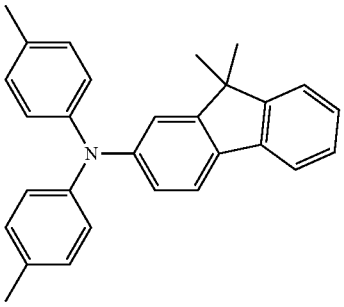
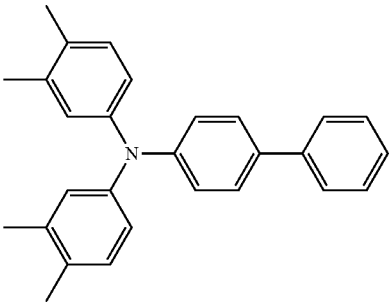
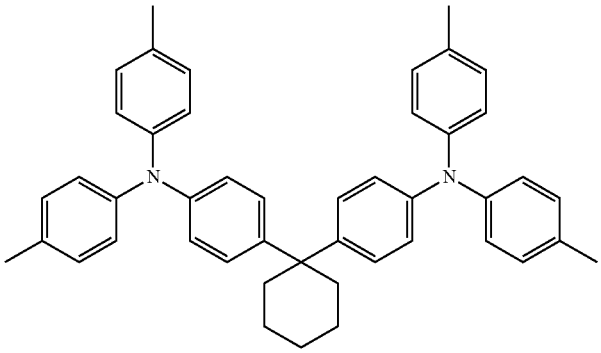
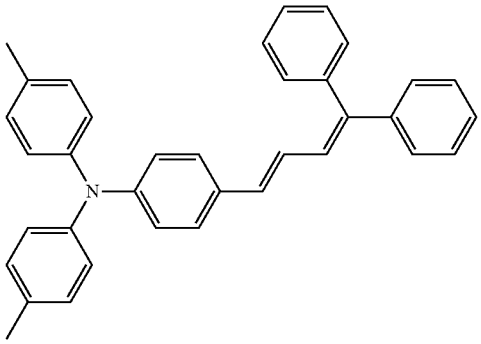

-continued
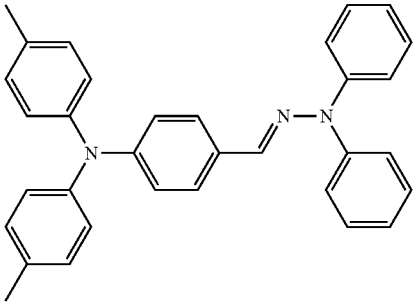
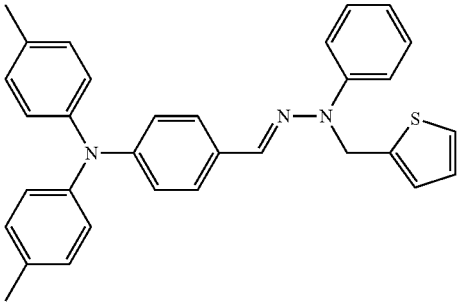
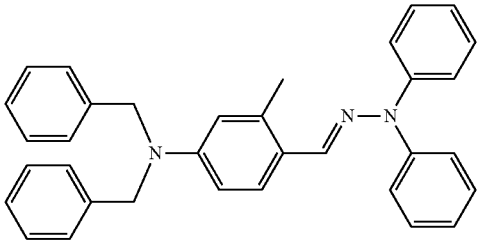
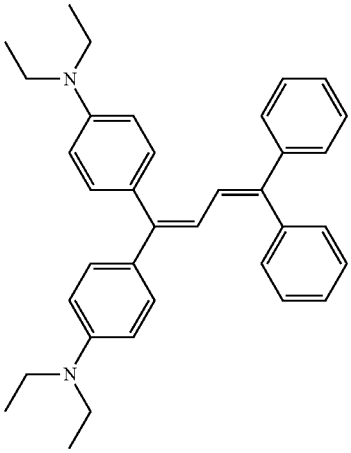
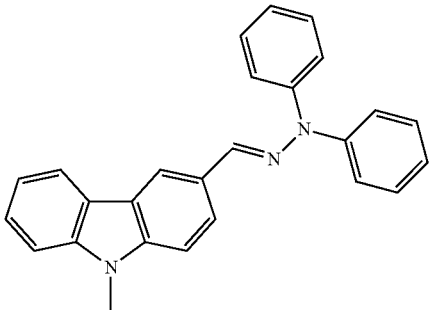
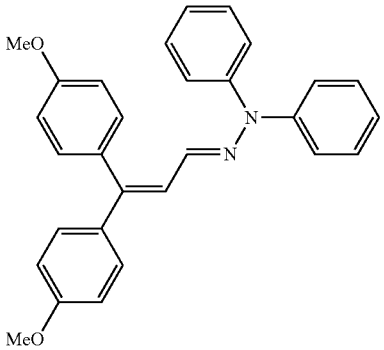
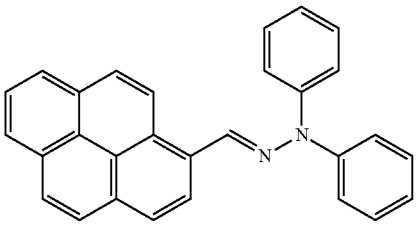
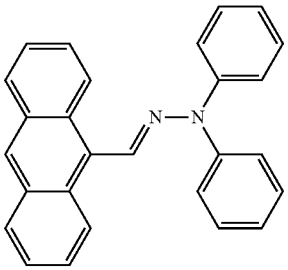
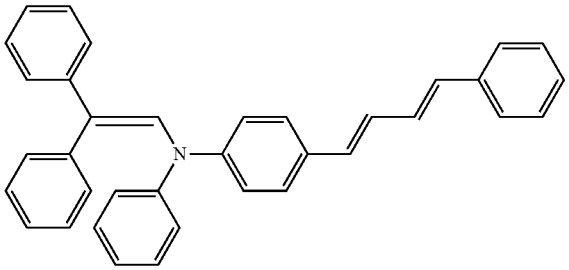

-continued
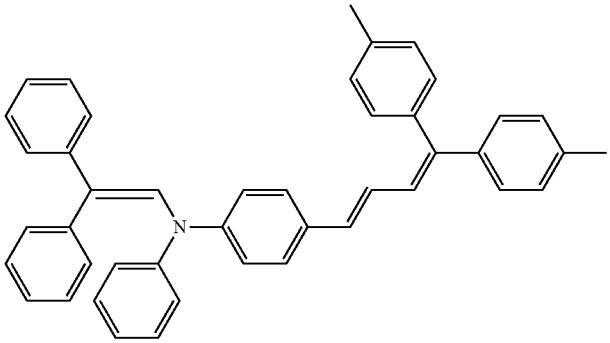
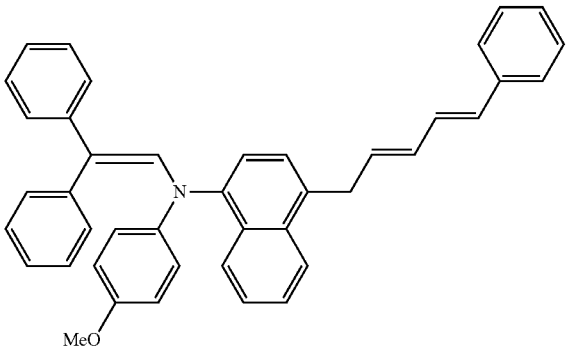
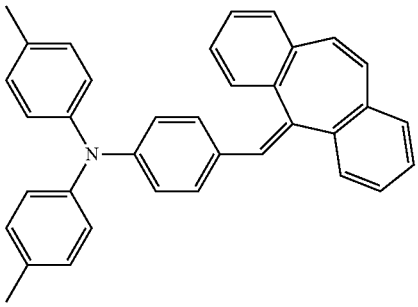
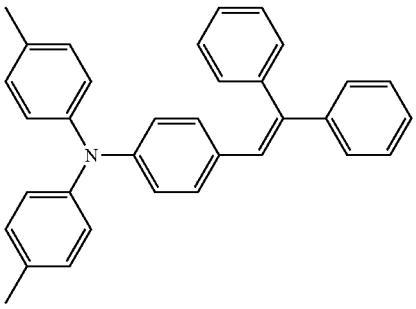
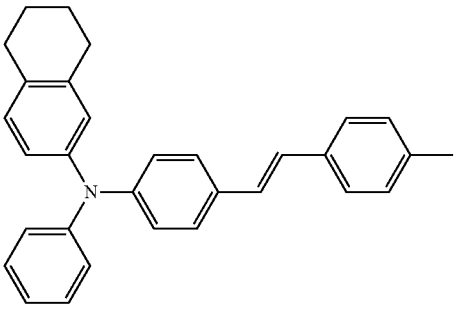
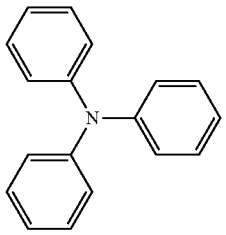
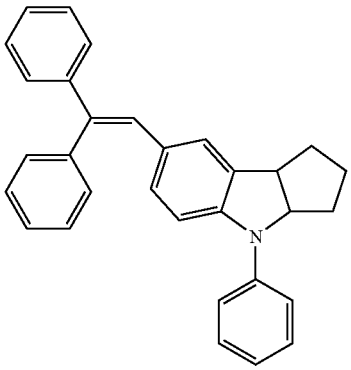
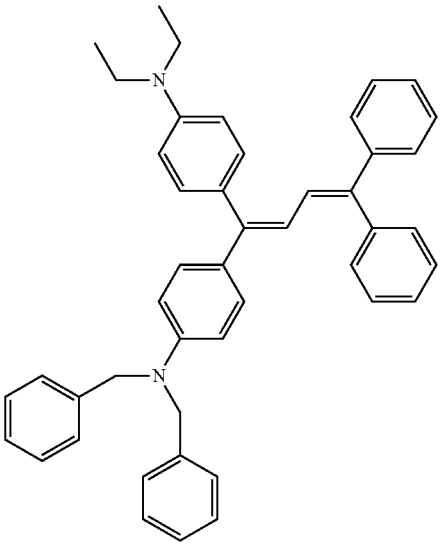

-continued
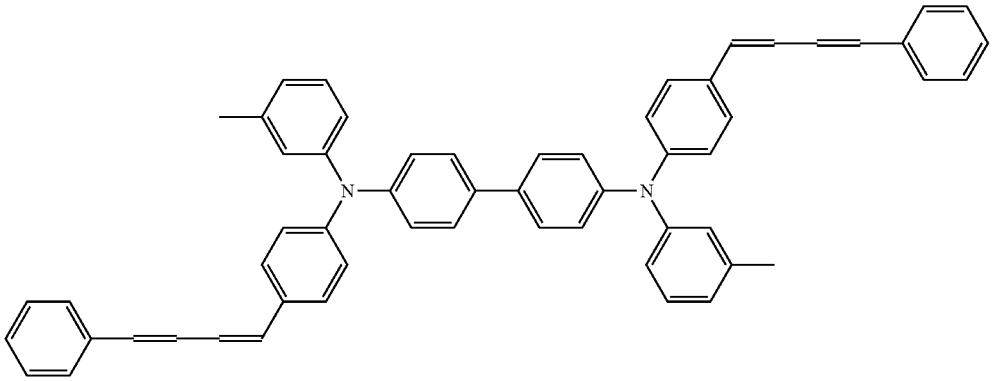
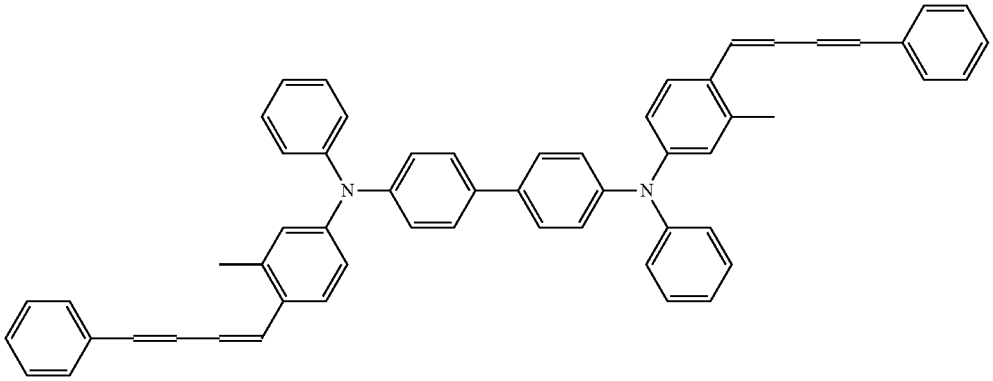
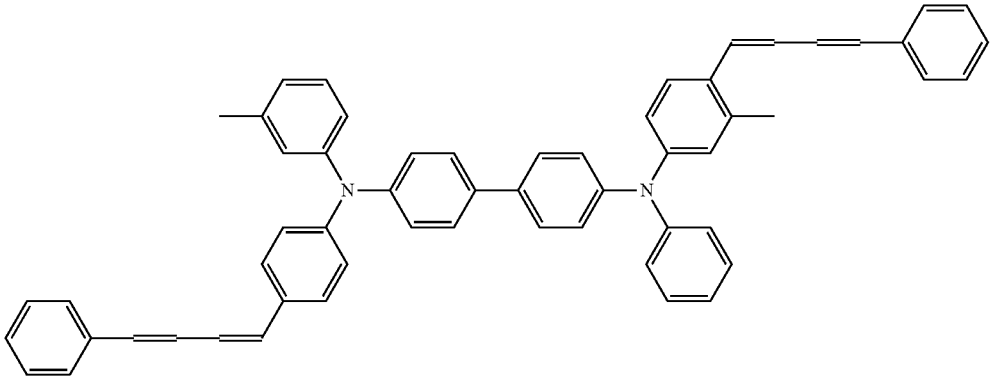
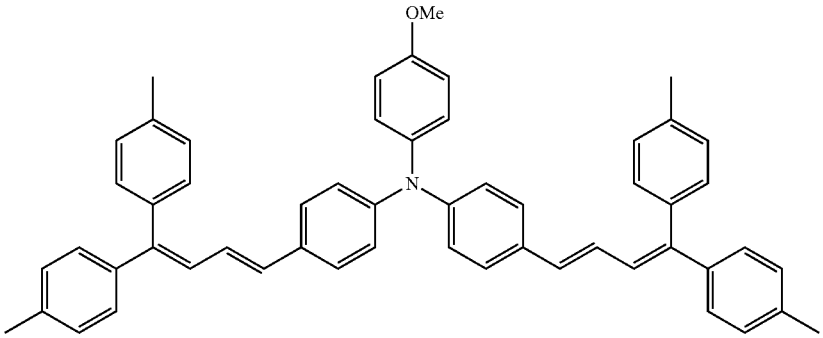

-continued
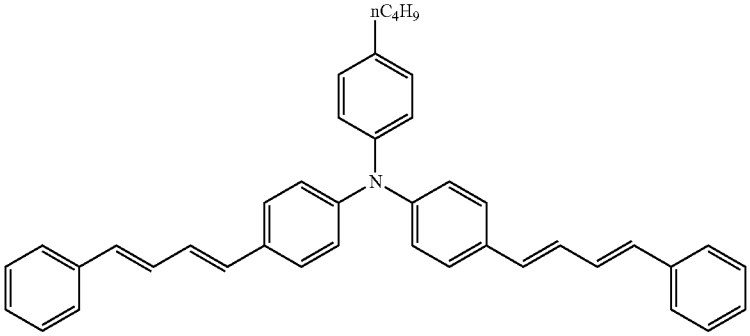
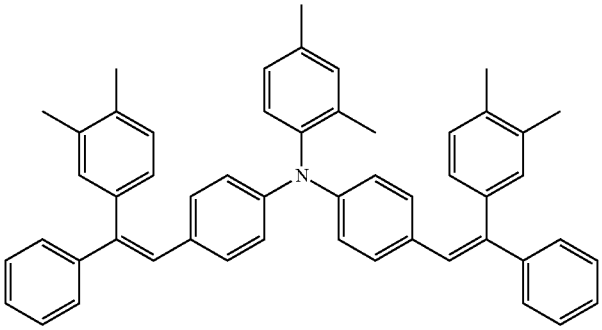
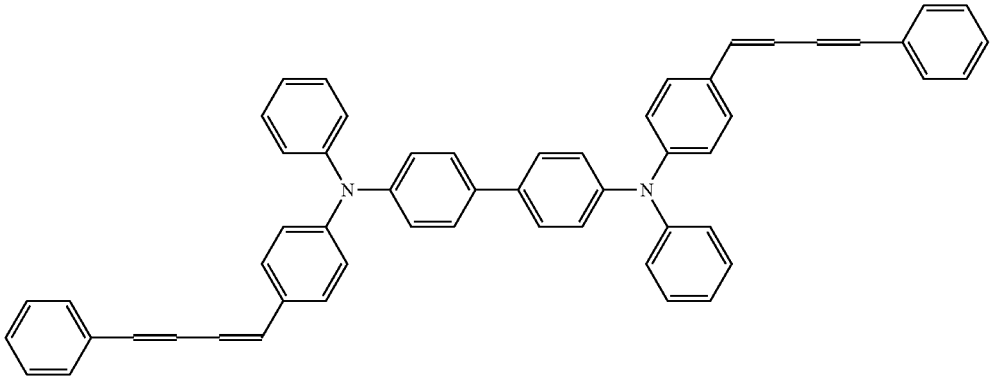
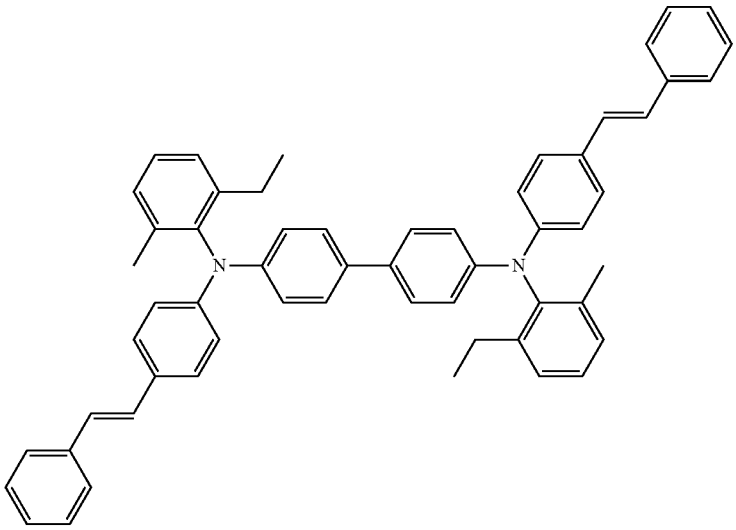

-continued
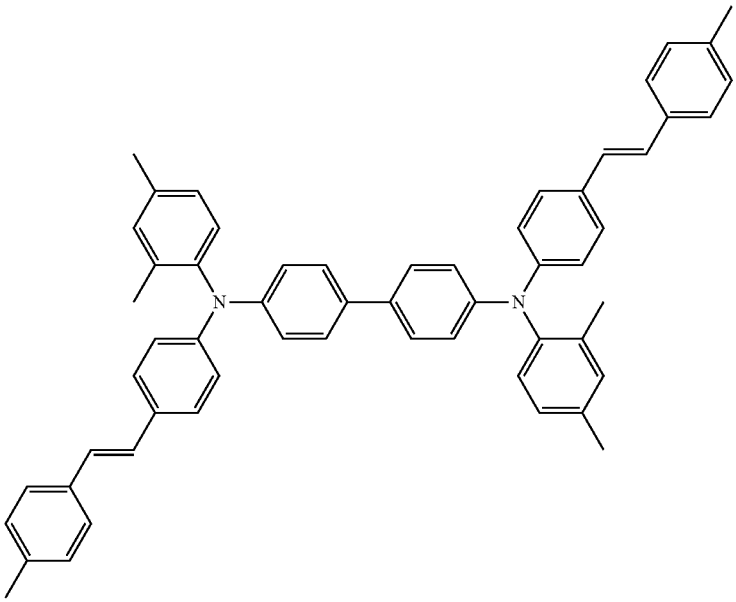
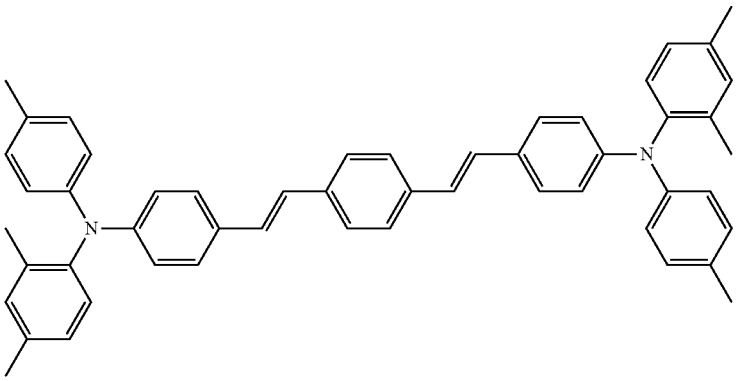
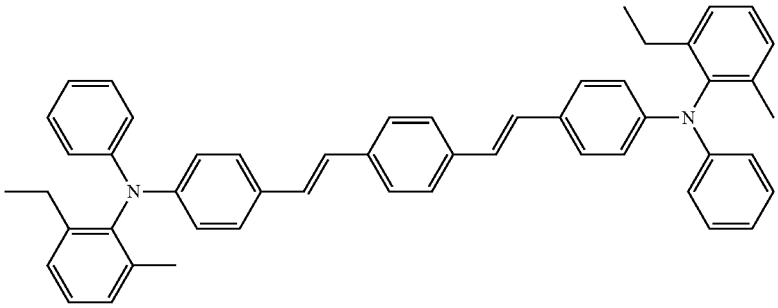
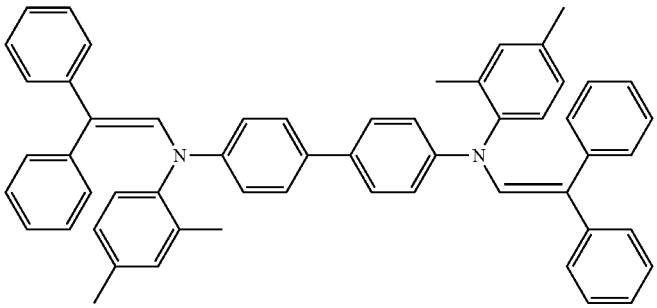

-continued

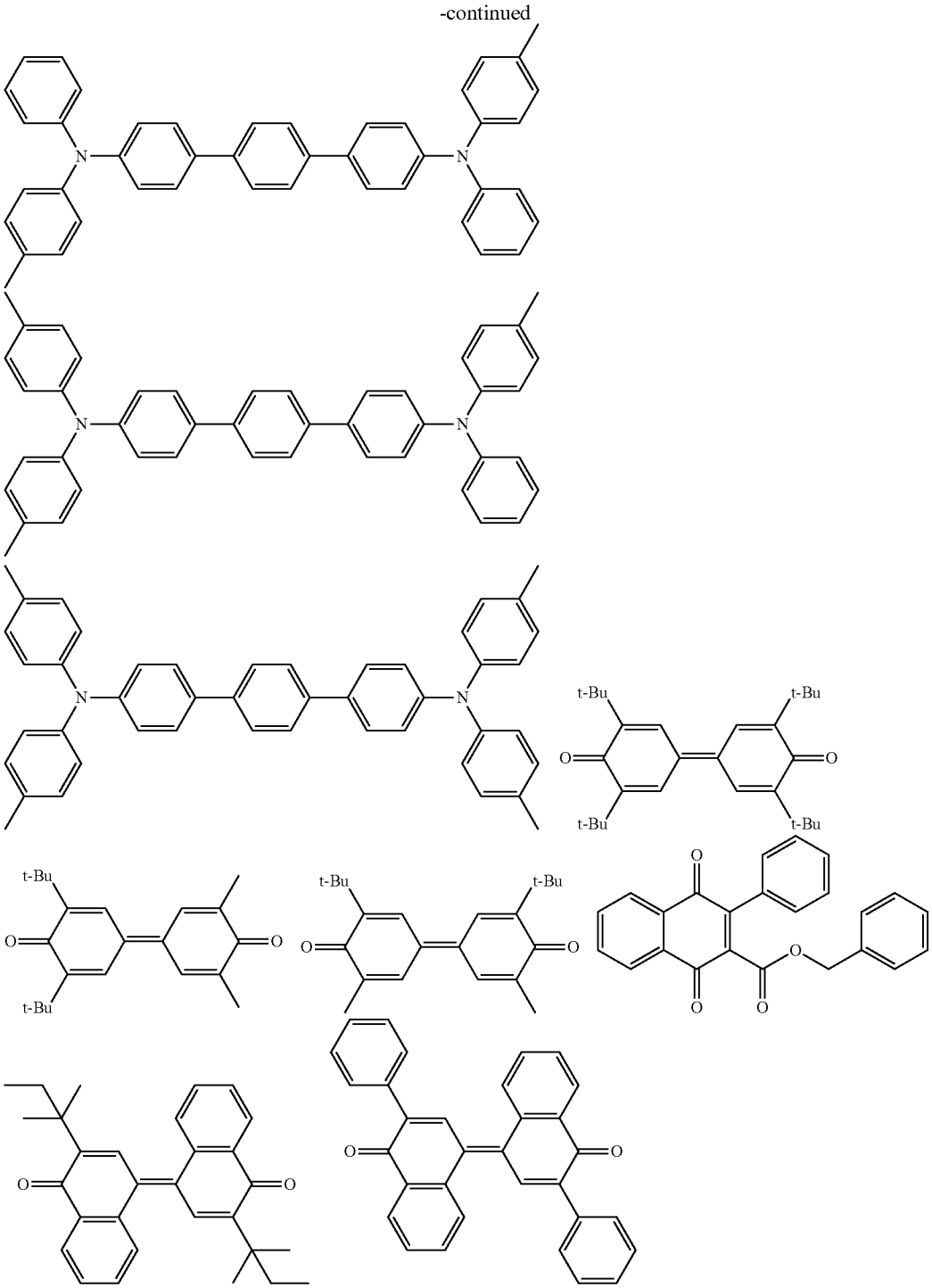

<Binder Resin>

The photosensitive layer may be a deposited film, and is generally formed by binding raw materials such as the charge generation substance and the charge transport substance described above with a binder resin, and preferably polycarbonate or the like is used as the binder resin.

Examples of the binder resin include polymethyl methacrylate, polystyrene, vinyl polymers such as polyvinyl chloride and a copolymer thereof, thermoplastic resins such as polycarbonate, polyester, polyester polycarbonate, polysulfone, phenoxy, epoxy, and silicone resins, and various thermosetting resins. In addition, partially crosslinked cured products of the above can also be used. Among these resins, polycarbonate resins, polyester resins or polyarylate resins are preferred. These resins may be used alone or in combination of two or more kinds thereof.

Specific examples of a suitable repeating unit structure of the binder resin are shown below. These specific examples are shown for the sake of illustration, and a known binder resin may be mixed and used as long as it does not contradict the gist of the present invention.

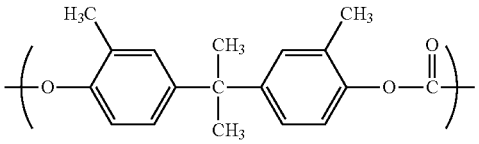
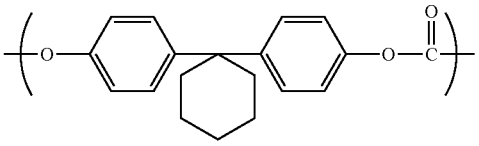
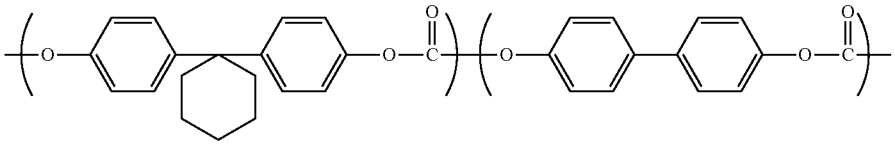
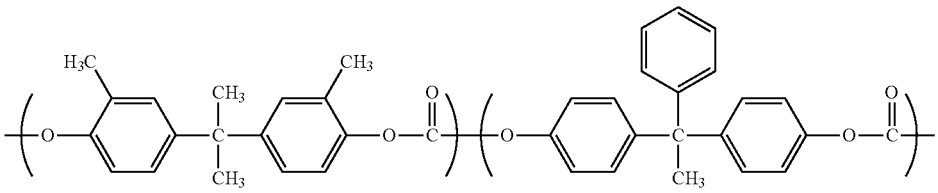
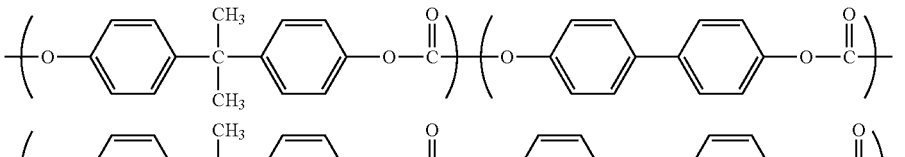
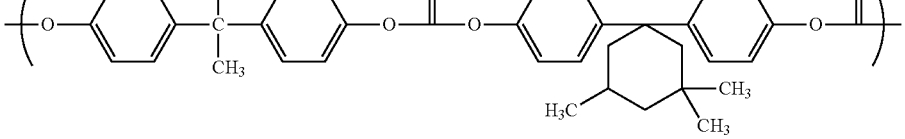
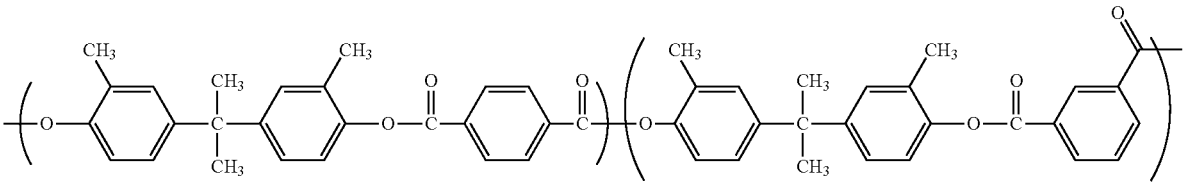
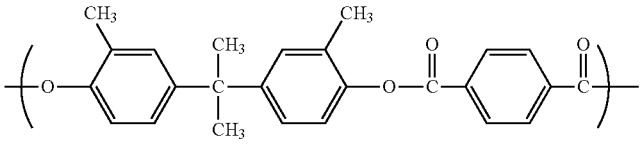
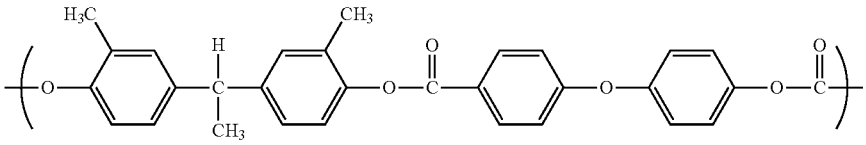
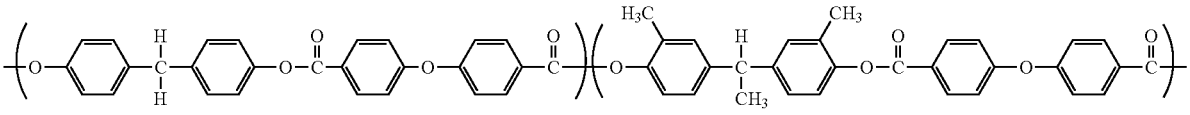
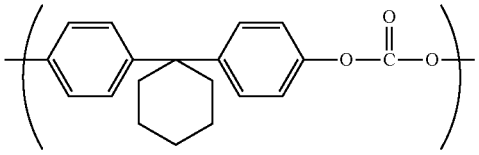
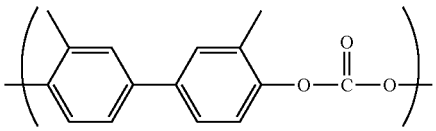
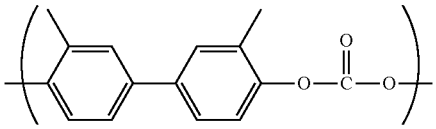

Among the resins having the above repeating units, those having a plurality of repeating units are preferred.

The viscosity average molecular weight of the binder resin is arbitrary as long as the effect of the present invention is not significantly impaired, and is preferably 10,000 or more, more preferably 20,000 or more, and it is desirable that the upper limit thereof is preferably 150,000 or less, more preferably 120,000 or less, and still more preferably 100,000 or less. In a case where the value of viscosity average molecular weight is too small, the mechanical strength of the photoreceptor may be insufficient; in a case where the viscosity-average molecular weight is too large, the viscosity of the coating liquid for forming the photosensitive layer is too high and the productivity may be lowered.

The film thickness of the photosensitive layer of the single-layer type photoreceptor is generally in a range of 5 μm to 100 μm, preferably 10 μm to 50 μm. The film thickness of the charge transport layer of the normal lamination type photoreceptor is generally 5 μm or more, preferably 10 μm or more, more preferably 15 μm or more, and is generally 50 μm or less, preferably 45 μm or less, more preferably 35 μm or less, more preferably 30 μm or less, particularly preferably 25 μm or less. The above range is preferred from the viewpoint of electrical properties and image stability and from the viewpoint of high resolution. In addition, in the case of the normal lamination type photoreceptor, it is preferably 10 μm to 45 μm from the viewpoint of long life and image stability, and more preferably 10 μm to 30 μm from the viewpoint of high resolution.

The photosensitive layer may contain additives such as an antioxidant, a plasticizer, an ultraviolet absorber, an electron-attracting compound, a dye, a pigment, a leveling agent, and a visible-light-shielding agent in order to enhance the film-forming properties, flexibility, coating properties, non-fouling properties, gas resistance, light resistance, and the like.

Examples of the antioxidant include hindered phenolic compounds, hindered amine compounds, trialkylamines, dialkylarylamines, diarylalkylamines, or the like. From the viewpoint of the properties as the photoreceptor such as residual potential, hindered phenol compounds and trialkylamine compounds are preferred, and hindered phenol compounds are more preferred.

Examples of the plasticizer include a hydrocarbon compound, an ester compound, an ether compound, a thioether compound, or the like. From the viewpoint of electrical properties, a hydrocarbon compound, an ester compound and an ether compound are preferred, and a hydrocarbon compound and an ether compound are more preferred. From the viewpoint of compatibility with the binder resin, the plasticizer preferably has an aromatic group.

The molecular weight of the plasticizer is preferably 150 or more, more preferably 170 or more, still more preferably 200 or more, and on the other hand, it is preferably 400 or less, more preferably 380 or less, still more preferably 350 or less. When the molecular weight is within the above range, crack resistance and gas resistance can be improved due to the compatibility with the binder resin while sublimation during film formation/drying can be prevented.

These plasticizers may be used alone or in combination. Specific examples of the preferred structure of the plasticizer are shown below.

AD-1

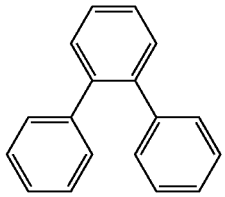

AD-2

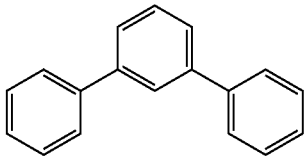

AD-3

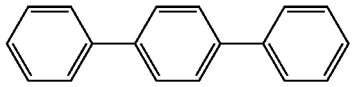

AD-4

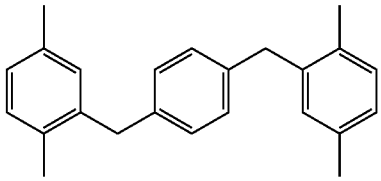

AD-5

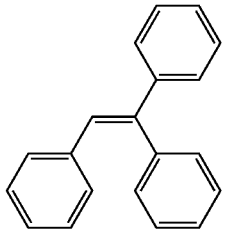

AD-6

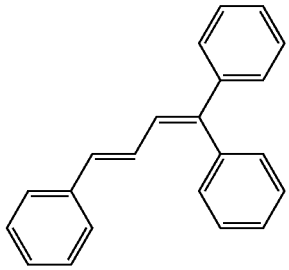

AD-7

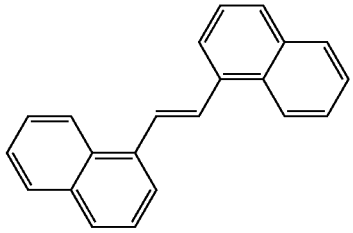

-continued

AD-8

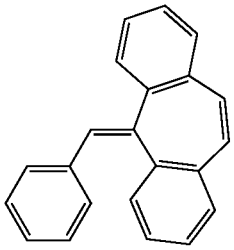

AD-9

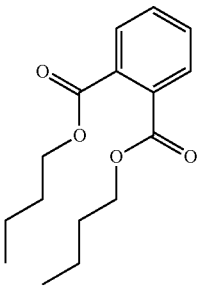

AD-10

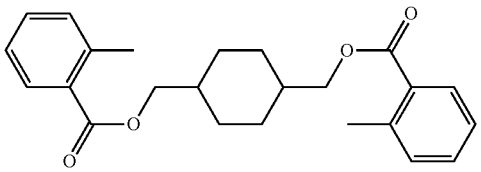

AD-11

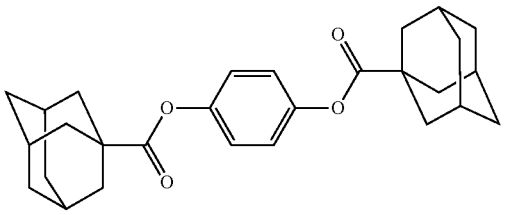

AD-12

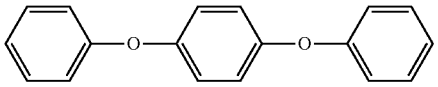

AD-13

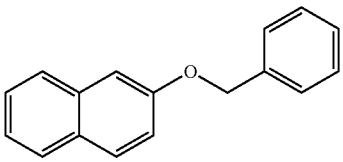

AD-14

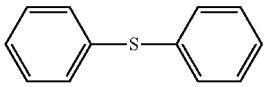

Among these plasticizers, preferred are AD-2, AD-4, AD-5, AD-6, AD-8, AD-10, AD-11, and AD-13, and more preferred are AD-2, AD-6, AD-8, AD-10, AD-11, and AD-13. With the above plasticizers, gas resistance and crack resistance can be improved without deteriorating electrical properties.

In addition, examples of the dye and pigment include various coloring matter compounds, azo compounds, or the like.

The charge transport layer may contain inorganic particles such as alumina and silica, and organic particles such as fluorine resin particles, silicone particles, polyethylene particles, crosslinked polystyrene particles, and crosslinked (meth)acrylate particles, for the purpose of reducing the frictional resistance and abrasion on the surface of the photoreceptor and increasing the transfer efficiency of the toner from the photoreceptor to a transfer belt or paper.

In addition, the photosensitive layer may contain various additives such as a leveling agent, an antioxidant, and a sensitizer in order to improve the coating properties, if necessary. Examples of the antioxidant include a hindered phenol compounds, a hindered amine compound, or the like. In addition, examples of the dye and pigment include various coloring matter compounds, azo compounds, or the like. Examples of the surfactant include silicone oil, fluorinated oil, or the like.

Examples of the electron-attracting compound include: cyano compounds such as tetracyanoquinodimethane, dicyanoquinomethane, and aromatic esters having a dicyanoquinovinyl group; nitro compounds such as 2,4,6-trinitrofluorenone; condensed polycyclic aromatic compounds such as perylene; diphenoquinone derivatives; quinones; aldehydes; ketones; esters; acid anhydrides; phthalides; metal complexes of substituted and unsubstituted salicylic acid; metal salts of substituted and unsubstituted salicylic acid; metal complexes of aromatic carboxylic acids; and metal salts of aromatic carboxylic acids. Preferably, cyanide compounds, nitro compounds, condensed polycyclic aromatic compounds, diphenoquinone derivatives, metal complexes of substituted and unsubstituted salicylic acid, metal salts of substituted and unsubstituted salicylic acid, metal complexes of aromatic carboxylic acids, and metal salts of aromatic carboxylic acids are used.

The electrophotographic photoreceptor in the present invention has a roughness (Rz) in a range of preferably 0.1 μm or more, and in a range of preferably 1 μm or less, more preferably 0.8 μm or less, still more preferably 0.6 μm or less, even more preferably 0.4 μm or less.

When the roughness is more than 1 abrasion resistance may deteriorate. This is because the dispersion state of the filler deteriorates, the contact interface between the filler and the inside of the photoreceptor is reduced, and the effect of the filler is reduced. If the dispersion state of the filler becomes worse, the amount of the aggregated filler increases and the roughness also increases. Further, when Rz is too large, the chargeability differs between a convex portion and a concave portion (that is, thick and thin portions with respect to the surface layer), and charging unevenness and abrasion unevenness tend to occur.

Here, the roughness (Rz) refers to a ten-point average roughness defined in JIS-B-0601 (1994). That is, the roughness (Rz) refers to a difference value, expressed in micrometers (μm), between an average value of heights of five summit points (the highest point to the fifth highest point) and an average value of heights of five valley points (the deepest point to the fifth deepest point) which are measured in a direction perpendicular to an average line from a straight line parallel to the average line and not crossing the cross section curve in a portion extracted by a reference length from a cross section curve of the photoreceptor.

The roughness (Rz) can be measured, for example, by a cutoff type Gaussian method in which the reference length is 0.8 mm, the cutoff wavelength is 0.8 mm, and the measurement speed is 0.1 mm/sec using a surface roughness measuring device (surface roughness measuring machine SV-548, manufactured by Mitutoyo Corporation). The measurement position of the roughness is a central portion in the axial direction of the electrophotographic photoreceptor.

A protective layer may be provided on the outermost surface layer of the photoreceptor for the purpose of preventing the abrasion of the photosensitive layer or preventing or reducing the deterioration of the photosensitive layer due to a discharge substance or the like generated from a charger or the like. The protective layer is formed by incorporating a conductive material in a suitable binder resin, or can use copolymers using a compound having charge transport ability such as a triphenylamine skeleton as described in JP-A-H9-190004 and JP-A-H10-252377.

As the conductive material, aromatic amino compounds such as N,N-diphenyl-N,N'-bis-(m-tolyl) benzidine (TPD), and metal oxides such as antimony oxide, indium oxide, tin oxide, titanium oxide, tin oxide-antimony oxide, aluminum oxide, and zinc oxide can be used, but it is not limited thereto.

As the binder resin used in the protective layer, known resins such as a polyamide resin, a polyurethane resin, a polyester resin, an epoxy resin, a polyketone resin, a polycarbonate resin, a polyvinyl ketone resin, a polystyrene resin, a polyacrylamide resin, and a siloxane resin can be used, and copolymers of a skeleton having charge transport ability such as a triphenylamine skeleton as described in JP-A-H9-190004 and JP-A-H10-252377 and the above resins can also be used.

The protective layer is preferably configured to have an electrical resistance of $10^9$ Ω·cm to $10^{14}$ Ω·cm. When the electrical resistance is higher than $10^{14}$ Ω·cm, the residual potential may increase, resulting in an image with a large amount of fog; on the other hand, when the electrical resistance is lower than $10^9$ Ω·cm, the image may be blurred or the resolution may be reduced. In addition, the protective layer is configured such that it does not substantially prevent the transmission of light emitted to the image exposure.

Further, the surface layer may contain a fluorine resin, a silicone resin, a polyethylene resin, a polystyrene resin or the like, for the purpose of reducing the frictional resistance and abrasion on the surface of the photoreceptor and increasing the transfer efficiency of the toner from the photoreceptor to the transfer belt or paper. Furthermore, the surface layer may contain particles of these resins or particles of inorganic compounds such as silica and alumina.

<Layer Formation Method>

Each layer constituting the photoreceptor is formed by coating a coating liquid containing the material constituting each layer on the support using a known coating method, repeating the coating and drying steps for each layer, and sequentially coating each layer.

Solvents or dispersion medium to be used in preparation of the photosensitive layer is not particularly limited, and specific examples thereof include ethers such as tetrahydrofuran, 1,4-dioxane, and dimethoxyethane, esters such as methyl formate and ethyl acetate, ketones such as acetone, methyl ethyl ketone, and cyclohexanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, and aprotic polar solvents such as acetonitrile, N-methylpyrrolidone, N,N-dimethylformamide, and dimethyl sulfoxide. One selected from these may be used alone, or two or more selected from these may be used in any desired combination.

Although the amount of the solvent or dispersion medium to be used is not particularly limited, the amount thereof is preferably adjusted, as appropriate, in accordance with the intended purpose of each layer and nature of the selected solvent or dispersion media so as to set properties such as the solid content concentration or viscosity of the coating liquid, to be in desired ranges.

In a case of a charge transport layer of a single-layer type photoreceptor and a lamination type photoreceptor, the solid content concentration of the coating liquid is generally in a range of 5% by mass or more, preferably 10% by mass or more, and on the other hand, is generally in a range of 40% by mass or less, preferably 35% by mass or less. In addition, the viscosity of the coating liquid is generally in a range of 10 mPa·s or more, preferably 50 mPa·s or more, and on the other hand, is generally in a range of 1,500 mPa·s or less, preferably 1,200 mPa·s or less, more preferably 500 mPa·s or less, still more preferably 400 mPa·s or less.

In a case of a charge generation layer of a lamination type photoreceptor, the solid content concentration of the coating liquid is generally in a range of 0.1 mass % or more, preferably 1 mass % or more, and on the other hand, is generally in a range of 15 mass % or less, preferably 10 mass % or less. In addition, the viscosity of the coating liquid is generally in a range of 0.01 mPa·s or more, preferably 0.1 mPa·s or more, and on the other hand, is generally in a range of 20 mPa·s or less, preferably 10 mPa·s or less.

Examples of a method for coating the coating liquid include a dip coating method, a spray coating method, a spinner coating method, a bead coating, a wire bar coating method, a blade coating method, a roller coating method, an air-knife coating method, a curtain coating method, or the like, and other known coating methods can also be used.

Regarding the drying of the coating liquid, it is preferable that after a touch drying at room-temperature, the coating liquid is dried with heating in a temperature range of 30° C. to 200° C. for 1 minute to 2 hours without air or under air. In addition, the heating temperature may be constant or may be changed during the drying.

<Electrophotographic Photoreceptor Cartridge and Image Forming Apparatus>

An electrophotographic photoreceptor cartridge (process cartridge, cartridge) used in copiers, printers, or the like using the electrophotographic photoreceptor of the present invention, and an image forming apparatus equipped with the cartridge includes processes such as charging, exposure, development, transfer, and cleaning, and any process may use any method commonly used.

An electrophotographic photoreceptor cartridge includes: the electrophotographic photoreceptor; and at least one device selected from the group consisting of: a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

In addition, the image forming apparatus of the present invention includes: the electrophotographic photoreceptor; a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

As a charging method (charging machine), for example, direct charging unit may be used in which a direct charging member to which a voltage is applied is brought into contact with the surface of the photoreceptor for charging, in addition to scorotron and scorotron charging utilizing corona discharge. As the direct charging unit, any contact charging by a charging roll, a brush, a film or the like may be used, and injection charging with air discharge or injection charging without air discharge can also be used.

Among these, in the charging method using corona discharge, scorotron charging is preferred in order to keep the dark part potential constant. The charging roll used in the present invention is preferably one in which a conductive elastic layer is formed on a conductive shaft core. As a charging method in the case of a contact charging device using a charging roll or the like, direct-current charging or alternating-current superimposed direct-current charging can be used.

The volume resistivity of the charging roll used in the present invention is preferably 0.1 MΩ·cm to 5 MΩ·cm at a temperature of 25° C. and a humidity of 50% RH. The above range is preferred since the leak resistance is improved and the discharge start voltage is appropriate, and since the ghost property is improved for the same applied voltage.

Next, a drum cartridge will be described as an example of a cartridge using the electrophotographic photoreceptor of the present invention, and the drum cartridge and the image forming apparatus will be described based on FIG. 1 showing an example of the apparatus.

As shown in FIG. 1, the image forming apparatus is provided with an electrophotographic photoreceptor 1, a charging device 2, an exposure device 3, and a developing device 4, and if necessary, is further provided with a transfer device 5, a cleaning device 6, and a fixing device 7.

The electrophotographic photoreceptor 1 is not particularly limited as long as it is an electrophotographic photoreceptor according to the present invention. FIG. 1 shows, as an example thereof, a drum-shaped photoreceptor obtained by forming the photosensitive layer described above on the surface of a cylindrical conductive support. The charging device 2, the exposure device 3, the developing device 4, the transfer device 5, and the cleaning device 6 are disposed along the peripheral surface of this electrophotographic photoreceptor 1.

The charging device 2, which is the one that charges the electrophotographic photoreceptor 1, uniformly charges the surface of the electrophotographic photoreceptor 1 to a predetermined potential. In FIG. 1, a roller type charging device (charging roller) is shown as an example of the charging device 2, but a corona charging device such as scorotron or scorotron, a contact type charging device such as a charging brush, and the like are often used.

In many cases, the electrophotographic photoreceptor 1 and the charging device 2 are designed to be removable from a main body of the image forming apparatus as a cartridge (hereinafter referred to as a photoreceptor cartridge) including both of them. For example, in a case where the electrophotographic photoreceptor 1 or the charging device 2 deteriorates, the photoreceptor cartridge can be removed from the main body of the image forming apparatus, and another new photoreceptor cartridge can be mounted to the main body of the image forming apparatus. In addition, the cartridge may be designed to be removable from the main body of the image forming apparatus as a cartridge including the photoreceptor 1 and the exposure device 3 and/or the developing device 4, in addition to the charging device 2 or instead of the charging device 2.

In many cases, a toner T to be described later is stored in a toner cartridge and is also designed to be removable from the main body of the image forming apparatus. In a case where the toner in the toner cartridge being used runs out, this toner cartridge can be removed from the main body of the image forming apparatus, and another new toner cartridge can be mounted.

Further, a cartridge including all the electrophotographic photoreceptor 1, the charging device 2, and the toner T may also be used.

The type of the exposure device 3 is not particularly limited as long as it is an exposure device that is capable of exposing the electrophotographic photoreceptor 1 to light and forming an electrostatic latent image on the photosensitive surface of the electrophotographic photoreceptor 1. Specific examples thereof include a halogen lamp, a fluorescent lamp, a laser such as a semiconductor laser or a He—Ne laser, and an LED. Exposure may be performed by an internal photoreceptor exposure technique, or the like. The light during the exposure is arbitrary, and for example, monochromatic light having a wavelength of 780 nm, monochromatic light having a slightly short wavelength in a range of 600 nm to 700 nm, monochromatic light having a short wavelength in a range of 380 nm to 500 nm, or the like can be used.

The type of the developing device 4 is not particularly limited as long as it can develop the electrostatic latent image formed on the electrophotographic photoreceptor 1. Specifically, it is possible to use any device using dry development methods such as cascade development, one-component conductive toner development and two-components magnetic brush development, or wet development methods.

In FIG. 1, the developing device 4 includes a developing tank 41, an agitator 42, a supply roller 43, a developing roller 44, and a regulating member 45, and the toner T is stored inside the developing tank 41. In addition, if necessary, a replenishing device (not shown) for replenishing the toner T may be attached to the developing device 4. The replenishing device is configured to be capable of replenishing the toner T from a container such as a bottle or a cartridge.

The type of the transfer device 5 is not particularly limited, and devices using any technique such as an electrostatic transfer technique, a pressure transfer technique, and an adhesive transfer technique, e.g., corona transfer, roller transfer, or belt transfer can be used. Herein, the transfer device 5 includes a transfer charger, a transfer roller, and a transfer belt configured to face the electrophotographic photoreceptor 1. This transfer device 5 applies a predetermined voltage (transfer voltage) in a polarity opposite to the charge potential of the toner T, and thereby transfers a toner image formed on the electrophotographic photoreceptor 1 onto a recording paper (paper and print medium) P.

The type of the cleaning device 6 is not particularly limited, and any cleaning device such as a brush cleaner, a magnetic brush cleaner, an electrostatic brush cleaner, a magnetic roller cleaner, and a blade cleaner can be used. In the present invention, the effect is easily exhibited in the case of a blade cleaner. The cleaning device 6 scrapes off the remaining toner attached to the photoreceptor 1 with a cleaning member to collect the remaining toner.

The electrophotographic apparatus (image forming apparatus) configured as above records an image as follows.

In FIG. 1, the drum-shaped photoreceptor 1 is rotationally driven at a predetermined peripheral speed in the arrow direction. The photoreceptor 1 is uniformly charged by a predetermined positive or negative potential on the surface thereof by the charging device 2 in the process of rotation. At this time, the charging device 2 may charge the surface of the photoreceptor using a direct-current voltage or using an alternate-current voltage superimposed with a direct-current voltage. Next, in the exposure device 3, exposure for forming a latent image is performed by the image exposure unit.

Then, the formed electrostatic latent image is toner-developed by the developing device 4, and the toner development image is sequentially transferred from a paper feeding portion by the transfer device 5 such as corona transfer to the recording paper P such as paper as a fed transfer body. In FIG. 1, the developing device 4 includes the developing tank 41, the agitator 42, the supply roller 43, the developing roller 44, and the regulating member 45, and the toner T is stored inside the developing tank 41. In addition, if necessary, the replenishing device (not shown) for replenishing the toner T may be attached to the developing device 4. The replenishing device is configured to be capable of replenishing the toner T from a container such as a bottle or a cartridge. Then, the image-transferred transfer body is sent to the fixing device 7 and image-fixed, and the image is printed out.

The fixing device 7 includes an upper fixing member (fixing roller) 71 and a lower fixing member (fixing roller) 72. A heating device 73 is provided inside the upper fixing member 71 or the lower fixing member 72. FIG. 1 shows an example in which the heating device 73 is provided inside the upper fixing member 71. Each of the upper fixing member 71 and the lower fixing member 72 can use a known heat fixing member for a fixing roll in which a tube of metal such as stainless steel or aluminum is coated with silicone rubber, a fixing roll which is coated with Teflon (registered trademark) resin, a fixing sheet, or the like. Further, each of the upper fixing member 71 and the lower fixing member 72 may be configured to supply a releasing agent such as silicone oil in order to improve the releasability, or may be configured to forcibly apply pressure to each other by a spring or the like.

When the toner transferred onto the recording paper P passes through between the upper fixing member 71 and the lower fixing member 72 heated to a predetermined temperature, the toner is thermally heated to a molten state, cooled after passing, and fixed on the recording paper P.

After the image transfer, the surface of the photoreceptor 1 is cleaned of the transfer residual toner by the cleaning device 6, and the charge on the surface is eliminated by a charge elimination unit and cleaned for the next image formation.

In using the electrophotographic photoreceptor of the present invention, as the charger, direct charging unit may be used in which a direct charging member to which a voltage is applied is brought into contact with the surface of the photoreceptor for charging, in addition to a corona charger such as scorotron or scorotron.

Examples of the direct charging unit include a contact charger such as a charging roller and a charging brush. As the direct charging unit, injection charging with air discharge or injection charging without air discharge can also be used. In addition, as the voltage to be applied for the charging, a direct-current voltage only can be used or an alternate-current voltage superimposed with a direct-current voltage can also be used.

For exposure, a halogen lamp, a fluorescent lamp, a laser (semiconductor and He—Ne), an LED, an exposure system inside the photoreceptor, or the like are used. As a digital electrophotographic system, it is preferable to use a laser, an LED, an optical shutter array or the like. As the wavelength, in addition to monochromatic light a wavelength of 780 nm, monochromatic light having a slightly short wavelength in a range of 600 nm to 700 nm can be used.

In the development process, dry development methods such as cascade development, one-component insulation toner development, one-component conductive toner development and two-component magnetic brush development, or wet development methods are used.

As the toner, in addition to a pulverized toner, a chemical toner of suspension granulation, suspension polymerization, emulsion polymerization aggregation or the like can be used. Particularly, in the case of the chemical toner, one having a small particle diameter of about 4 μm to 8 μm is used, and one having a shape close to a spherical shape or one having a shape other than a spherical shape such as potato can be used. Polymerization toners, which are excellent in terms of uniformity in charging and transferability, are preferably used for increasing image quality.

In the transfer process, an electrostatic transfer technique, a pressure transfer technique, and an adhesive transfer technique, e.g., corona transfer, roller transfer, or belt transfer can be used. The fixing is performed using heat roller fixing, flash fixing, oven fixing, pressure fixing, IH fixing, belt fixing, IHF fixing, or the like. These fixing methods may be used alone or in combination of a plurality of fixing methods.

A brush cleaner, a magnetic brush cleaner, an electrostatic brush cleaner, a magnetic roller cleaner, a blade cleaner or the like is used for cleaning.

The charge elimination step is often omitted, but when it is used, a fluorescent lamp, an LED or the like is used, and as the intensity, exposure energy three or more times the exposure light is often used. In addition to these processes, a pre-exposing step and an auxiliary charging step may be included.

In the present invention, a plurality of components, such as the drum-shaped photoreceptor 1, the charging device 2, the developing device 4 and the cleaning device 6, are integrally combined as a drum cartridge, and this drum cartridge may be configured to be detachable from the main body of an electrophotographic apparatus such as a copier or a laser beam printer. For example, at least one of the charging device 2, the developing device 4 and the cleaning device 6 can be integrally supported together with the drum-shaped photoreceptor 1 so as to form a cartridge.

In addition, the image forming apparatus may further be modified such that the image forming apparatus is configured, for example, to be capable of performing a pre-exposing step or an auxiliary charging step, or to be capable of offset printing, or further may be configured as a full-color tandem system employing multiple kinds of toners.

EXAMPLES

Hereinafter, embodiments of the present invention will be described more specifically with reference to examples. It is to be noted that the following Examples are presented for the purpose of explaining the present invention in detail, and the present invention is not limited to the following Examples, and can be arbitrarily modified and carried out within the scope not departing from the gist of the invention. In the following Examples and Comparative Examples, the term "parts" means "parts by mass" unless otherwise specified.

Examples 1-1 to 1-8 and Comparative Examples 1-1 to 1-10

<Preparation of Undercoat Layer Forming Coating Liquid>

Coating Liquid A

Rutile type titanium oxide ("TTO55N" manufactured by Ishihara Sangyo Kaisha, Ltd.) having an average primary particle diameter of 40 nm and 3% by mass of methyl dimethoxysilane ("TSL8117" manufactured by Toshiba Silicone Co., Ltd.) based on the titanium oxide were mixed in a Henschel mixer. 1 kg of a raw material slurry obtained by mixing 50 parts by mass of the obtained surface treated titanium oxide and 120 parts by mass of methanol was subjected to a dispersion treatment for 1 hour in a liquid circulation state with a rotor peripheral speed of 10 m/s and a liquid flow rate of 10 kg/h, with zirconia beads (YTZ manufactured by Nikkato Corporation) having a diameter of about 100 μm as dispersion media by using an ultra apex mill (UAM-015 type) having a mill volume of about 0.15 L manufactured by Kotobuki Industries Co., Ltd., so as to prepare a titanium oxide dispersion liquid.

The titanium oxide dispersion liquid, a mixed solvent of methanol/1-propanol/toluene, and pellets of a copolymerized polyamide containing ε-caprolactam [a compound represented by the following Formula (A)], bis(4-amino-3-methylcyclohexyl) methane [compound represented by the following Formula (B)], hexamethylenediamine [compound represented by the following Formula (C)], decamethylenedicarboxylic acid [compound represented by the following formula (D)] and octadecamethylene dicarboxylic acid [compound represented by the Following formula (E)] in a composition molar ratio of 75%, 9.5%, 3%, 9.5% and 3% were stirred and mixed with heating, so as to dissolve the polyamide pellets. Thereafter, the mixture was subjected to an ultrasonic dispersion treatment by using an ultrasonic transmitter with an output of 1200 W for 1 hour, and was further filtrated with PTFE membrane filter (Mytex LC, manufactured by Advantech Co., Ltd.) having a pore size of 5 μm. Thus, an undercoat layer forming coating liquid A having surface-treated titanium oxide/copolymerized polyamide in a mass ratio of 3/1, methanol/1-propanol/toluene in a mass ratio of 7/1/2, and a solid content concentration of 18.0% by mass was prepared.

A

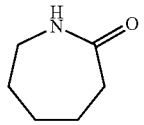

B

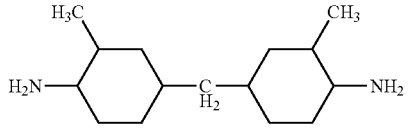

C

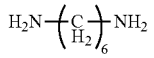

D

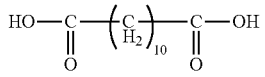

-continued

E

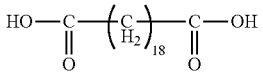

<Preparation of Charge Generation Layer Forming Coating Liquid>

Charge Generation Layer Forming Coating Liquid B

The charge generation layer forming coating liquid was prepared as follows. As the charge generation substance, 20 parts by mass of oxytitanium phthalocyanine showing an X-ray diffraction spectrum in FIG. 2 and 280 parts by mass of 1,2-dimethoxyethane were mixed with each other, and the mixture was subjected to a pulverization/dispersion treatment for 1 hour by using a sand grinding mill. Subsequently, the resultant pulverized treatment liquid was mixed with a binder liquid obtained by dissolving 10 parts by mass of polyvinyl butyral (trade name "Denka Butyral" #6000C, manufactured by Denki Kagaku Kogyo K.K.) in a mixed solution containing 255 parts by mass of 1,2-dimethoxyethane and 85 parts by mass of 4-methoxy-4-methyl-2-pentanone, and mixed with 230 parts by mass of 1,2-dimethoxyethane, so as to prepare a charge generation layer forming coating liquid B1.

Figure 3:
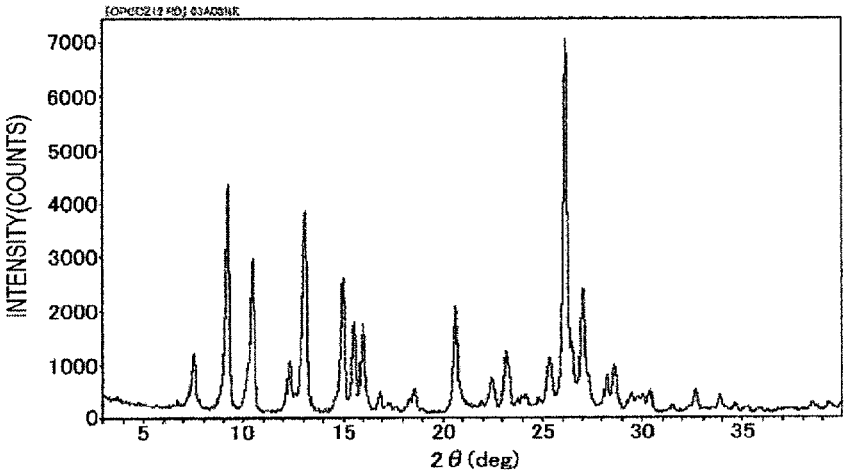
FIG. 3 is a figure showing a diffraction spectrum by a CuKα characteristic X-ray of A-form oxytitanium phthalocyanine used in Examples.

As the charge generation substance, 20 parts by mass of oxytitanium phthalocyanine showing an X-ray diffraction spectrum in FIGS. 3 and 280 parts by mass of 1,2-dimethoxyethane were mixed with each other, and the mixture was subjected to a pulverization/dispersion treatment for 4 hours by using a sand grinding mill. Subsequently, the resultant pulverized treatment liquid was mixed with a binder liquid obtained by dissolving 10 parts by mass of polyvinyl butyral (trade name "Denka Butyral" #6000C, manufactured by Denki Kagaku Kogyo K.K.) in a mixed solution containing 255 parts by mass of 1,2-dimethoxyethane and 85 parts by mass of 4-methoxy-4-methyl-2-pentanone, and mixed with 230 parts by mass of 1,2-dimethoxyethane, so as to prepare a charge generation layer forming coating liquid B2.

The charge generation layer forming coating liquid B1 and the charge generation layer forming coating liquid B2 were mixed with each other at a proportion (mass ratio) of 6:4, so as to prepare the charge generation layer forming coating liquid B used in the Examples.

<Preparation of Charge Transport Layer Forming Coating Liquid>

Charge Transport Layer Forming Coating Liquid C1

10 parts by mass of polytetrafluoroethylene particles (average primary particle diameter=0.3 μm; KTL-500F manufactured by Kitamura Chemical, hereinafter referred to as KTL) and 0.5 part by mass of a fluorinated graft polymer (GF400, manufactured by TOAGOSEI CO., LTD.) were added to 90 parts by mass of a tetrahydrofuran solvent, and the mixture was subjected to ultrasonic dispersion for 1 hour, so as to obtain a primary slurry liquid CA1.

Next, the primary slurry liquid CA1 was subjected to five passes of dispersion treatment by being pressurized to 100 MPa, using a high pressure collision type disperser (Star Burst Mini manufactured by Sugino Machine), so as to obtain a KTL dispersion liquid CA2.

As a CB liquid, 64 parts by mass of a polycarbonate resin (resin X1, having a viscosity average molecular weight of 50,000) represented by the following repeating structure, 29 parts by mass of a compound represented by (HT-17) described above as the charge transport substance, 1 part by mass of a compound AD1 represented by the following formula, and 0.03 part by mass of a leveling agent silicone oil (KF96-10CS manufactured by Shin-Etsu Chemical Co., Ltd.) were dissolved by being heated and stirred in a mixed solvent of 9:1 (mass ratio) of tetrahydrofuran and anisole, so as to obtain a CB liquid having a solid content concentration of 18% by mass.

The KTL dispersion liquid CA2 was added to the CB liquid such that the fluorine resin particles were 6 parts by mass, and the mixture was dispersed for 1 hour at 7,000 rpm using a homo-mixer, so as to obtain a charge transport layer forming coating liquid C1.

RESIN X1

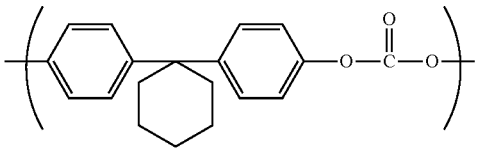

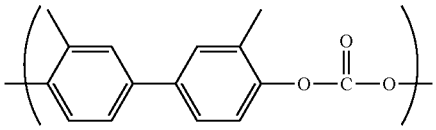

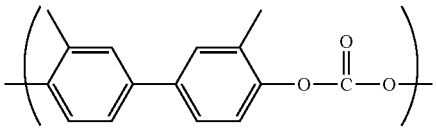

AD1

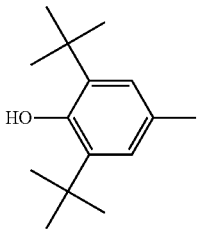

Charge Transport Layer Forming Coating Liquid C2

A charge transport layer forming coating liquid C2 was prepared in the same manner as C1, except that the KTL dispersion liquid CA2 used in the charge transport layer forming coating liquid C1 was added to the CB liquid in an amount (part by mass) such that the fluorine resin particles were 11 parts by mass.

Charge Transport Layer Forming Coating Liquid C3

A charge transport layer forming coating liquid C3 was prepared in the same manner as C1, except that the KTL dispersion liquid CA2 used in the charge transport layer forming coating liquid C1 was added to the CB liquid in an amount (part by mass) such that the fluorine resin particles were 16 parts by mass.

Charge Transport Layer Forming Coating Liquid C4

A charge transport layer forming coating liquid C4 was prepared in the same manner as C1, except that, instead of the KTL dispersion liquid CA2 used in the charge transport layer forming coating liquid C1, the primary slurry liquid CA1 only subjected to ultrasonic dispersion was added to the CB liquid such that the fluorine resin particles were 6 parts by mass.

Charge Transport Layer Forming Coating Liquid C5

A charge transport layer forming coating liquid C5 was prepared in the same manner as C4, except that the primary slurry liquid CA1 used in the charge transport layer forming coating liquid C4 was added to the CB liquid in an amount (part by mass) such that the fluorine resin particles were 11 parts by mass.

Charge Transport Layer Forming Coating Liquid C6

A charge transport layer forming coating liquid C6 was prepared in the same manner as C4, except that the primary slurry liquid CA1 used in the charge transport layer forming coating liquid C4 was added to the CB liquid in an amount (part by mass) such that the fluorine resin particles were 16 parts by mass.

Charge Transport Layer Forming Coating Liquid C7

A charge transport layer forming coating liquid C7 was prepared in the same manner as C1, except that the KTL dispersion liquid CA2 used in the charge transport layer forming coating liquid C1 was not added to the CB liquid and the CB liquid was used as it was.

Charge Transport Layer Forming Coating Liquid C8

A charge transport layer forming coating liquid C8 was prepared in the same manner as C1, except that the KTL dispersion liquid CA2 used in the charge transport layer forming coating liquid C1 was added to the CB liquid in an amount (part by mass) such that the fluorine resin particles were 1 part by mass.

Charge Transport Layer Forming Coating Liquid C9

A charge transport layer forming coating liquid C9 was prepared in the same manner as C1, except that the KTL dispersion liquid CA2 used in the charge transport layer forming coating liquid C1 was added to the CB liquid in an amount (part by mass) such that the fluorine resin particles were 22 parts by mass.

Charge Transport Layer Forming Coating Liquid C10

A charge transport layer forming coating liquid C10 was prepared in the same manner as C1, except that the KTL dispersion liquid CA2 used in the charge transport layer forming coating liquid C1 was not added to the CB liquid and the CTM in the CB liquid was changed from (HT-17) to HT-20 represented by the following formula.

HT-20

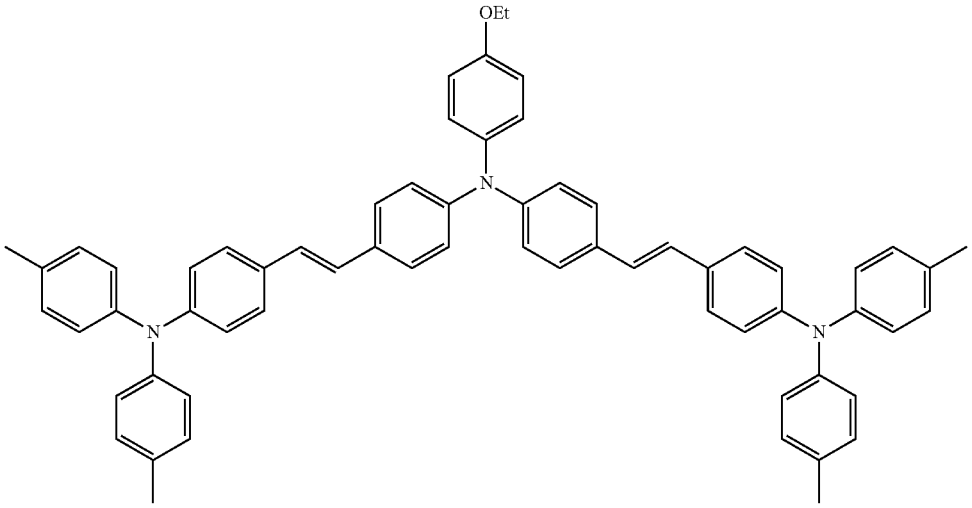

Charge Transport Layer Forming Coating Liquid C11

A charge transport layer forming coating liquid C11 was prepared in the same manner as C1, except that the KTL dispersion liquid CA2 used in the charge transport layer forming coating liquid C1 was added to the CB liquid in an amount (part by mass) such that the fluorine resin particles were 1 parts by mass, and the CTM in the CB liquid wad changed from (HT-17) to above (HT-20).

Charge Transport Layer Forming Coating Liquid C12

A charge transport layer forming coating liquid C12 was prepared in the same manner as C11, except that the KTL dispersion liquid CA2 used in the charge transport layer forming coating liquid C11 was added to the CB liquid in an amount (part by mass) such that the fluorine resin particles were 6 parts by mass.

Charge Transport Layer Forming Coating Liquid C13

A charge transport layer forming coating liquid C13 was prepared in the same manner as C11, except that the KTL dispersion liquid CA2 used in the charge transport layer forming coating liquid C11 was added to the CB liquid in an amount (part by mass) such that the fluorine resin particles were 11 parts by mass.

Charge Transport Layer Forming Coating Liquid C14

A charge transport layer forming coating liquid C14 was prepared in the same manner as C11, except that the KTL dispersion liquid CA2 used in the charge transport layer forming coating liquid C11 was added to the CB liquid in an amount (part by mass) such that the fluorine resin particles were 22 parts by mass.

Charge Transport Layer Forming Coating Liquid C15

A charge transport layer forming coating liquid C15 was prepared in the same manner as C2, except that the CTM used in the charge transport layer forming coating liquid C2 was changed from (HT-17) to HT-21 represented by the following formula.

HT-21

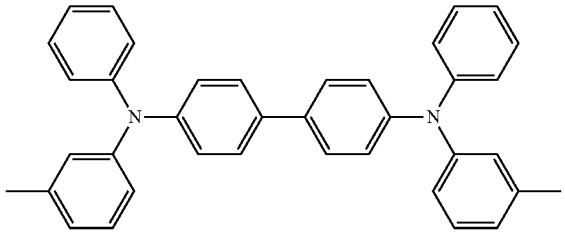

Charge Transport Layer Forming Coating Liquid C16

A charge transport layer forming coating liquid C16 was prepared in the same manner as C2, except that the CTM used in the charge transport layer forming coating liquid C2 was changed from (HT-17) to HT-22 represented by the following formula.

HT-22

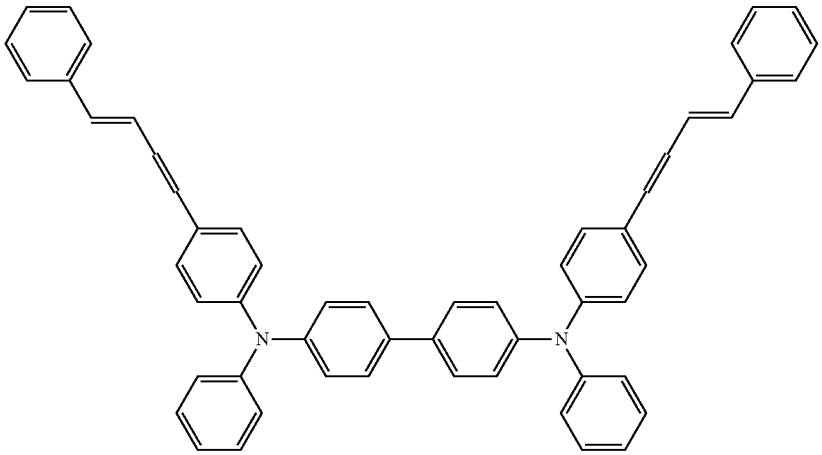

Charge Transport Layer Forming Coating Liquid C17

10 parts by mass of silicon oxide (average particle diameter=0.2 μm) (product name KE-S30 subjected to surface treatment, manufactured by Nippon Shokubai Co., Ltd., hereinafter referred to as KET30) which was subjected to surface treatment with hexamethylenedisilazane was added to 90 parts by mass of a tetrahydrofuran solvent, and the mixture was subjected to ultrasonic dispersion for 1 hour, so as to obtain a primary slurry liquid CA17.

As a CB17 liquid, 64 parts by mass of a polycarbonate resin (resin X1, having a viscosity average molecular weight of 50,000) represented by the repeating structure same as that of the CB liquid, 29 parts by mass of the compound represented by (HT-17) described above as the charge transport substance, 1 part by mass of the above compound AD1, and 0.03 part by mass of a leveling agent silicone oil (KF96-10CS manufactured by Shin-Etsu Chemical Co., Ltd.) were dissolved by being heated and stirred in a mixed solvent of 9:1 (mass ratio) of tetrahydrofuran and anisole, so as to obtain a CB17 liquid having a solid content concentration of 18% by mass.

The primary slurry liquid CA17 was added to the CB17 liquid such that the KET30 was 11 parts by mass, and the mixture was dispersed for 1 hour at 7,000 rpm using a homo-mixer, so as to obtain a charge transport layer forming coating liquid C17.

<Preparation of Photoreceptor Drum>

Using the charge transport layer forming coating liquids (coating liquids) C1 to C17 obtained above, photoreceptor drums corresponding to Examples 1-1 to 1-8 (coating liquids C1 to C6, C12, and C13) and Comparative Examples 1-1 to 1-10 (coating liquids C7 to C11, and C14 to C17) as shown in Table 1 were prepared as follows.

An undercoat layer forming coating liquid, a charge generation layer forming coating liquid, and a charge transport layer forming coating liquid which were prepared in the preparation example of the coating liquid were sequentially applied to a cylinder made of an aluminum alloy, of which the surface was subjected to a cutting process and which has an external diameter of 30 mm, a length of 248 mm, and a film thickness of 0.75 mm, by using a dip coating method, and dried so as to form an undercoat layer, a charge generation layer, and a charge transport layer such that the film thicknesses thereof after drying respectively were 1.5 μm, 0.5 μm, and 36 μm, and thereby an electrophotographic photoreceptor drum was prepared. Note that, the charge transport layer was dried at 125° C. for 24 minutes.

For a leak test, a photoreceptor drum was prepared in the same manner as above, except that the thickness of the charge transport layer was set to 20 μm using a cylinder made of an aluminum alloy of which the surface is machined and which has an external diameter of 24 mm, a length of 255 mm, and a film thickness of 0.75 mm.

<Evaluation on Dispersibility>

The dispersibility of the fluorine resin particles on the surface of the photoreceptor was confirmed visually or by palpation. The results are shown in Table-1. The levels of dispersibility are as follows.

○: there is little aggregation on the surface of the photoreceptor, and no rough aggregation is felt even when it is touched with a hand.

Δ: aggregation is observed at a very small portion particularly at a lower end on the surface of the photoreceptor. When it is touched with a hand, rough aggregations are felt. However, there is no problem in practical use because the rough aggregations are out of the image area.

x: aggregations are observed on the entire surface of the photoreceptor, and rough aggregations are felt when it is touched with a hand. There is also a problem in practical use because the rough aggregations are within the image area.

<Evaluation on Electrical Properties>

Next, the electrophotographic photoreceptors were attached to an electrophotography property evaluation apparatus manufactured in accordance with the measurement standards of the Society of Electrophotography of Japan (as described in Foundation and Application of Electrophotographic Technique (Continued), edited by the Society of Electrophotography of Japan, published by CORONA PUBLISHING CO., LTD., (1996), Pages 404 to 405), and attached to a photoreceptor property measuring machine. Then, according to the following procedures, evaluation on electrical properties was performed under an environment of 25° C./50% RH by cycles of charge (minus polarity), exposure, potential measurement, and charge removal. In addition, the photoreceptors were charged such that the initial surface potential thereof was −800 V, and were irradiated with the light of a halogen lamp made to be monochromatic light having a wavelength of 780 nm by an interference filter, and the exposure light was irradiated at an intensity of 0.6 μJ/cm$^2$ and after 40 ms, the surface potential (VL) after the exposure was measured (−V). Measured data are shown in Table-1.

<Measurement of Volume Resistivity>

Figure 4:
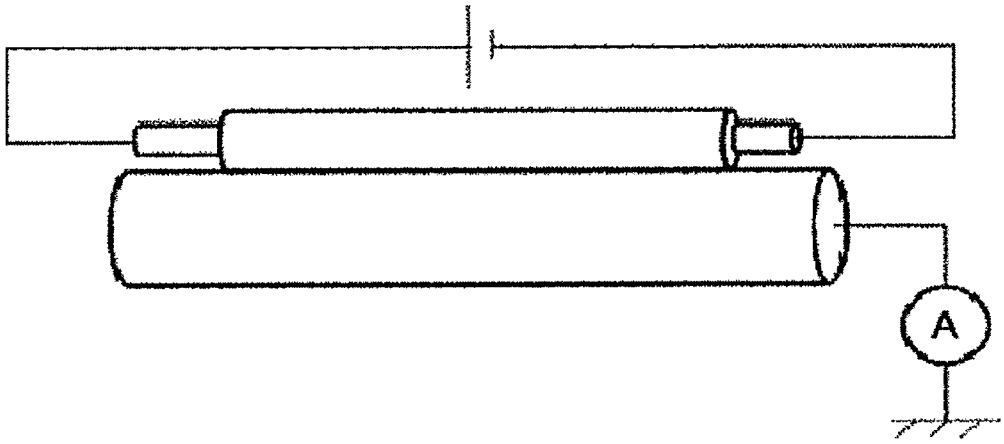
FIG. 4 is a schematic diagram for explaining a method of measuring a volume resistivity of a charging roll.

The volume resistivity of the charging roll was measured using the apparatus shown in FIG. 4. The charging roll was pressed against an aluminum drum and was measured while rotating at 30 rpm. A direct-current voltage was applied in the range of 10 V to 100 V, and a current value under each voltage was measured. Based on these measured values, the resistance value was calculated using Ohm's law. As for the shape of the charging roll, based on a nip width where the charging roll is in contact with the aluminum drum, a width from an axial center of the charging roll to the aluminum drum (layer width of a conductive elastic layer), and a length of the charging roll, the volume resistivity was obtained. The resistivity and the volume resistivity generally have the following relationship.

$$R=\rho A/L$$

R: resistivity

ρ: volume resistivity

A: area in contact with aluminum drum

L: layer width of conductive elastic layer

As a result, the volume resistivities of the charging rolls used in the Examples 1-1 to 1-8, Comparative Examples 1-1 to 1-8, and Comparative Examples 1-10 were 1.3 KΩ·cm, and the volume resistivity of the charging roll used in the Comparative Example 1-9 was 10.3 KΩ·cm.

<Image Test>

The obtained photoreceptor was mounted on a photoreceptor cartridge of a monochrome printer ML6510 (DC roller charging, laser exposure, nonmagnetic two-component, non-contact development) manufactured by Samsung Co., Ltd., and continuous printing of 30,000 sheets was performed at a coverage rate of 5% under a temperature of 25° C. and a relative humidity of 50%. The film thickness before and after printing 30,000 sheets was measured, and the amount of film reduction in terms of 1,000 revolutions of the photoreceptor was calculated. The results are shown in Table-1.

<Leak Test>

The obtained photoreceptor was mounted on a cartridge for a color printer CLP-680 manufactured by Samsung Co., Ltd., together with the charging roll. The cartridge was applied with a voltage by the charging roll while increasing the voltage by −0.5 kV every 1 minute from −1.5 kV under a temperature of 32° C. and a relative humidity of 80%, and the voltage at the time of leak was recorded. The voltage was applied while rotating the drum 30 times a minute. The results are shown in Table-1.

TABLE 1

| | Coating liquid | Charge transport substance | primary slurry liquid | Part by mass of added particle | Dispersibility | Roughness Rz [μm] | Volume resistivity [KΩ · cm] | electrical properties [−V] | Abrasion [nm/kc] | Applied voltage [−kV] |
|---|---|---|---|---|---|---|---|---|---|---|
| Example 1-1 | C1 | HT-17 | CA2 | PTFE 6 parts by mass | ○ | 0.12 | 1.3 | 81 | 12.8 | 2.5 |
| Example 1-2 | C2 | HT-17 | CA2 | PTFE 11 parts by mass | ○ | 0.27 | 1.3 | 79 | 9.1 | 3 |
| Example 1-3 | C3 | HT-17 | CA2 | PTFE 16 parts by mass | ○ | 0.39 | 1.3 | 80 | 7.8 | 3 |
| Example 1-4 | C4 | HT-17 | CA1 | PTFE 6 parts by mass | Δ | 0.43 | 1.3 | 82 | 16.3 | 2.5 |
| Example 1-5 | C5 | HT-17 | CA1 | PTFE 11 parts by mass | Δ | 0.62 | 1.3 | 81 | 12.8 | 3 |
| Example 1-6 | C6 | HT-17 | CA1 | PTFE 16 parts by mass | Δ | 0.82 | 1.3 | 79 | 11.1 | 3 |
| Comparative Example 1-1 | C7 | HT-17 | — | — | ○ | 0.11 | 1.3 | 80 | 17.7 | 1.5 |
| Comparative Example 1-2 | C8 | HT-17 | CA2 | PTFE 1 parts by mass | ○ | 0.11 | 1.3 | 79 | 18.1 | 1.5 |
| Comparative Example 1-3 | C9 | HT-17 | CA2 | PTFE 22 parts by mass | x | 0.12 | 1.3 | | Cannot disperse well | |
| Comparative Example 1-4 | C10 | HT-20 | — | — | ○ | 0.11 | 1.3 | 42 | 19.7 | 1.5 |
| Comparative Example 1-5 | C11 | HT-20 | CA2 | PTFE 1 parts by mass | ○ | 0.12 | 1.3 | 41 | 19.4 | 1.5 |
| Example 1-7 | C12 | HT-20 | CA2 | PTFE 6 parts by mass | ○ | 0.13 | 1.3 | 43 | 16.7 | 2.5 |
| Example 1-8 | C13 | HT-20 | CA2 | PTFE 11 parts by mass | ○ | 0.29 | 1.3 | 45 | 14.5 | 2.5 |
| Comparative Example 1-6 | C14 | HT-20 | CA2 | PTFE 22 parts by mass | x | 1.14 | 1.3 | | Cannot disperse well | |

TABLE 1-continued

| | Coating liquid | Charge transport substance | primary slurry liquid | Part by mass of added particle | Dispersibility | Roughness Rz [μm] | Volume resistivity [KΩ · cm] | electrical properties [−V] | Abrasion [nm/kc] | Applied voltage [−kV] |
|---|---|---|---|---|---|---|---|---|---|---|
| Comparative Example 1-7 | C15 | HT-21 | CA2 | PTFE 11 parts by mass | ○ | 0.29 | 1.3 | 293 | 12.1 | 3.5 |
| Comparative Example 1-8 | C16 | HT-22 | CA2 | PTFE 11 parts by mass | ○ | 0.28 | 1.3 | 125 | 13.5 | 2.5 |
| Comparative Example 1-9 | C16 | HT-22 | CA2 | PTFE 11 parts by mass | ○ | 0.28 | 10.3 | 125 | 13.5 | 3 |
| Comparative Example 1-10 | C17 | HT-17 | CA17 | PTFE 11 parts by mass | ○ | 0.25 | 1.3 | 125 | 13.5 | 1.5 |

From the results of Table-1, Examples 1-1 to 1-6 are excellent in overall balance. The dispersibility of Comparative Example 1-3 and Comparative Example 1-6 in which the amount of addition of the fluorine resin particles is large is at the level of x, and the value of the roughness is also large. As for the electrical properties, it is seen that Examples 1-1 to 1-6 are better than Comparative Examples 1-7 to 1-10. In addition, it is also seen that the leak resistance of the fluorine resin particles in Example 1-2 and Example 1-5 is better than that of Comparative Example 1-10. When comparing Examples 1-1 to 1-6 with Comparative Examples 1-1 to 1-3, it is seen that the effects of the present invention can be obtained when the addition amount of the fluorine resin particles is 3% by mass to 20% by mass from the viewpoint of abrasion resistance and leak resistance. Further, it is seen that the leakage resistance in Examples 1-2 and 1-5 is better that of Comparative Examples 1-8 and 1-9 even when a charging roll with a low volume resistance is used.

Examples 2-1 to 2-4 and Comparative Examples 2-1 to 2-12

Example 2-1

<Preparation of Undercoat Layer Forming Coating Liquid>

Rutile type titanium oxide ("TTO55N" manufactured by Ishihara Sangyo Kaisha, Ltd.) having an average primary particle diameter of 40 nm and 3% by mass of methyl dimethoxysilane ("TSL8117" manufactured by Toshiba Silicone Co., Ltd.) based on the titanium oxide were mixed in a Henschel mixer. 1 kg of a raw material slurry obtained by mixing 50 parts of the obtained surface treated titanium oxide and 120 parts of methanol was subjected to a dispersion treatment for 1 hour in a liquid circulation state with a rotor peripheral speed of 10 m/s and a liquid flow rate of 10 kg/h, with zirconia beads (YTZ manufactured by Nikkato Corporation) having a diameter of about 100 μm as dispersion media by using an ultra apex mill (UAM-015 type) having a mill volume of about 0.15 L manufactured by Kotobuki Industries Co., Ltd., so as to prepare a titanium oxide dispersion liquid.

The titanium oxide dispersion liquid, a mixed solvent of methanol/1-propanol/toluene, and pellets of a copolymerized polyamide containing ε-caprolactam [a compound represented by the following Formula (A)], bis(4-amino-3-methylcyclohexyl) methane [compound represented by the following Formula (B)], hexamethylenediamine [compound represented by the following Formula (C)], decamethylenedicarboxylic acid [compound represented by the following formula (D)] and octadecamethylene dicarboxylic acid [compound represented by the Following formula (E)] in a composition molar ratio of 75%, 9.5%, 3%, 9.5% and 3% were stirred and mixed with heating, so as to dissolve the polyamide pellets. Thereafter, the mixture was subjected to an ultrasonic dispersion treatment by using an ultrasonic transmitter with an output of 1200 W for 1 hour, and was further filtrated with PTFE membrane filter (Mytex LC, manufactured by Advantech Co., Ltd.) having a pore size of 5 μm. Thus, an undercoat layer forming coating liquid having surface-treated titanium oxide/copolymer polyamide in a mass ratio of 3/1, methanol/1-propanol/toluene in a mass ratio of 7/1/2, and a solid content concentration of 18.0% by mass was prepared.

A

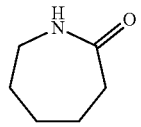

B

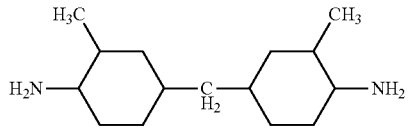

C

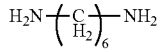

D

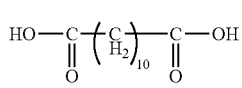

E

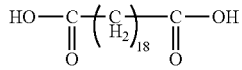

<Preparation of Charge Generation Layer Forming Coating Liquid>

Figure 2:
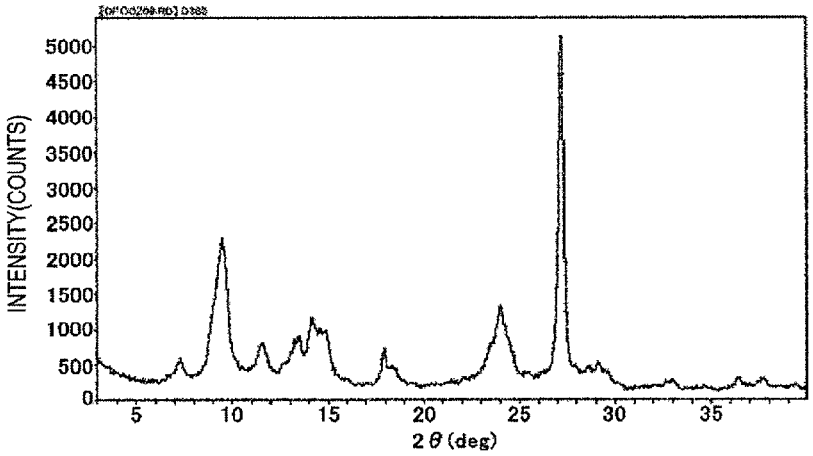
FIG. 2 is a figure showing a diffraction spectrum by a CuKα characteristic X-ray of D-form oxytitanium phthalocyanine used in Examples.

As the charge generation substance, 20 parts of oxytitanium phthalocyanine showing an X-ray diffraction spectrum by CuKα characteristic X-ray in FIGS. 2 and 280 parts of 1,2-dimethoxyethane were mixed with each other, and the mixture was subjected to a pulverization/dispersion treatment for 1 hour by using a sand grinding mill. Subsequently, the resultant fine treatment liquid was mixed with a binder liquid obtained by dissolving 10 parts of polyvinyl butyral (trade name "Denka Butyral" #6000C, manufactured by Denki Kagaku Kogyo K.K.) in a mixed solution containing 255 parts of 1,2-dimethoxyethane and 85 parts of 4-methoxy-4-methyl-2-pentanone, and with 230 parts by mass of 1,2-dimethoxyethane, so as to prepare a charge generation layer forming coating liquid.

<Preparation of Charge Transport Layer Forming Coating Liquid>

10 parts by mass of polytetrafluoroethylene resin particles (KTL-500F manufactured by Kitamura Chemical, average primary particle diameter=0.3 μm) and 0.5 part by mass of a fluorinated graft polymer (GF400, manufactured by TOAGOSEI CO., LTD.) were mixed with 90 parts by mass of tetrahydrofuran under stirring, and then the mixture was subjected to a dispersion treatment by increasing the pressure to 70 MPa using a high-pressure homogenizer (manufactured by Sugino Machine Co., Ltd.) equipped with a ball collision chamber, so as to obtain a suspension of the polytetrafluoroethylene resin particles.

Next, 100 parts of a polycarbonate resin (resin X, having a viscosity average molecular weight of 50,000) represented by the following repeating structure, 50 parts of a charge transport substance CTM-1 [E_homo=−4.349 eV] represented by the following formula, 4 parts of a compound AD1 represented by the following Formula, 1 part of AD2, 0.05 part of dimethylpolysiloxane (KF96-10CS manufactured by Shin-Etsu Chemical Co., Ltd.) were dissolved in 570 parts of a mixed solvent of tetrahydrofuran/toluene (80/20 (mass ratio)), the obtained mixture was mixed with the suspension of the polytetrafluoroethylene resin particles previously obtained, and the obtained mixture was stirred with a homogenizer, so as to prepare a charge transport layer forming coating liquid.

RESIN X

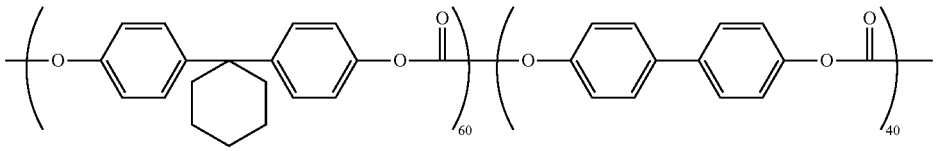

CTM-1

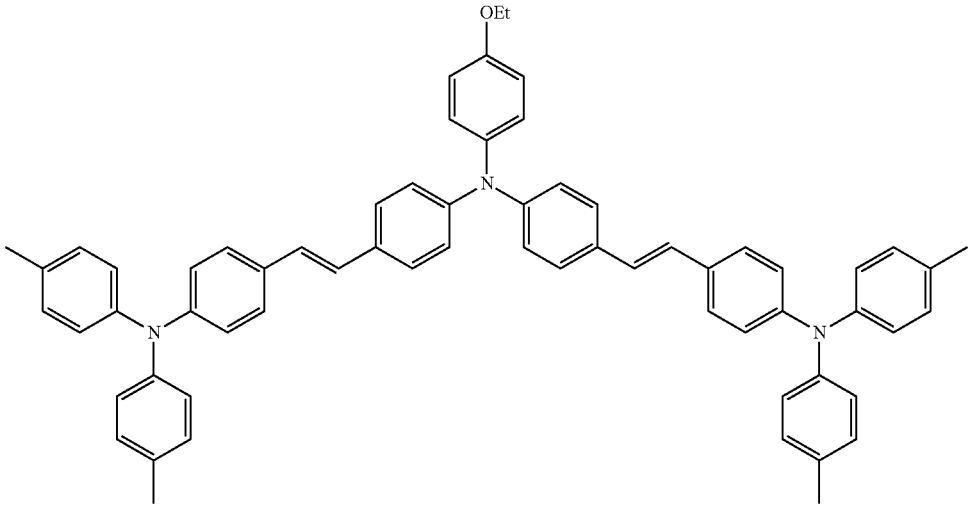

AD1

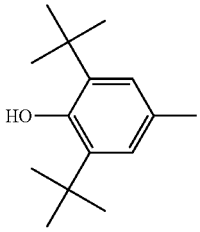

AD2

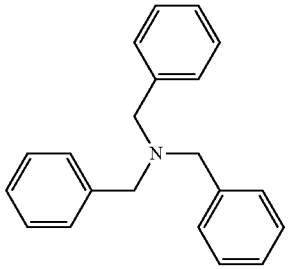

<Preparation of Photoreceptor Drum>

An undercoat layer forming coating liquid, a charge generation layer forming coating liquid, and a charge transport layer forming coating liquid which were prepared in the preparation example of the coating liquid were sequentially applied to a cylinder made of an aluminum alloy, of which the surface was subjected to a cutting process and which has an external diameter of 30 mm, a length of 254 mm, and a film thickness of 0.8 mm, by using a dip coating method, and dried to form an undercoat layer, a charge generation layer, and a charge transport layer such that the film thicknesses thereof after drying respectively were 1.5 μm, 0.4 μm, and 25 μm, and thereby an electrophotographic photoreceptor drum was prepared. Note that, the charge transport layer was dried at 125° C. for 24 minutes.

Example 2-2

A photoreceptor drum was prepared in the same manner as in Example 2-1, except that the amount of the charge transport substance CTM-1 used in <Preparation of Charge Transport Layer Forming Coating Liquid> in Example 2-1 was changed to 60 parts by mass.

Example 2-3

A photoreceptor drum was prepared in the same manner as in Example 2-1, except that the amount of the charge transport substance CTM-1 used in <Preparation of Charge Transport Layer Forming Coating Liquid> in Example 2-1 was changed to 40 parts by mass.

Example 2-4

A photoreceptor drum was prepared in the same manner as in Example 2-1, except that the charge transport substance CTM-1 used in <Preparation of Charge Transport Layer Forming Coating Liquid> in Example 2-1 was changed to a charge transport substance CTM-2 [E_homo=−4.400 eV] represented by the following formula.

Comparative Example 2-1

A photoreceptor drum was prepared in the same manner as in Example 2-1, except that the charge transport substance used in <Preparation of Charge Transport Layer Forming Coating Liquid> in Example 2-1 was changed to a charge transport substance CTM-A [E_homo=−4.576 eV] represented by the following formula.

CTM-A

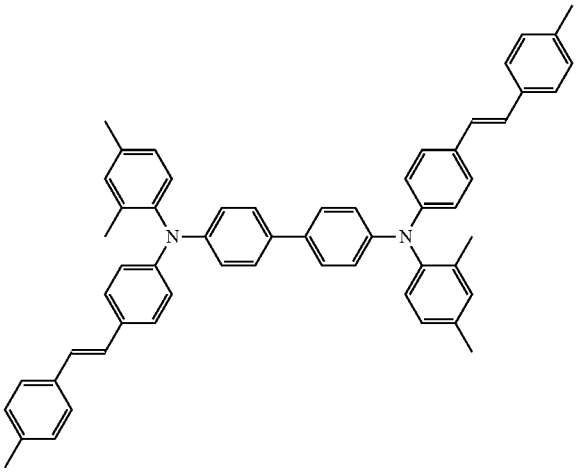

Comparative Example 2-2

A photoreceptor drum was prepared in the same manner as in Example 2-1, except that the charge transport substance used in <Preparation of Charge Transport Layer Forming Coating Liquid> in Example 2-1 was changed to the charge transport substance CTM-A as in Comparative Example 2-1 and the amount thereof was 60 parts by mass.

CTM-2

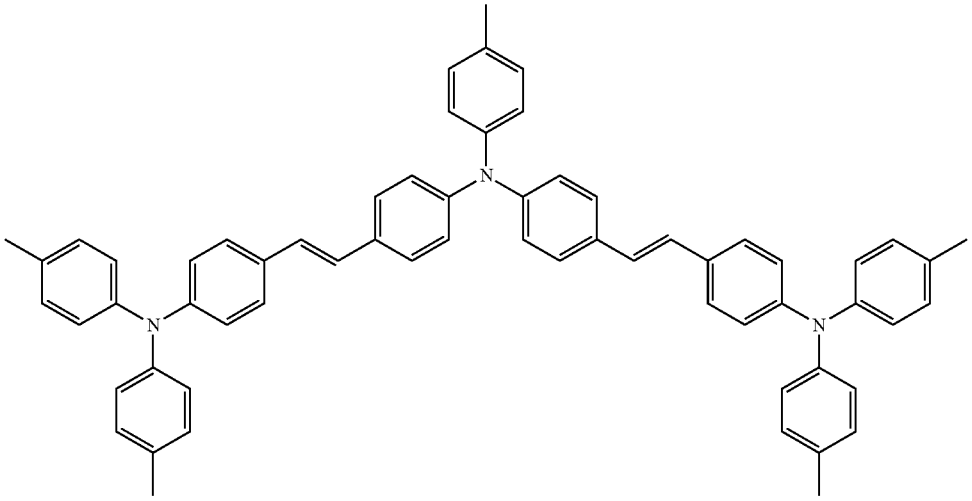

Comparative Example 2-3

A photoreceptor drum was prepared in the same manner as in Example 2-1, except that the charge transport substance used in <Preparation of Charge Transport Layer Forming Coating Liquid> in Example 2-1 was changed to a charge transport substance CTM-B [E_homo=−4.603 eV] represented by the following formula.

CTM-B

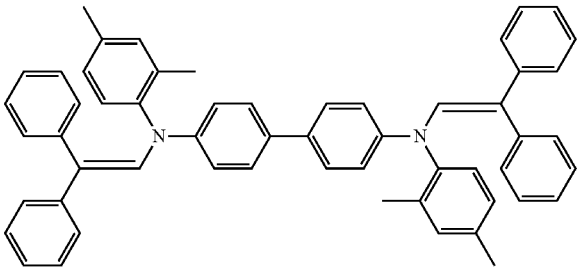

Comparative Example 2-4

A photoreceptor drum was prepared in the same manner as in Example 2-1, except that the charge transport substance used in <Preparation of Charge Transport Layer Forming Coating Liquid> in Example 2-1 was changed to the charge transport substance CTM-B as in Comparative Example 2-3 and the amount thereof was 60 parts by mass.

Comparative Example 2-5

A photoreceptor drum was prepared in the same manner as in Example 2-1, except that the charge transport substance used in <Preparation of Charge Transport Layer Forming Coating Liquid> in Example 2-1 was changed to a charge transport substance CTM-C [E_homo=−4.677 eV] represented by the following formula, and the amount thereof was 60 parts by mass.

CTM-C

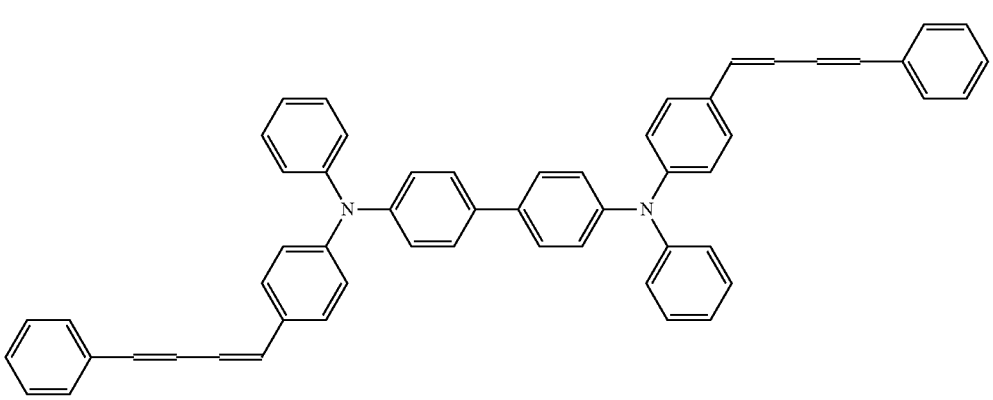

Comparative Example 2-6

A photoreceptor drum was prepared in the same manner as in Example 2-1, except that the charge transport substance used in <Preparation of Charge Transport Layer Forming Coating Liquid> in Example 2-1 was changed to a charge transport substance CTM-D [E_homo=−4.687 eV] represented by the following formula, and the amount thereof was 70 parts by mass.

CTM-D

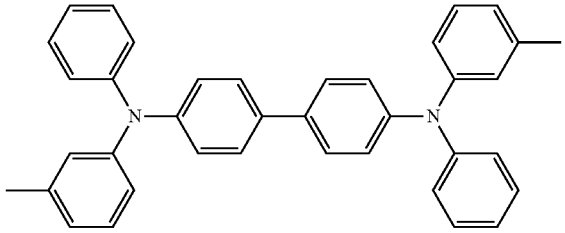

Comparative Example 2-7

A photoreceptor drum was prepared in the same manner as in Example 2-1, except that 100 parts of a polycarbonate resin (resin X, having a viscosity average molecular weight of 50,000) represented by the following repeating structure same as that in Example 2-1, 50 parts of a charge transport substance CTM-1 [E_homo=−4.349 eV] represented by the above formula, 4 parts of the compound AD1 represented by the above Formula, 1 part of AD2, 0.03 part of dimethylpolysiloxane (KF96-10CS manufactured by Shin-Etsu Chemical Co., Ltd.) were dissolved in 620 parts of a mixed solvent of tetrahydrofuran/toluene (80/20 (mass ratio)), so as to prepare a charge transport layer forming coating liquid.

Comparative Example 2-8

A photoreceptor drum was prepared in the same manner as in Comparative Example 2-7, except that the charge transport substance used in Comparative Example 2-7 was changed to the charge transport substance CTM-2 [E_homo=−4.400 eV] represented by the above formula.

Comparative Example 2-9

A photoreceptor drum was prepared in the same manner as in Comparative Example 2-7, except that the charge transport substance used in Comparative Example 2-7 was changed to the charge transport substance CTM-A [E_homo=−4.576 eV] represented by the above formula.

Comparative Example 2-10

A photoreceptor drum was prepared in the same manner as in Comparative Example 2-7, except that the charge transport substance used in Comparative Example 2-7 was changed to the charge transport substance CTM-B [E_homo=−4.603 eV] represented by the above formula.

Comparative Example 2-11

A photoreceptor drum was prepared in the same manner as in Comparative Example 2-7, except that the charge transport substance used in Comparative Example 2-7 was changed to the charge transport substance CTM-C [E_homo=−4.677 eV] represented by the above formula.

Comparative Example 2-12

A photoreceptor drum was prepared in the same manner as in Comparative Example 2-7, except that the charge transport substance used in Comparative Example 2-7 was changed to the charge transport substance CTM-D [E_homo=−4.687 eV] represented by the above formula.

<Repeated Durability Test>

The electrophotographic photoreceptors, which were prepared in examples and comparative examples under an environment of a room temperature of 35° C. and a relative humidity of 80%, were attached to an electrophotography property evaluation apparatus manufactured in accordance with the measurement standards of the Society of Electrophotography of Japan (as described in Foundation and Application of Electrophotographic Technique (Continued), edited by the Society of Electrophotography of Japan, published by CORONA PUBLISHING CO., LTD., (1996), Pages 404 to 405). Then, according to the following procedures, evaluation on electrical properties was performed by cycles of charge (minus polarity), exposure, potential measurement, and charge removal.

The photoreceptors were charged such that the initial surface potential thereof was −700 V, and were irradiated with the light of a halogen lamp made to be monochromatic light having a wavelength of 780 nm by an interference filter at an intensity of 0.8 μJ/cm$^2$, and after 100 ms, the surface potential (VL1) after exposure before the repeated durability test was measured (−V).

Then, after measuring the surface potential after the exposure and before the repeated durability test, a cycle of −700 V charging and about 15 μJ/cm$^2$ intensity discharging was repeated 5000 times with the above device. Thereafter, the photoreceptors were charged such that the surface potential thereof was −700 V, and were irradiated with the light from a halogen lamp made to be monochromatic light having a wavelength of 780 nm by an interference filter at an intensity of 0.8 μJ/cm$^2$, and after 100 ms, the surface potential (VL2) after exposure after the repeated durability test was measured.

A photoreceptor with a small variation before and after the repeated durability test indicates that the property change is smaller for repeated use, and has high stability and excellent durability as the electrical properties of a photoreceptor.

TABLE 2

| | Charge transport substance E_homo (−eV) [part by mass] | Fluorine resin particle (% by mass) | VL1 (−V) | VL2 (−V) | VL2 − VL1 (−V) |
|---|---|---|---|---|---|
| Example 2-1 | CTM-1 −4.394 [50] | 6.1 | 52 | 103 | 51 |
| Example 2-2 | CTM-1 −4.394 [60] | 5.7 | 48 | 89 | 41 |
| Example 2-3 | CTM-1 −4.394 [40] | 6.5 | 58 | 153 | 95 |
| Example 2-4 | CTM-2 −4.400 [50] | 6.1 | 55 | 112 | 57 |
| Comparative Example 2-1 | CTM-A −4.576 [50] | 6.1 | 78 | 382 | 304 |
| Comparative Example 2-2 | CTM-A −4.576 [60] | 5.7 | 63 | 335 | 272 |
| Comparative Example 2-3 | CTM-B −4.603 [50] | 6.1 | 97 | 464 | 367 |
| Comparative Example 2-4 | CTM-B −4.603 [60] | 5.7 | 106 | 428 | 322 |
| Comparative Example 2-5 | CTM-C −4.677 [60] | 5.7 | 135 | 494 | 359 |
| Comparative Example 2-6 | CTM-D −4.687 [70] | 5.4 | 65 | 413 | 348 |
| Comparative Example 2-7 | CTM-1 −4.394 [50] | 0 | 49 | 58 | 9 |
| Comparative Example 2-8 | CTM-2 −4.400 [50] | 0 | 50 | 62 | 12 |
| Comparative Example 2-9 | CTM-A −4.576 [50] | 0 | 67 | 82 | 15 |
| Comparative Example 2-0 | CTM-B −4.603 [50] | 0 | 78 | 92 | 14 |
| Comparative Example 2-11 | CTM-C −4.677 [50] | 0 | 95 | 111 | 16 |
| Comparative Example 2-12 | CTM-D −4.687 [50] | 0 | 108 | 126 | 18 |

In the results in Table-2, a photoreceptor with a small variation before and after the repeated durability test indicates that the property change is smaller for repeated use, and has high stability and excellent durability as the electrical properties of a photoreceptor.

Comparative Example 2-1 has a value of VL2-VL1 significantly higher than that of Comparative Example 2-9, while Example 2-1 has a value of VL2-VL1 a little higher than that of Comparative Example 2-7. It is apparently that the photoreceptor of the present invention has a small variation in surface potential after exposure before and after the repeated durability test, and the present invention can provide a photoreceptor having extremely high stability and excellent durability for repeated use.

While the present invention has been described in detail and with reference to specific embodiments, it will be apparent to those skilled in the art that various changes and modifications can be made without departing from the spirit and scope of the present invention. This application is based on a Japanese patent application (Japanese Patent Application No. 2017-012881) filed on Jan. 27, 2017 and a Japanese patent application (Japanese Patent Application No. 2017-056370) filed on Mar. 22, 2017, the contents of which are incorporated herein by reference.

INDUSTRIAL APPLICABILITY

The electrophotographic photoreceptor, the electrophotographic photoreceptor cartridge, and the image forming apparatus according to the present invention are expected to significantly contribute to high quality and long life in various image forming apparatuses such as copiers and printers.

REFERENCE SIGNS LIST

1 Photoreceptor (electrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Supply roller
44 Developing roller
45 Regulating member
71 Upper fixing member (fixing roller)
72 Lower fixing member (fixing roller)
73 Heating device
T Toner
P Recording paper (paper and medium)

The invention claimed is:

1. A lamination type electrophotographic photoreceptor comprising:

a conductive support; and a charge generation layer and a charge transport layer on the conductive support, wherein the charge transport layer contains a compound having a HOMO energy level (E_homo) of −4.550 eV or more based on structure optimization calculation by density functional calculation B3LYP/6-31G (d, p) and fluorine resin particles, and a content of the fluorine resin particles is 4.5% by mass to 12% by mass based on a total mass of the charge transport layer, wherein the compound having an E_homo of −4.550 eV or more includes a compound represented by the following Formula (1):

(1)

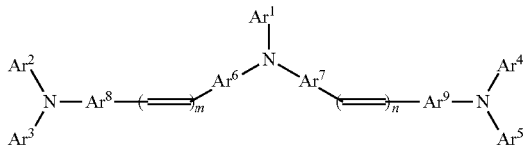

in the Formula (1), $Ar^1$ to $Ar_5$ each independently represent an aryl group which may have a substituent; $Ar^6$ to $Ar^9$ each independently represent a 1,4-phenylene group which may have a substituent; and m and n each independently represent an integer of 1 to 3, wherein the fluorine resin particle is selected from the group consisting of polytetrafluoroethylene, polychlorotrifluoroethylene, polyhexafluoropropylene, polyvinyl fluoride, polyvinylidene fluoride, polydichlorodifluoroethylene and a copolymer thereof, and wherein a ratio of a content (part by mass) of compounds represented by Formula (1) in the charge transport layer to a content (part by mass) of fluorine resin particles in the charge transport layer ranges from 2.6 to 6.0.

2. The electrophotographic photoreceptor according to claim 1, wherein a surface roughness (Rz) of the electrophotographic photoreceptor is 0.1 μm to 0.4 μm.

3. The electrophotographic photoreceptor according to claim 1, wherein in a stable structure of the compound having an E_homo of −4.550 eV or more, a calculated value αcal of a polarizability is 70 $A^3$ or more based on the density functional calculation B3LYP/6-31G (d, p) and HF/6-31G (d, p) calculation.

4. The electrophotographic photoreceptor according to claim 1, wherein an average primary particle diameter of the fluorine resin particles is 0.05 μm to 1 μm.

5. An electrophotographic photoreceptor cartridge comprising: the electrophotographic photoreceptor according to claim 1; and at least one device selected from the group consisting of: a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

6. An image forming apparatus comprising: the electrophotographic photoreceptor according to claim 1; a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

7. The electrophotographic photoreceptor according to claim 1, wherein the compound having an E_homo of −4.550 eV or more includes a compound represented by the following Formula (3)

(3)

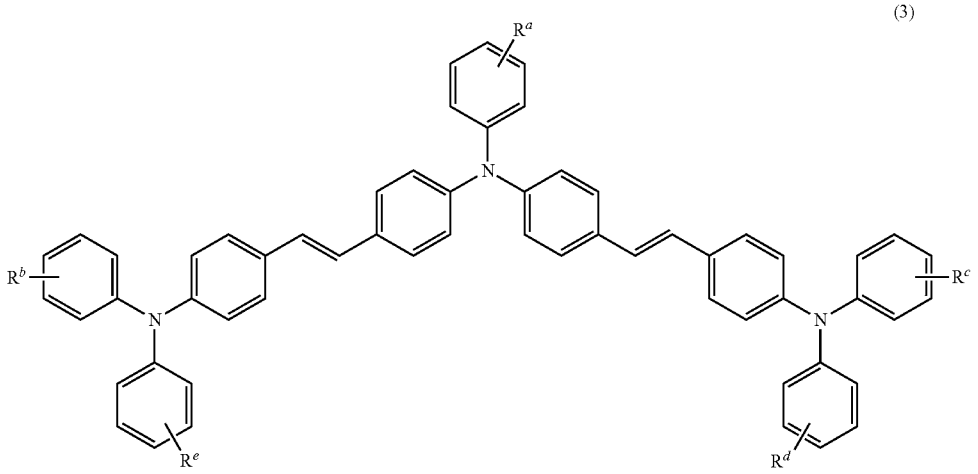

wherein $R^a$ to $R^e$ each independently represent an alkyl group, an alkoxy group, an aryloxy group, an aralkyloxy group or a hydrogen atom.

8. The electrophotographic photoreceptor according to claim 1, wherein the content of the fluorine resin particles is 4.5% by mass to 10% by mass, based on the total mass of the charge transport layer.

9. A lamination type electrophotographic photoreceptor comprising:

a conductive support; and a charge generation layer and a charge transport layer on the conductive support, wherein the charge transport layer contains a compound represented by the following Formula (1) and fluorine resin particles, and a content of the fluorine resin particles is 4.5% by mass to 12% by mass based on a total mass of the charge transport layer, (1)

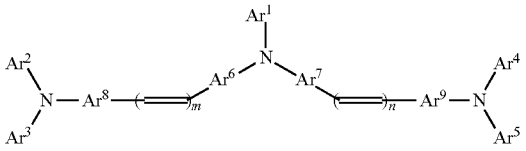

in the Formula (1), $Ar^1$ to $Ar^5$ each independently represent an aryl group which may have a substituent; $Ar^6$ to $Ar^9$ each independently represent a 1,4-phenylene group which may have a substituent; and m and n each independently represent an integer of 1 to 3, wherein the fluorine resin particle is selected from the group consisting of polytetrafluoroethylene, polychlorotrifluoroethylene, polyhexafluoropropylene, polyvinyl fluoride, polyvinylidene fluoride, polydichlorodifluoroethylene and a copolymer thereof, and wherein a ratio of a content (part by mass) of compounds represented by Formula (1) in the charge transport layer to a content (part by mass) of fluorine resin particles in the charge transport layer ranges from 2.6 to 6.0.

10. An electrophotographic photoreceptor cartridge comprising: the electrophotographic photoreceptor according to claim 9; and at least one device selected from the group consisting of: a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

11. An image forming apparatus comprising: the electrophotographic photoreceptor according to claim 9; a charging device which charges the electrophotographic photoreceptor; an exposure device which exposes the charged electrophotographic photoreceptor so as to form an electrostatic latent image; and a developing device which develops the electrostatic latent image formed on the electrophotographic photoreceptor.

12. The electrophotographic photoreceptor according to claim 1, wherein the content of the fluorine resin particles is 5% by mass to 10% by mass, based on the total mass of the charge transport layer.

* * * * *